US010653901B2

(12) United States Patent
Nguyen et al.

(10) Patent No.: US 10,653,901 B2
(45) Date of Patent: May 19, 2020

(54) RESPIRATOR HAVING ELASTIC STRAPS HAVING OPENWORK STRUCTURE

(71) Applicant: 3M INNOVATIVE PROPERTIES COMPANY, St. Paul, MN (US)

(72) Inventors: Nhat Ha T. Nguyen, Woodbury, MN (US); Ronald W. Ausen, St. Paul, MN (US); Thomas J. Xue, St. Paul, MN (US); Seyed A. Angadjivand, Los Angeles, CA (US)

(73) Assignee: 3M Innovative Properties Company, St. Paul, MN (US)

( * ) Notice: Subject to any disclaimer, the term of this patent is extended or adjusted under 35 U.S.C. 154(b) by 744 days.

(21) Appl. No.: 14/628,365

(22) Filed: Feb. 23, 2015

(65) Prior Publication Data

US 2015/0238783 A1 Aug. 27, 2015

Related U.S. Application Data

(60) Provisional application No. 61/945,456, filed on Feb. 27, 2014.

(51) Int. Cl.
*A62B 18/02* (2006.01)
*A62B 18/08* (2006.01)
(Continued)

(52) U.S. Cl.
CPC ..... *A62B 18/084* (2013.01); *A41D 13/1161* (2013.01); *A62B 18/02* (2013.01); *A62B 18/10* (2013.01); *A62B 23/025* (2013.01)

(58) Field of Classification Search
CPC . A41D 13/1161; A41D 13/11; A41D 13/1115; A42B 1/248; A45C 13/08;
(Continued)

(56) References Cited

U.S. PATENT DOCUMENTS 1,616,272 A * 2/1927 Martin ..... A41F 3/00 139/388
2,484,125 A * 10/1949 Silvain ..... D02G 3/328 139/421
(Continued)

FOREIGN PATENT DOCUMENTS

AU 2014-101151 12/2014
CN 2704338 U 6/2005
(Continued)

OTHER PUBLICATIONS

Elasticated definition and meaning, Collins English Dictionary, Jun. 2018.*
(Continued)

*Primary Examiner* — Annette Dixon

(57) ABSTRACT

Various embodiments of a respirator are disclosed. The respirator can include a mask body and one or more elastic straps that are secured to the mask body on opposing sides. The elastic straps can have an openwork construction and can include a netting that has an array of polymeric strands periodically joined together at bond regions throughout the array. In one or more embodiments, the openwork elastic straps are lighter and more breathable than conventional straps. This improvement in breathability can make the respirator more comfortable to wear.

13 Claims, 23 Drawing Sheets

(51) Int. Cl.
*A62B 18/10* (2006.01)
*A62B 23/02* (2006.01)
*A41D 13/11* (2006.01)

(58) Field of Classification Search
CPC ..... A45C 13/26; A61F 13/15593; A61F 13/4902; A61F 5/56; A61M 16/06; A61M 16/0611; A61M 16/0622; A61M 16/0633; A61M 16/0644; A61M 16/0666; A61M 16/0683; A61M 16/08; A61M 16/0816; A61M 16/0825; A61M 16/0833; A61M 2016/0661; A61M 2205/0216; A61M 2207/00; A62B 18/025; A62B 18/084; A63B 21/4017; A63B 21/4019; B25G 1/10; B29C 65/18; B29C 66/1122; B29C 66/234; B29C 66/41; B29C 66/43; B29C 66/71; B29C 66/7294; B29C 66/81433; B29C 66/83413; B29K 2021/003; B29K 2096/04; B29K 2995/0046; B29L 2031/4878; B32B 2262/0215; B32B 2262/023; B32B 2262/0253; B32B 2307/51; B32B 2555/02; B32B 3/28; B32B 5/022; B32B 5/04; D04H 1/559; Y10S 428/903; Y10T 428/24446; Y10T 428/24826; Y10T 428/249921; Y10T 428/249953; Y10T 442/40
USPC ..... 139/423
See application file for complete search history.

(56) References Cited

U.S. PATENT DOCUMENTS 3,082,767 A 3/1963 Matheson
3,178,328 A * 4/1965 Tittmann ..... B29C 47/0033 156/167
3,471,588 A 10/1969 Kanner
3,521,630 A 7/1970 Westberg
RE28,102 E * 8/1974 Mayhew ..... A41D 13/1115 128/206.19
3,932,092 A 1/1976 Hureau
3,971,373 A 7/1976 Braun
4,013,816 A 3/1977 Sabee
4,062,995 A * 12/1977 Korpman ..... B29C 47/0033 264/154
4,215,682 A 8/1980 Kubik
4,328,840 A * 5/1982 Fontana ..... D03D 19/00 139/419
4,328,841 A * 5/1982 Fontana ..... D03D 13/006 139/419
4,329,309 A * 5/1982 Kelly ..... A61L 15/225 264/154
4,333,782 A * 6/1982 Pieniak ..... A61F 13/15593 156/164
4,381,326 A 4/1983 Kelly
RE31,285 E 6/1983 Van Turnhout
4,536,440 A 8/1985 Berg
4,588,537 A 5/1986 Klasse
4,720,415 A * 1/1988 Vander Wielen ..... B32B 5/04 428/152
4,790,306 A 12/1988 Braun
4,798,850 A 1/1989 Brown
4,807,619 A 2/1989 Dyrud
4,848,334 A * 7/1989 Bellm ..... A61M 16/06 128/206.24
5,038,776 A * 8/1991 Harrison ..... A62B 18/084 128/201.23
5,046,200 A * 9/1991 Feder ..... A61F 9/027 128/207.11
5,052,084 A 10/1991 Braun
5,237,986 A 8/1993 Seppala
5,307,796 A 5/1994 Kronzer
5,325,892 A 7/1994 Japuntich
5,334,446 A * 8/1994 Quantrille ..... D01G 25/00 428/109
5,413,849 A * 5/1995 Austin ..... D04H 1/54 28/104
5,496,507 A 3/1996 Angadjivand
5,558,089 A 9/1996 Castiglione
D378,610 S 3/1997 Reischel
5,628,092 A * 5/1997 Harris ..... G02C 3/003 24/3.3
5,656,368 A 8/1997 Braun
5,699,791 A * 12/1997 Sukiennik ..... A41D 13/1115 128/206.13
5,803,077 A 9/1998 Gazzara
5,804,295 A 9/1998 Braun
5,885,686 A 3/1999 Cederblad
5,908,598 A 6/1999 Rousseau
5,918,598 A 7/1999 Belfer
D412,573 S 8/1999 Castiglione
5,948,517 A 9/1999 Adamko
D421,118 S 2/2000 Reischel
6,041,782 A 3/2000 Angadjivand
6,062,221 A 5/2000 Brostrom
6,070,578 A * 6/2000 Baughman ..... A41D 13/1192 128/205.27
6,070,579 A 6/2000 Bryant
6,090,234 A * 7/2000 Barone ..... B29C 70/224 156/177
6,123,077 A 9/2000 Bostock
6,228,449 B1 5/2001 Meyer
6,277,178 B1 8/2001 Hilmquist-Brown
6,279,168 B1 * 8/2001 Bean ..... A42B 1/248 2/195.1
6,280,676 B1 * 8/2001 Cederblad ..... B29D 28/00 264/291
6,332,465 B1 12/2001 Xue
6,334,671 B1 1/2002 Umehara
6,348,249 B2 2/2002 Meyer
6,375,886 B1 4/2002 Angadjivand
6,391,420 B1 5/2002 Cederblad
6,391,429 B1 5/2002 Senkus
6,394,090 B1 5/2002 Chen
6,397,458 B1 6/2002 Jones
6,398,847 B1 6/2002 Jones
6,406,657 B1 6/2002 Eitzman
6,409,806 B1 6/2002 Jones
6,436,529 B1 8/2002 Deeb
6,454,986 B1 9/2002 Eitzman
6,457,473 B1 10/2002 Brostrom
6,465,107 B1 10/2002 Kelly
6,484,722 B2 11/2002 Bostock
D467,656 S 12/2002 Mittelstadt
6,492,286 B1 12/2002 Berrigan
RE37,974 E 2/2003 Bowers
D471,627 S 3/2003 Mittelstadt
6,568,392 B1 5/2003 Bostock
6,591,837 B1 7/2003 Byram
6,644,314 B1 * 11/2003 Elsberg ..... A41D 13/11 128/205.27
6,692,606 B1 * 2/2004 Cederblad ..... B29D 28/00 156/166
6,715,490 B2 4/2004 Byram
6,732,733 B1 5/2004 Brostrom
6,743,464 B1 6/2004 Insley
6,783,574 B1 8/2004 Angadjivand
6,824,718 B2 11/2004 Eitzman
6,843,248 B2 1/2005 Japuntich
6,854,463 B2 2/2005 Japuntich
6,874,499 B2 4/2005 Viner
6,878,647 B1 * 4/2005 Rezai ..... A61F 13/49012 264/288.8
6,883,518 B2 4/2005 Mittelstadt
6,923,182 B2 8/2005 Angadjivand
6,967,178 B2 * 11/2005 Zhou ..... A61F 13/15593 428/343
7,013,895 B2 3/2006 Martin
D518,571 S 4/2006 Martin
7,028,689 B2 4/2006 Martin

(56) References Cited

U.S. PATENT DOCUMENTS

| | | | | |
|---|---|---|---|---|
| 7,117,868 | B1 | 10/2006 | Japuntich | |
| 7,131,442 | B1 | 11/2006 | Kronzer | |
| RE39,493 | E | 2/2007 | Yuschak | |
| 7,188,622 | B2 | 3/2007 | Martin | |
| 7,302,951 | B2 | 12/2007 | Mittelstadt | |
| 7,311,104 | B2 | 12/2007 | Japuntich | |
| 7,428,903 | B1 | 9/2008 | Japuntich | |
| 7,490,634 | B2 * | 2/2009 | Resendez | D03D 1/00 139/420 A |
| 7,594,510 | B2 | 9/2009 | Betz | |
| 7,650,884 | B2 | 1/2010 | Flannigan | |
| D613,850 | S | 4/2010 | Holmquist-Brown | |
| 7,799,162 | B2 * | 9/2010 | Wood | A61F 13/15593 156/230 |
| 8,067,110 | B2 | 11/2011 | Rakow | |
| D652,507 | S | 1/2012 | Mittelstadt | |
| D659,821 | S | 5/2012 | Spoo | |
| 8,596,224 | B2 | 12/2013 | Taylor | |
| 8,733,711 | B2 | 5/2014 | Fristoe | |
| 8,800,563 | B2 | 8/2014 | Doherty | |
| 9,314,962 | B2 * | 4/2016 | Rothwell | B29C 55/08 |
| 2002/0001707 | A1 * | 1/2002 | Zhang | C08L 53/02 428/318.6 |
| 2002/0016122 | A1 * | 2/2002 | Curro | A47L 1/15 442/381 |
| 2002/0104202 | A1 * | 8/2002 | Henry | A45F 5/00 24/306 |
| 2002/0125596 | A1 * | 9/2002 | Cederblad | B29D 28/00 264/40.1 |
| 2005/0081857 | A1 | 4/2005 | Fenton | |
| 2006/0137690 | A1 * | 6/2006 | Gunaratnam | A61M 16/0666 128/206.11 |
| 2007/0044803 | A1 | 3/2007 | Xue | |
| 2007/0068529 | A1 | 3/2007 | Kalatoor | |
| 2007/0181135 | A1 * | 8/2007 | Baker | A61F 5/56 128/848 |
| 2007/0251522 | A1 * | 11/2007 | Welchel | A41D 13/11 128/201.15 |
| 2008/0023006 | A1 | 1/2008 | Kalatoor | |
| 2008/0047560 | A1 * | 2/2008 | Veliss | A61M 16/06 128/206.24 |
| 2008/0095978 | A1 * | 4/2008 | Siqueira | A61F 13/4902 428/137 |
| 2008/0099022 | A1 | 5/2008 | Gebrewold | |
| 2009/0090364 | A1 | 4/2009 | Daugaard | |
| 2009/0145444 | A1 * | 6/2009 | Edwards | A41D 13/1107 128/858 |
| 2010/0000544 | A1 * | 1/2010 | Blaszczykiewicz | A61F 5/56 128/207.17 |
| 2010/0031962 | A1 | 2/2010 | Chiu | |
| 2010/0154805 | A1 | 6/2010 | Duffy | |
| 2011/0057002 | A1 * | 3/2011 | Westra | A45F 5/10 224/218 |
| 2011/0067700 | A1 | 3/2011 | Duffy | |
| 2011/0156314 | A1 | 6/2011 | Alberg | |
| 2011/0180078 | A1 * | 7/2011 | McKinley | A41D 13/1161 128/863 |
| 2012/0047614 | A1 * | 3/2012 | Choi | A41D 13/1161 2/9 |
| 2012/0067942 | A1 * | 3/2012 | Quehl | B42D 3/10 229/67.4 |
| 2012/0103339 | A1 * | 5/2012 | Koehler | A41D 13/1146 128/206.14 |
| 2012/0125797 | A1 * | 5/2012 | Foye | A45C 13/30 206/494 |
| 2012/0199131 | A1 * | 8/2012 | Sofranko | A61M 16/06 128/206.21 |
| 2013/0074845 | A1 * | 3/2013 | Smith | A61M 16/06 128/205.25 |
| 2013/0149925 | A1 | 6/2013 | Handziak | |
| 2013/0186414 | A1 * | 7/2013 | Suzuki | A41D 13/1161 128/863 |
| 2013/0247916 | A1 | 9/2013 | Symons | |
| 2013/0312760 | A1 | 11/2013 | Kostyk | |
| 2014/0209098 | A1 * | 7/2014 | Dunn | A61M 16/0683 128/206.21 |
| 2014/0234605 | A1 * | 8/2014 | Ausen | B29D 28/00 428/219 |
| 2016/0002838 | A1 * | 1/2016 | Ausen | B29C 47/0035 442/50 |

FOREIGN PATENT DOCUMENTS

| | | |
|---|---|---|
| EP | 1495785 | 1/2005 |
| GB | 2200281 | 8/1988 |
| GB | 2480288 | 11/2011 |
| JP | 04332567 | 11/1992 |
| JP | 3115302 U | 11/2005 |
| JP | 3162641 U | 9/2010 |
| JP | 5240638 | 7/2013 |
| JP | 2014-030584 | 2/2014 |
| KR | 10-2007-0071962 | 7/2007 |
| KR | 10-2009-0077454 | 7/2009 |
| KR | 10-0973995 | 8/2010 |
| KR | 10-2011-0004564 | 1/2011 |
| KR | 10-1074601 | 10/2011 |
| KR | 10-2012-0055440 | 5/2012 |
| TH | 69699 | 7/2005 |
| TW | 2011-21595 | 7/2011 |
| WO | WO 1996-028216 | 9/1996 |
| WO | WO 1996-039349 | 12/1996 |
| WO | WO 1997-032493 | 9/1997 |
| WO | WO 1998-031743 | 7/1998 |
| WO | WO 2009-022250 | 2/2009 |
| WO | WO 2011-014931 | 2/2011 |
| WO | WO 2013-028654 | 2/2013 |
| WO | WO 2013-032683 | 3/2013 |
| WO | WO 2013-052371 | 4/2013 |
| WO | WO 2014-164242 | 10/2014 |

OTHER PUBLICATIONS

Davies, "The Separation of Airborne Dust Particles", Institution of Mechanical Engineers Proceedings, vol. 1B, No. 1-12, 1952, pp. 185-198.

Wente, "Superfine Thermoplastic Fibers", Industrial and Engineering. Chemistry, 1956, pp. 1342-1346.

International Application PCT/US2015/017036 Search Report dated Apr. 9, 2015.

* cited by examiner

RESPIRATOR HAVING ELASTIC STRAPS HAVING OPENWORK STRUCTURE

BACKGROUND

Respirators are commonly worn over a person's breathing passages for at least one of two common purposes: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

Respirators are regularly provided with a harness that includes one or more straps. These straps are commonly made of an elastomeric material such as a braided web or a Kraton rubber. See, e.g., U.S. Pat. No. 6,332,465 to Xue, WO9831743 to Deeb et al., and WO9732493 A1 to Bryant et al. These straps typically are solid in appearance—that is, you cannot see through the strap, partially or totally. The solid nature of the known straps can add to overall product weight and increase heat retention on a wearer's neck. Additionally, conventional respirator straps are constructed such that the strap exhibits one color throughout. Both major strap surfaces therefore have the same appearance. As such it can be difficult to notice if the strap is twisted. The straps also are deprived of any opportunity to be aesthetically colorful or artistic by exhibiting more than one color or by exhibiting a generally plain solid appearance.

A variety of known respirators and their harnesses are shown in the following U.S. patents: RE39,493 to Yuschak et al.; U.S. Pat. No. 4,790,306 to Braun; U.S. Pat. No. 7,131,442 to Kronzer et al.; U.S. Pat. Nos. 6,923,182 and 6,041,782 to Angadjivand et al.; U.S. Pat. No. 4,807,619 to Dyrud et al.; U.S. Pat. No. 4,536,440 to Berg; U.S. Pat. Nos. 6,568,392 and 6,484,722 to Bostock et al.; and U.S. Pat. No. 6,394,090 to Chen. See also U.S. Patent Application Nos. 2001/0067700 and 2010/0154805 to Duffy et al.; U.S. Design Pat. No. 659,821 to Spoo et al.; U.S. Pat. No. 3,521,630 to Westberg et al.; and Korean Patent No. 100467924.

SUMMARY

In one aspect, the present disclosure provides a respirator that includes a mask body and a harness that includes one or more elastic straps that are joined to the mask body on opposing sides of thereof. The elastic strap(s) includes a netting that has an array of polymeric strands periodically joined together at bond regions throughout the array but do not substantially cross over each other.

In another aspect, the present disclosure provides a respirator that includes a mask body and a harness that includes one or more elastic straps that have an openwork construction.

In one or more embodiments, the openwork construction may be in the form of a netting that has an array of polymeric strands periodically joined together at bond regions throughout the array but do not substantially cross over each other. Since the straps are openwork, the straps can have a "see-through" appearance with open spaces or voids between the strands. The porous construction of the straps allows them to breathe, which allows heat to be more readily displaced, making the strap more comfortable to the wearer. The straps also can be lighter in weight than conventional straps because they are not solid throughout. In one or more embodiments, first and second arrays can be juxtaposed upon each other, with each array being provided with a different color. The different colors on each side of the strap can enable the wearer to readily detect if the strap is twisted. The different colored arrays can also allow for various aesthetic designs to be provided.

Glossary

The terms set forth below will have the meanings as defined:

"array" means an ordered arrangement;

"bond regions" means areas and/or volumes of two or more strands where the two or more strands are held together;

"comprises" or "comprising" means its definition as is standard in patent terminology, being an open-ended term that is generally synonymous with "includes", "having", or "containing" Although "comprises", "includes", "having", and "containing" and variations thereof are commonly-used, open-ended terms, this disclosure also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"cross over" means to continue past the intersection;

"crosswise dimension" is the dimension that extends laterally across the respirator, from side-to-side when the respirator is viewed from the front;

"contaminants" means particles (including dusts, mists, and fumes) and/or other substances that generally may not be considered to be particles (e.g., organic vapors, etc.) but which may be suspended in air;

"cup-shaped configuration," and variations thereof, mean any vessel-type shape that is capable of adequately covering the nose and mouth of a person;

"elastic" means being able to be stretched at least 100% and return essentially to the original dimension without imparting damage to the strap;

"do not substantially" in reference to crossing over means at least 50% do not;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" means a generally air-permeable construction that filters air;

"harness" means a structure or combination of parts that assists in supporting a mask body on a wearer's face;

"interior gas space" means the space between a mask body and a person's face;

"joined to" means secured to directly or indirectly;

"mask body" means a structure that is designed to fit over the nose and mouth of a person and that helps define an interior gas space separated from an exterior gas space;

"netting" means an openwork structure where the openings are in an ordered arrangement;

"polymer" means a material that contains repeating chemical units, regularly or irregularly arranged;

"polymeric" and "plastic" each mean a material that mainly includes one or more polymers and that may contain other ingredients as well;

"openwork" means having open spaces sized to be large enough for air to easily pass therethrough and for a person to see therethrough with the naked eye (i.e., without the assistance of an instrument);

"opposing" means opposite;

"plurality" means two or more;

"respirator" means an air filtration device that is worn by a person to provide the wearer with clean air to breathe;

"side" means an area on the mask body distanced from a plane that bisects the mask body centrally and vertically when the mask body is oriented in an upright position and viewed from the front;

"strand" means an elongated filamentary or threadlike type structure; and

"strap" means a generally flat elongated structure.

DETAILED DESCRIPTION

Figure 1:
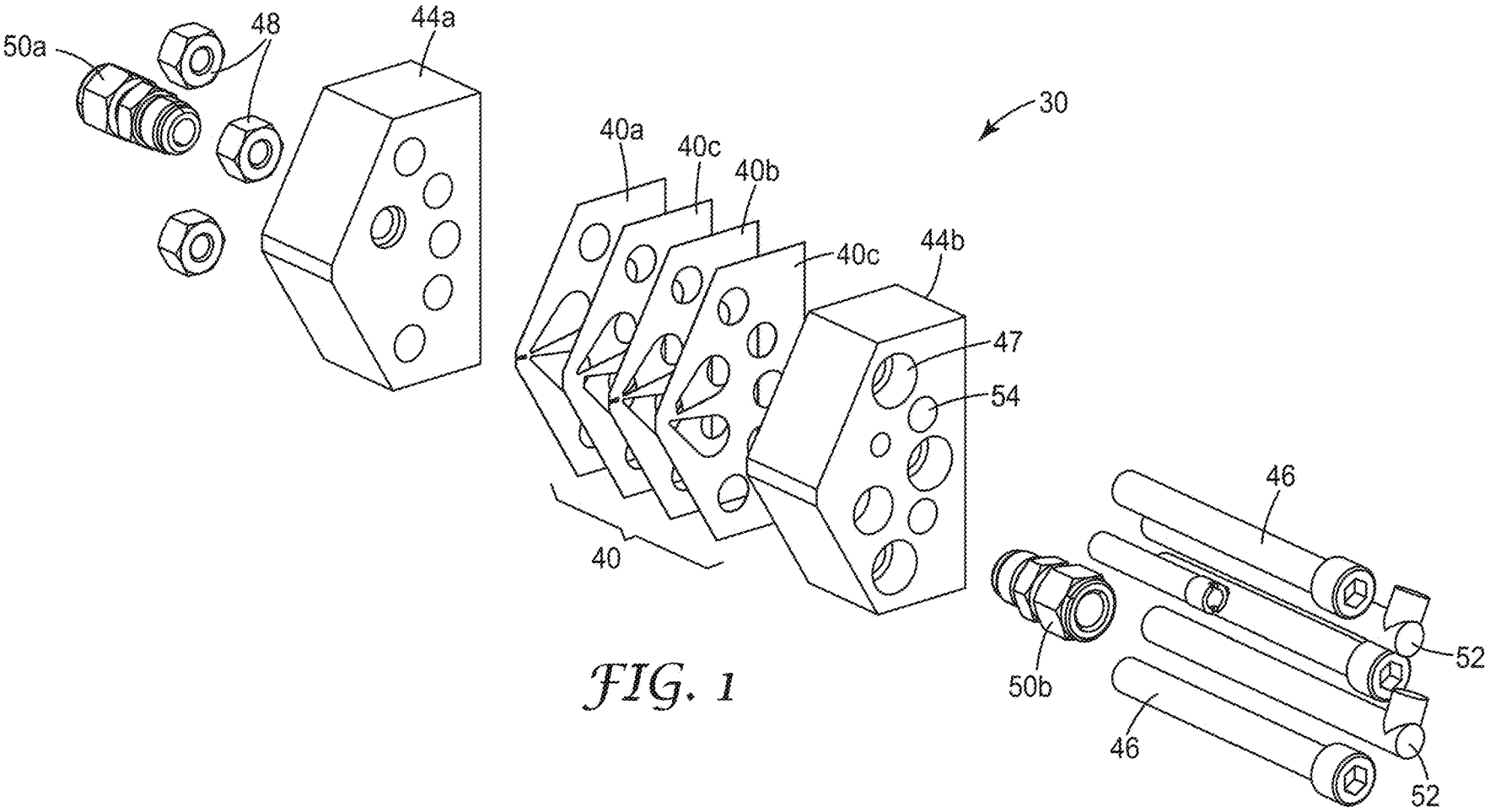
FIG. 1 is an exploded perspective view of an exemplary embodiment of a set of extrusion die elements of the present disclosure, including a plurality of shims, a set of end blocks, bolts for assembling the components, and inlet fittings for the materials to be extruded.

In the practice of the present disclosure, a new respirator is provided that has elastic straps in a harness, which straps are unique in design and performance. The respirator has a mask body and one or more elastic harness straps. The elastic straps can have an openwork construction and may be in the form of a netting. The netting may include an array of polymeric strands periodically joined together at bond regions throughout the array but do not substantially cross over each other. The use of openwork elastic straps can allow for a lighter weight product, since the strap is not solid throughout. The openwork construction can also allow the strap to breathe in that air can easily pass through it. When the strap is in contact with a person's neck, a more comfortable contacting relationship may be achieved between the wearer's neck and the strap. Also an aesthetic appearance not heretofore provided in the respirator art can be exhibited by the openwork array of strands that include the strap. The use of dual layers of the netting can further allow multiple colors to be displayed on each side of the strap, allowing the user to easily notice if the strap is twisted and to make the product more colorful.

Straps suitable for use in the present disclosure are described in PCT/US2012/051660, filed Aug. 21, 2012, which claims priority to U.S. Provisional Application No. 61/526,001, filed Aug. 22, 2011. The straps described in this copending patent application have a netting including an array of polymeric strands (in some embodiments. at least alternating first and second (optionally third, fourth, or more) polymeric strands) periodically joined together at bond regions throughout the array, but do not substantially cross over each other (i.e., at least 50 (at least 55, 60, 65, 70, 75, 80, 85, 90, 95, 99, or even 100) percent by number), where the netting can have a thickness up to about 1 millimeter (mm), more typically up to about 0.5 mm. The open spaces in the openwork structure can be about 0.1 to 40 $mm^2$ in size, more typically about 0.3 to 20 $mm^2$ in size. The strands can have a cross-sectional area of about 0.03 to 1 $mm^2$, more typically about 0.05 to 0.5 $mm^2$.

For embodiments having first and second polymeric strands, the polymers of the first and second polymeric strands may be the same or different. See also Patent Applications Nos. PCT/US2012/050746 and PCT/US2012/057900 for further description of netting, arrays, and strands that may be used in elastic straps suitable for use in respirators of the present disclosure.

There may be an array of alternating first and second polymeric strands, where the first and second strands periodically join together at bond regions throughout the array, where the first strands have average first yield strength, and where the second strands have an average second yield strength that is different (e.g., at least 10 percent different) than the first yield strength. In making a netting, there may be an extrusion die including a plurality of shims positioned adjacent to one another, the shims together defining a cavity and a dispensing surface, where the dispensing surface has an array of first dispensing orifices alternating with an array of second dispensing orifices, where the plurality of shims includes a plurality of a repeating sequence of shims including a shim that provides a fluid passageway between the cavity and the first dispensing orifices and a shim that provides a fluid passageway between the cavity and the second dispensing orifices, where the first array of fluid passageways has greater fluid restriction than the second array of fluid passageways. Typically, the fluid passageway between cavity and dispensing orifice is up to 5 mm in length.

In making a netting, there may be an extrusion die including a plurality of shims positioned adjacent to one another, the shims together defining a first cavity, a second cavity, and a dispensing surface, where the dispensing surface has an array of first dispensing orifices alternating with an array of second dispensing orifices, where the plurality of shims includes a plurality of a repeating sequence of shims including a shim that provides a fluid passageway between the first cavity and one of the first dispensing orifices and a shim that provides a fluid passageway between the second cavity and one of second the dispensing orifices Typically, the fluid passageway between a cavity and a dispensing orifice is up to 5 mm in length. Typically, each of the dispensing orifices of the first and the second arrays has a width, and each of the dispensing orifices of the first and the second arrays are separated by up to 2 times the width of the respective dispensing orifice.

In making a netting, there may be an extrusion die including a plurality of shims positioned adjacent to one another, the shims together defining a cavity and a dispensing surface, where the dispensing surface has at least one net-forming zone and at least one ribbon-forming zone, where the net-forming zone has an array of first dispensing orifices alternating with an array of second dispensing orifices. In some embodiments, each of the dispensing orifices of the first and the second arrays has a width, and each of the dispensing orifices of the first and the second arrays are separated by up to 2 times the width of the respective dispensing orifice.

In making a netting, there may be an extrusion die including a plurality of shims positioned adjacent to one another, the shims together defining a first cavity, a second cavity, and a dispensing surface, where the dispensing surface has at least one net-forming zone and at least one ribbon-forming zone, where the net-forming zone has an array of first dispensing orifices alternating with an array of second dispensing orifices. In some embodiments, each of the dispensing orifices of the first and the second arrays has a width, and each of the dispensing orifices of the first and the second arrays are separated by up to 2 times the width of the respective dispensing orifice.

The present disclosure describes a method of making a netting and arrays of polymeric strands described herein, the method including one of Method I or Method II:

Method I providing an extrusion die including a plurality of shims positioned adjacent to one another, the shims together defining a cavity, the extrusion die having a plurality of first dispensing orifices in fluid communication with the cavity and a plurality of second dispensing orifices in fluid communication with the cavity, such that the first and second dispensing orifices are alternated; and dispensing first polymeric strands from the first dispensing orifices at a first strand speed while simultaneously dispensing second polymeric strands from the second dispensing orifices at a second strand speed, where the first strand speed is at least 2 (in some embodiments, in a range from 2 to 6, or even 2 to 4) times the second strand speed to provide the netting (i.e., the first and second dispensing orifices in fluid communication with the (single) cavity such that in use the first and second strand speeds are sufficiently different to produce net bonding); or Method II providing an extrusion die including a plurality of shims positioned adjacent to one another, the shims together defining a first cavity and a second cavity, the extrusion die having a plurality of first dispensing orifices in fluid communication with the first cavity and having a plurality of second dispensing orifices connected to the second cavity, such that the first and second dispensing orifices are alternated; and dispensing first polymeric strands from the first dispensing orifices at a first strand speed while simultaneously dispensing second polymeric strands from the second dispensing orifices at a second strand speed, where the first strand speed is at least 2 (in some embodiments, in a range from 2 to 6, or even 2 to 4) times the second strand speed to provide the netting. In some embodiments, the plurality of shims includes a plurality of a repeating sequence of shims that includes a shim that provides a passageway between the first cavity and at least one of the first dispensing orifices and a shim that provides a passageway between the second cavity and the at least one of the second dispensing orifices. In some embodiments, the polymers of the first and second polymeric strands are the same, while in others they are different.

The plurality of shims includes a plurality of a repeating sequence of shims that includes a shim that provides a passageway between a cavity and the dispensing orifices, or the plurality of shims includes a plurality of a repeating sequence of shims that includes a shim that provides a passageway between the first cavity and at least one of the first dispensing orifices and a shim that provides a passageway between the second cavity and the at least one of the second dispensing orifice. Typically, not all of the shims of dies described herein have passageways; as some may be spacer shims that provide no passageway between a cavity and a dispensing orifice. In some embodiments, there is a repeating sequence that further includes at least one spacer shim. The number of shims providing a passageway between the first cavity and a first dispensing orifice may be equal or unequal to the number of shims providing a passageway between the second cavity and a dispensing orifice.

In some embodiments, the first dispensing orifices and the second dispensing orifices are collinear. In some embodiments, the first dispensing orifices are collinear, and the second dispensing orifices are collinear but offset from the first dispensing orifices.

In some embodiments, extrusion dies described herein include a pair of end blocks for supporting the plurality of shims. In these embodiments it may be convenient for one or all of the shims to each have one or more through-holes for the passage of connectors between the pair of end blocks. Bolts disposed within such through-holes are one convenient approach for assembling the shims to the end blocks, although the ordinary artisan may perceive other alternatives for assembling the extrusion die. In some embodiments, the at least one end block has an inlet port for introduction of fluid material into one or both of the cavities.

In some embodiments, the shims will be assembled according to a plan that provides a repeating sequence of shims of diverse types. The repeating sequence can have two or more shims per repeat. For a first example, a two-shim repeating sequence could include a shim that provides a conduit between the first cavity and a first dispensing orifice and a shim that provides a conduit between the second cavity and a dispensing orifice. For a second example, a four-shim repeating sequence could include a shim that provides a conduit between the first cavity and a dispensing orifice, a spacer shim, a shim that provides a conduit between the second cavity and a second dispensing orifice, and a spacer shim.

Exemplary passageway cross-sectional shapes include square and rectangular shapes. The shape of the passageways within, for example, a repeating sequence of shims, may be identical or different. For example, in some embodiments, the shims that provide a passageway between the first cavity and a first dispensing orifice might have a flow restriction compared to the shims that provide a conduit between the second cavity and a second dispensing orifice. The width of the distal opening within, for example, a repeating sequence of shims, may be identical or different. For example, the portion of the distal opening provided by the shims that provides a conduit between the first cavity and a first dispensing orifice could be narrower than the portion of the distal opening provided by the shims that provides a conduit between the second cavity and a second dispensing orifice.

The shape of a dispensing orifice within, for example, a repeating sequence of shims, may be identical or different. For example a 4-shim repeating sequence could be employed having a shim that provides a conduit between the first cavity and first dispensing orifice, a spacer shim, a shim that provides a conduit between the second cavity and a second dispensing orifice slot, and a spacer shim, where the shims that provide a conduit between the second cavity and a second dispensing orifice have a narrowed passage displaced from both edges of the distal opening.

In some embodiments, the assembled shims (conveniently bolted between the end blocks) further include a manifold body for supporting the shims. The manifold body has at least one (or more (e.g., two or three, four, or more)) manifold therein, the manifold having an outlet. An expansion seal (e.g., made of copper or alloys thereof) is disposed so as to seal the manifold body and the shims, such that the expansion seal defines a portion of at least one of the cavities (in some embodiments, a portion of both the first and second cavities), and such that the expansion seal allows a conduit between the manifold and the cavity.

In some embodiments, with respect to extrusion dies described herein, each of the dispensing orifices of the first and the second arrays have a width, and each of the dispensing orifices of the first and second arrays are separated by up to 2 times the width of the respective dispensing orifice.

Typically, the passageway between cavity and dispensing orifice is up to 5 mm in length. Typically, the first array of fluid passageways has greater fluid restriction than the second array of fluid passageways.

In some embodiments, for extrusion dies described herein, each of the dispensing orifices of the first and the second arrays has a cross sectional area, and each of the dispensing orifices of the first arrays has an area different from that of the second array.

In some embodiments, a cavity of an extrusion die described herein is supplied with a first polymer at a first pressure so as to dispense a first strand at a first strand speed through a first passageway, and to dispense a second strand at a second strand speed through a second passageway, where the first strand speed is at least 2 (in some embodiments, 2 to 6, or even 2 to 4) times the second strand speed, such that a netting including an array of alternating first and second polymeric strands is formed. In some embodiments, the first and second polymers are the same, while in others they are different.

In some embodiments, the first cavity of an extrusion die described herein is supplied with a first polymer at a first pressure so as to dispense the first polymer from the first array at a first strand speed, the second cavity of an extrusion die described herein is supplied with a second polymer at a second pressure so as to dispense the second polymer from the second array at a second strand speed, where the first strand speed is at least 2 (in some embodiments, 2 to 6, or even 2 to 4) times the second strand speed, such that a netting that includes an array of alternating first and second polymeric strands is formed. In some embodiments, the first and second polymers are the same, while in others they are different.

Typically, the spacing between orifices is up to 2 times the width of the orifice. The spacing between orifices is greater than the resultant diameter of the strand after extrusion. This diameter is commonly called die swell. This spacing between orifices is greater than the resultant diameter of the strand after extrusion leads to the strands repeatedly colliding with each other to form the repeating bonds of the netting. If the spacing between orifices is too great the strands will not collide with each other and will not form the netting.

The shims for dies described herein typically have thicknesses in the range from 50 micrometers to 125 micrometers, although thicknesses outside of this range may also be useful. Typically, the fluid passageways have thicknesses in a range from 50 micrometers to 5 mm, and lengths less than 5 mm (with generally a preference for smaller lengths for decreasingly smaller passageway thicknesses), although thicknesses and lengths outside of these ranges may also be useful. For large diameter fluid passageways several smaller thickness shims may be stacked together, or single shims of the desired passageway width may be used.

The shims are tightly compressed to prevent gaps between the shims and polymer leakage. For example, 12 mm (0.5 inch) diameter bolts are typically used and tightened, at the extrusion temperature, to their recommended torque rating. Also, the shims are aligned to provide uniform extrusion out the extrusion orifice, as misalignment can lead to strands extruding at an angle out of the die, which can inhibit desired bonding of the net. To aid in alignment, an alignment key can be cut into the shims. Also, a vibrating table can be useful to provide a smooth surface alignment of the extrusion tip.

The size (same or different) of the strands can be adjusted, for example, by the composition of the extruded polymers, velocity of the extruded strands, and/or the orifice design (e.g., cross sectional area (e.g., height and/or width of the orifices)). For example, a first polymer orifice that is 3 times greater in area than the second polymer orifice can generate a net with equal strand sizes while meeting the velocity difference between adjacent strands.

In general, it has been observed that the rate of strand bonding is proportional to the extrusion speed of the faster strand. Further, it has been observed that this bonding rate can be increased, for example, by increasing the polymer flow rate for a given orifice size, or by decreasing the orifice area for a given polymer flow rate. It has also been observed that the distance between bonds (i.e., strand pitch) is inversely proportional to the rate of strand bonding, and proportional to the speed that the netting is drawn away from the die. Thus, it is believed that the bond pitch and the net basis weight can be independently controlled by design of the orifice cross sectional area, the takeaway speed, and the extrusion rate of the polymer. For example, relatively high basis weight nettings, with a relatively short bond pitch, can be made by extruding at a relatively high polymer flow rate, with a relatively low netting takeaway speed, using a die with a relatively small strand orifice area.

Typically, the polymeric strands are extruded in the direction of gravity. This enables collinear strands to collide with each other before becoming out of alignment with each other. In some embodiments, it is desirable to extrude the strands horizontally, especially when the extrusion orifices of the first and second polymer are not collinear with each other.

In practicing the method, the first and second polymeric materials, which can be the same of different, might be solidified simply by cooling. This can be conveniently accomplished passively by ambient air, or actively by, for example, quenching the extruded first and second polymeric materials on a chilled surface (e.g., a chilled roll). In some embodiments, the first and/or second polymeric materials are low molecular weight polymers that need to be cross-linked to be solidified, which can be done, for example, by electromagnetic or particle radiation. In some embodiments, it is desirable to maximize the time to quenching to increase the bond strength.

Optionally, it may be desirable to stretch the as-made netting. Stretching may orientate the strands, and has been observed to increase the tensile strength properties of the netting. Stretching may also reduce the overall strand size, which may be desirable for applications which benefit from a relatively low basis weight. As an additional example, if the materials and the degree of stretch are chosen correctly, the stretch can cause some of the strands to yield while others do not, tending to form loft (e.g., the loft may be created because of the length difference between adjacent bonded net strands or by curling of the bonds due to the yield properties of the strands forming the bond). Optionally, both strands may be stretched beyond their respective yields and upon recovery, the first strands recover more than the second strands. The attribute can be useful for packaging applications where the material can be shipped to package assembly in a relatively dense form, and then lofted, on location. The loftiness attribute can also be useful as the loop for hook and loop attachment systems, where the loft created with strands enables hook attachment to the netting strands.

FIG. 1 shows an exploded view of an exemplary embodiment of an extrusion die 30. Extrusion die 30 includes a plurality of shims 40. In some embodiments of extrusion dies described herein, there will be a large number of very thin shims 40 (typically several thousand shims; in some embodiments, at least 1000, 2000, 3000, 4000, 5000, 6000, 7000, 8000, 9000, or even at least 10,000), of diverse types (shims 40*a*, 40*b*, and 40*c*), compressed between two end blocks 44*a* and 44*b*. Conveniently, fasteners (e.g., through bolts 46 threaded onto nuts 48) are used to assemble the components for extrusion die 30 by passing through holes 47. Inlet fittings 50*a* and 50*b* are provided on end blocks 44*a* and 44*b* respectively to introduce the materials to be extruded into extrusion die 30. In some embodiments, inlet fittings 50*a* and 50*b* are connected to melt trains of conventional type. In some embodiments, cartridge heaters 52 are inserted into receptacles 54 in extrusion die 30 to maintain the materials to be extruded at a desirable temperature while in the die.

Figure 2:
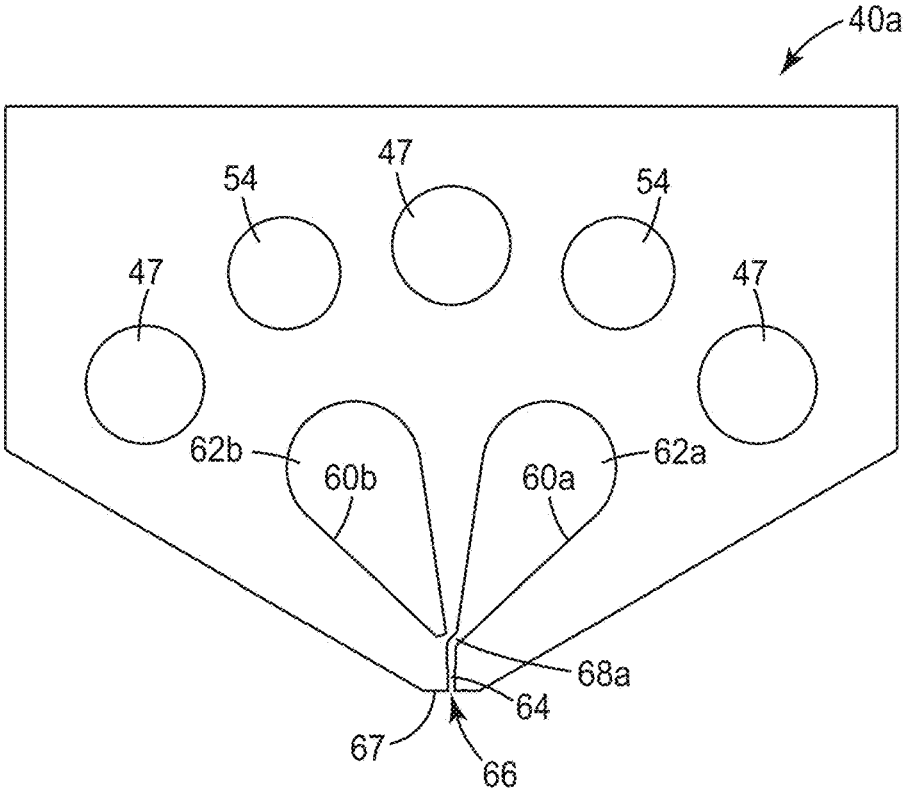
FIG. 2 is a plan view of one of the shims of FIG. 1.

FIG. 2 shows a plan view of shim 40*a* from FIG. 1. Shim 40*a* has first aperture 60*a* and second aperture 60*b*. When extrusion die 30 is assembled, first apertures 60*a* in shims 40 together define at least a portion of first cavity 62*a*. Similarly, second apertures 60*b* in shims 40 together define at least a portion of second cavity 62*b*. Material to be extruded conveniently enters first cavity 62*a* via inlet port 50*a*, while material to be extruded conveniently enters second cavity 62*b* via inlet port 50*b*. Shim 40*a* has a duct 64 ending in a first dispensing orifice 66*a* in a dispensing surface 67. Shim 40*a* further has a passageway 68*a* affording a conduit between first cavity 62*a* and duct 64. In carrying out the method of the present disclosure, the dimensions of the duct 64, and especially the first dispensing orifice 66*a* at its end, is constrained by the dimensions desired in the polymer strands extruded from them. Since the strand speed of the strand emerging from the first dispensing orifice 66*a* is also of significance, manipulation of the pressure in cavity 62*a* and the dimensions of passageway 68*a* are used to set the desired strand speed. In the embodiment of FIG. 1, shim 40*b* is a reflection of shim 40*a*, having a passageway instead affording a conduit between second cavity 62*b* and second dispensing orifice 66*b*.

Figure 3:
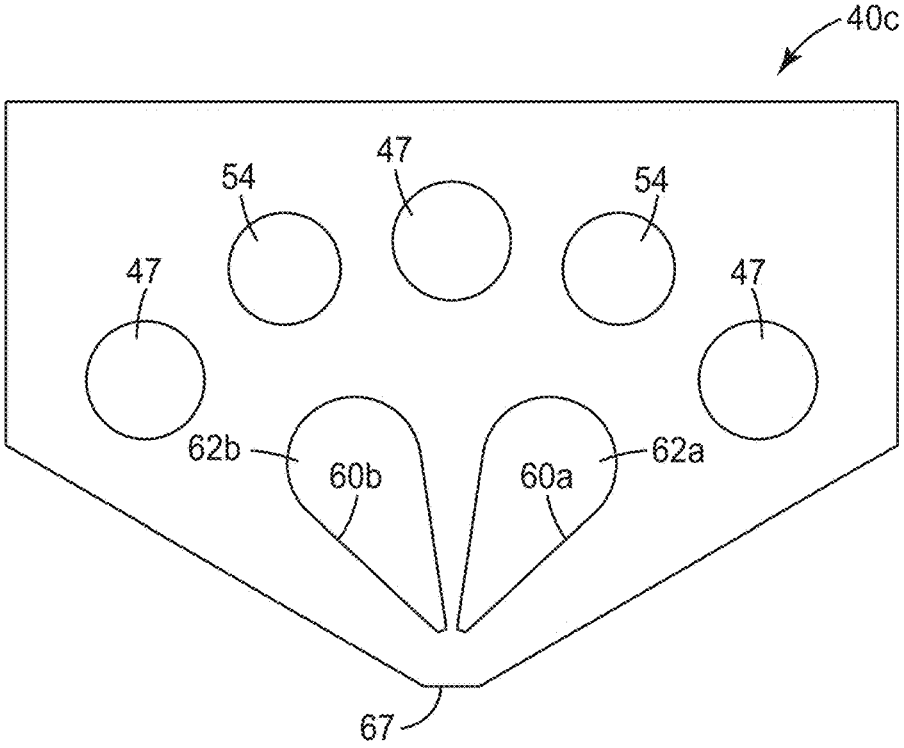
FIG. 3 is a plan view of a different one of the shims of FIG. 1.

FIG. 3 shows a plan view of shim 40*c* from FIG. 1. Shim 40*c* has no passageway between either of first or second cavities 62*a* and 62*b*, respectively, and no duct opening onto dispensing surface 67.

Figure 4:
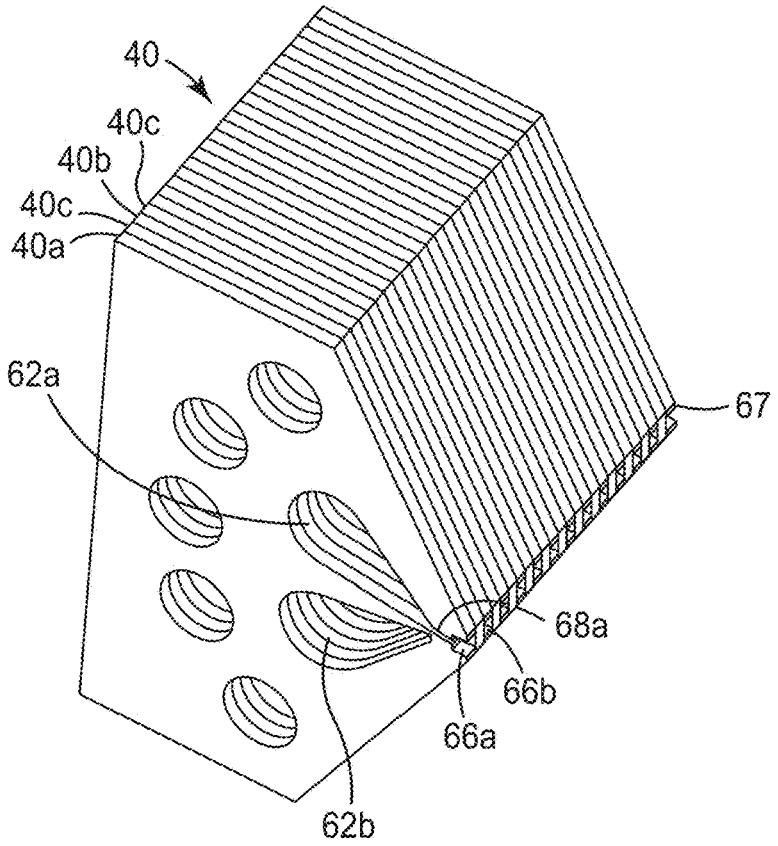
FIG. 4 is a perspective view of an exemplary extrusion die described herein.

FIG. 4 shows a perspective partial cutaway detail view of plurality of shims 40 packed closely together and ready to be assembled into die 30 of FIG. 1. Specifically, plurality of shims 40 conveniently form a repeating sequence of four shims. First in the sequence from left to right as the view is oriented is shim 40*a*. In this view, passageway 68*a*, which leads from cavity 62*a* to first dispensing orifice 66*a* in dispensing surface 67, can be seen. Second in the sequence is spacer shim 40*c*. Third in the sequence is shim 40*b*, which is simply shim 40*a* turned upside down so there is a passageway (not seen in this FIG.) between cavity 62*b* and second dispensing orifices 66*b* in dispensing surface 67. Fourth in the sequence is second spacer shim 40*c*. When complete die 30 is assembled with shims of this type in this way, and two flowable polymer containing compositions are introduced under pressure to cavities 62*a* and 62*b*, first and second polymeric strands respectively will emerge from first and second dispensing orifices 66*a* and 66*b*, supplied by cavities 62*a* and 62*b*. If the first polymeric strands have a first strand speed that is in a range from 2 to 6 (or even 2 to 4) times the second strand speed of the second polymeric strands, a net can be produced.

Figure 5:
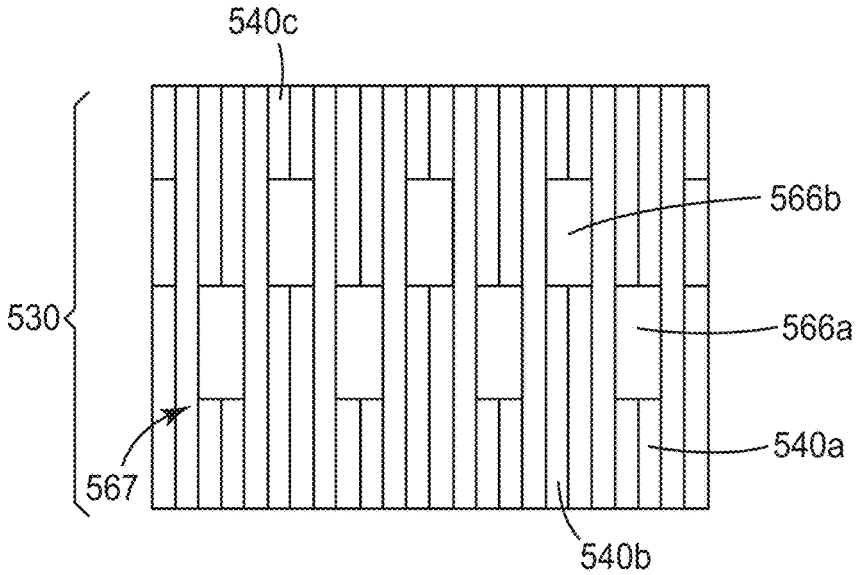
FIG. 5 is a front view of a portion of a dispensing surface of an exemplary extrusion die (and used in Example 5)

The dispensing orifices 66*a* and 66*b* are alternating and collinear. This second feature is not a requirement of the disclosure, and this is illustrated in FIG. 5. Referring now to FIG. 5, a front close up view of a portion of a dispensing surface 567 of alternately assembled die 530 is illustrated. This assembly also includes a repeating sequence of shims, each repeat having six shims. First in the sequence, from right to left, are two shims 540*a*, one shim 540*c*, two shims 540*b*, and one shim 540*c*. Although not visualized in FIG. 5, shims 540*a* have passageways analogous to passageways 68*a*, leading backwards and upwards as the drawing is oriented, together providing a fluid conduit with first cavity analogous to 62*a*. Next in the sequence is one spacer shim 540*c*, which in this arrangement still helps define the first dispensing orifice 566*a* on its left and the second dispensing orifice 566*b* on its right. Next in the sequence are two shims 540*b*. Although not visualized in FIG. 5, shims 540*b* have passageways analogous to passageways 68*b*, leading backwards and downwards as the drawing is oriented, together providing a fluid conduit with second cavity analogous to second cavity 62*b*. Although the first dispensing orifices 566*a* are collinear with each other, and the second dispensing orifices 566*b* are collinear with each other, they are offset from the first dispensing orifices 566*a*.

Figure 6:
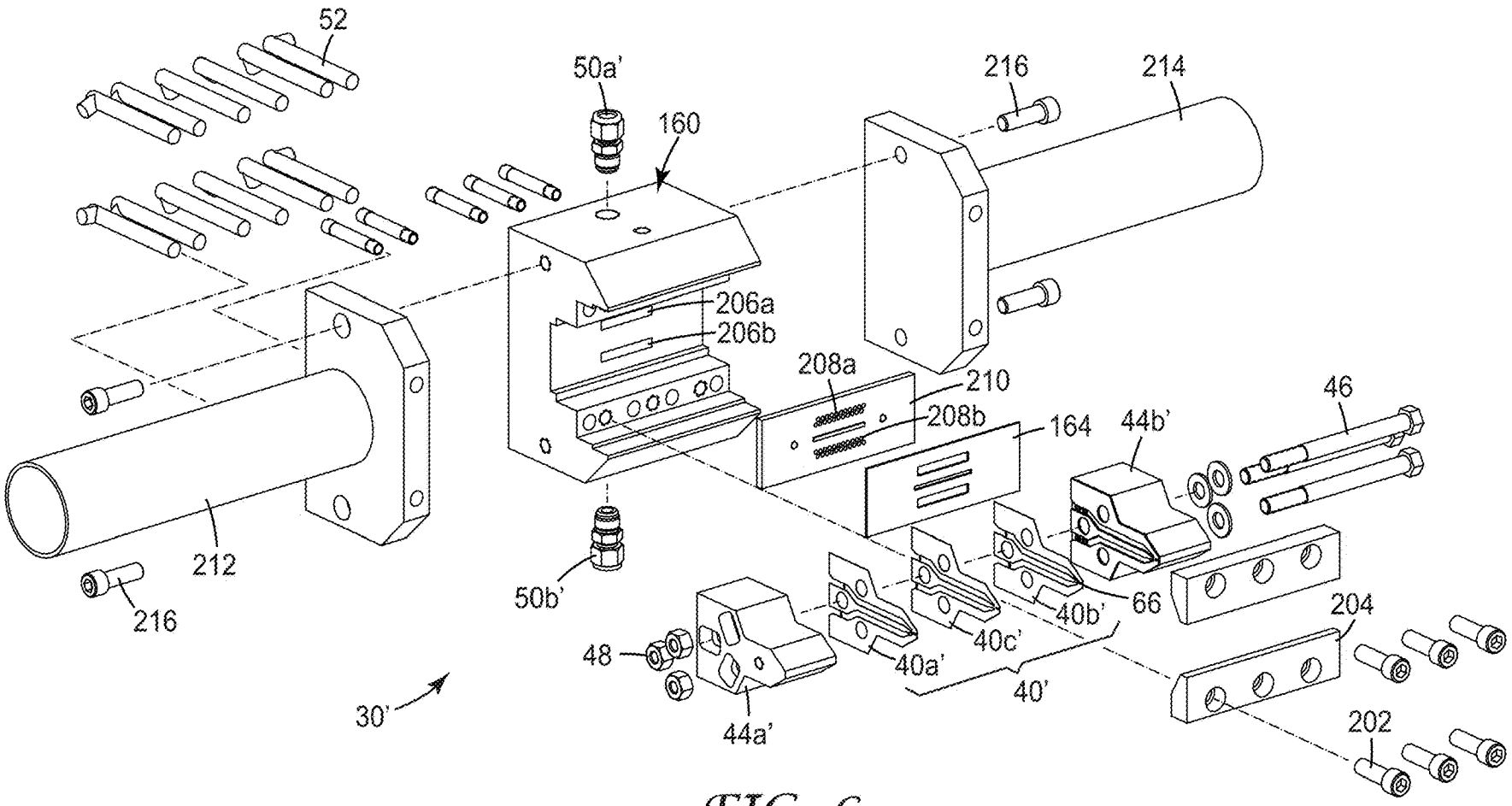
FIG. 6 is an exploded perspective view of an alternate exemplary embodiment of an extrusion die according to the present disclosure, where the plurality of shims, a set of end blocks, bolts for assembling the components, and inlet fittings for the materials to be extruded are clamped into a manifold body.

FIG. 6 shows a perspective exploded view of an alternate embodiment of extrusion die 30'. Extrusion die 30' includes plurality of shims 40'. In the depicted embodiment, there are a large number of very thin shims 40', of diverse types (shims 40*a*', 40*b*', and 40*c*'), compressed between two end blocks 44*a*' and 44*b*'. Conveniently, through bolts 46 and nuts 48 are used to assemble the shims 40' to the end blocks 44*a*' and 44*b*'.

In this embodiment, the end blocks 44*a*' and 44*b*' are fastened to manifold body 160, by bolts 202 pressing compression blocks 204 against the shims 40' and the end blocks 44*a*' and 44*b*'. Inlet fittings 50*a*' and 50*b*' are also attached to manifold body 160. These are in a conduit with two internal manifolds, of which only the exits 206*a* and 206*b* are visible in FIG. 6. Molten polymeric material separately entering body 160 via inlet fittings 50*a*' and 50*b*' pass through the internal manifolds, out the exits 206*a* and 206*b*, through passages 208*a* and 208*b* in alignment plate 210 and into openings 168*a* and 168*b* (seen in FIG. 7).

An expansion seal 164 is disposed between the shims 40' and the alignment plate 210. Expansion seal 164, along with the shims 40' together define the volume of the first and the second cavities (62*a*' and 62*b*' in FIG. 7). The expansion seal withstands the high temperatures involved in extruding molten polymer, and seals against the possibly slightly uneven rear surface of the assembled shims 40'. Expansion seal 164 may made from copper, which has a higher thermal expansion constant than the stainless steel conveniently used for both the shims 40' and the manifold body 160. Another useful expansion seal 164 material includes a polytetrafluoroethylene (PTFE) gasket with silica filler (available, for example, from Garlock Sealing Technologies, Palmyra, N.Y., under the trade designation "GYLON 3500" and "GYLON 3545").

Cartridge heaters 52 may be inserted into body 160, conveniently into receptacles in the back of manifold body 160 analogous to receptacles 54 in FIG. 1. It is an advantage of the embodiment of FIG. 6 that the cartridge heaters are inserted in the direction perpendicular to slot 66, in that it facilitates heating the die differentially across its width.

Manifold body 160 is conveniently gripped for mounting by supports 212 and 214, and is conveniently attached to manifold body 160 by bolts 216.

Figure 7:
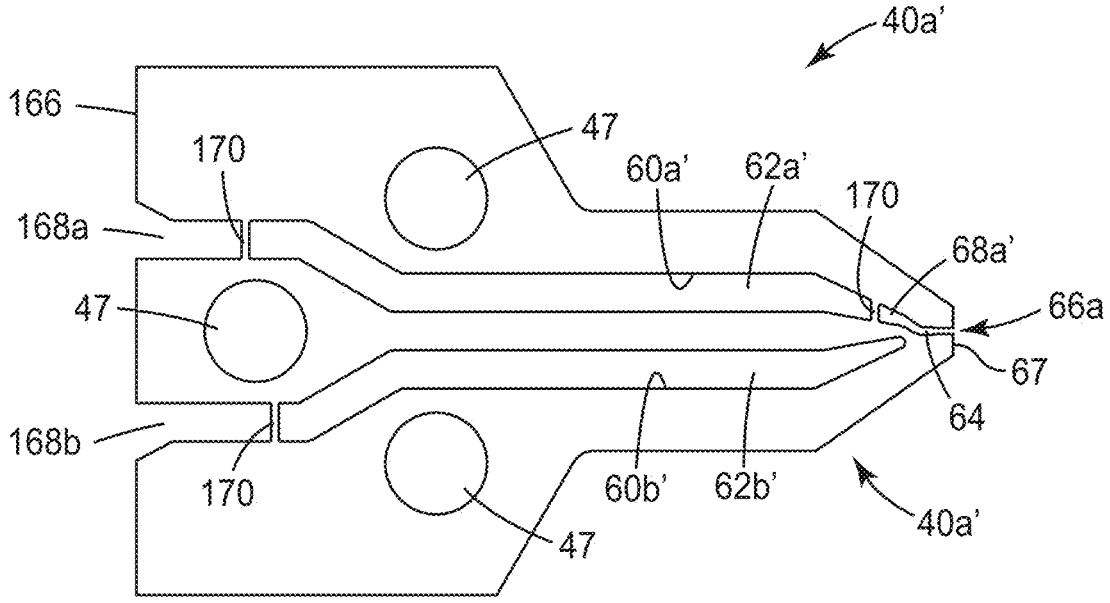
FIG. 7 is a plan view of one of the shims of FIG. 6, and relates to FIG. 6 in the same way FIG. 2 relates to FIG. 1.

FIG. 7 shows a plan view of shim 40*a*' from FIG. 6. Shim 40*a*' has first aperture 60*a*' and second aperture 60*b*'. When extrusion die 30' is assembled, first apertures 60*a*' in shims 40' together define at least a portion of first cavity 62*a*'. Similarly, second apertures 60*b*' in shims 40' together define at least a portion of second cavity 62*b*'. Base end 166 of shim 40*a*' contacts expansion seal 164 when extrusion die 30' is assembled. Material to be extruded conveniently enters first cavity 62*a*' via apertures in expansion seal 164 and via shim opening 168*a*. Similarly, material to be extruded conveniently enters first cavity 62*a*' via apertures in expansion seal 164 and via shim opening 168*a*.

Shim 40*a*' has duct 64 ending in dispensing orifice 66*a* in dispensing surface 67. Shim 40*a*' further has passageway 68*a*' affording a conduit between first cavity 62*a*' and duct 64. In the embodiment of FIG. 6, shim 40*c*' is a reflection of shim 40*a*', having a passageway instead affording a conduit between second cavity 62*b*' and die duct 64. It might seem that strength members 170 would block the adjacent cavities and passageways, but this is an illusion—the flow has a route in the perpendicular-to-the-plane-of-the-drawing dimension when extrusion die 30' is completely assembled. Similarly to the embodiment of FIG. 1, shim 40*b*' is a reflection of 40*a*', having a passageway instead forming a conduit between second cavity 62*b*' and the dispensing orifice.

Figure 8:
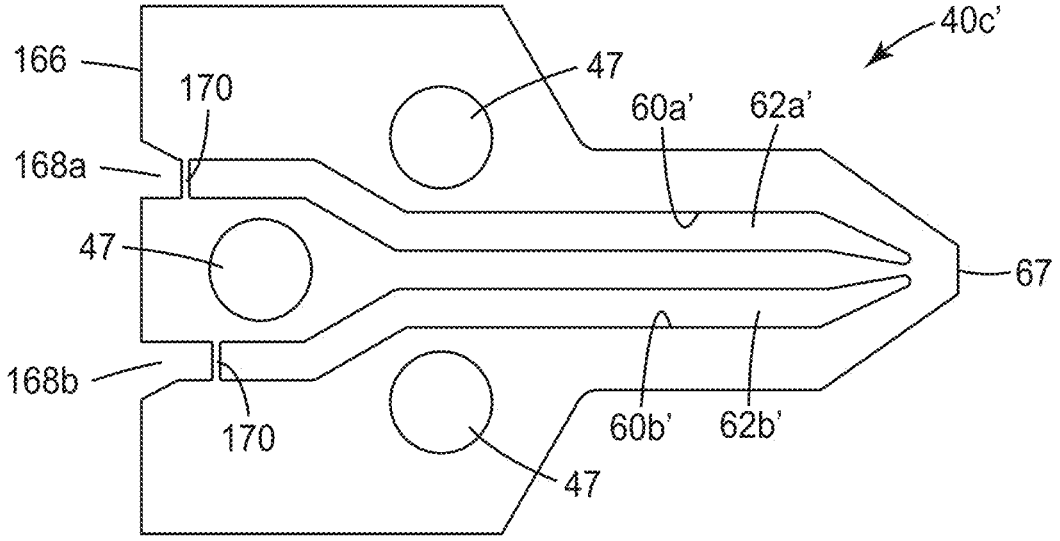
FIG. 8 is a plan view of a different one of the shims of FIG. 6, and relates to FIG. 6 in the same way FIG. 3 relates to FIG. 1.

FIG. 8 shows a plan view of shim 40*c*' from FIG. 6 is illustrated. Shim 40*c*' has no passageway between either of first or second cavities 62*a*' and 62*b*', respectively, and no duct opening onto dispensing surface 67.

Figure 9:
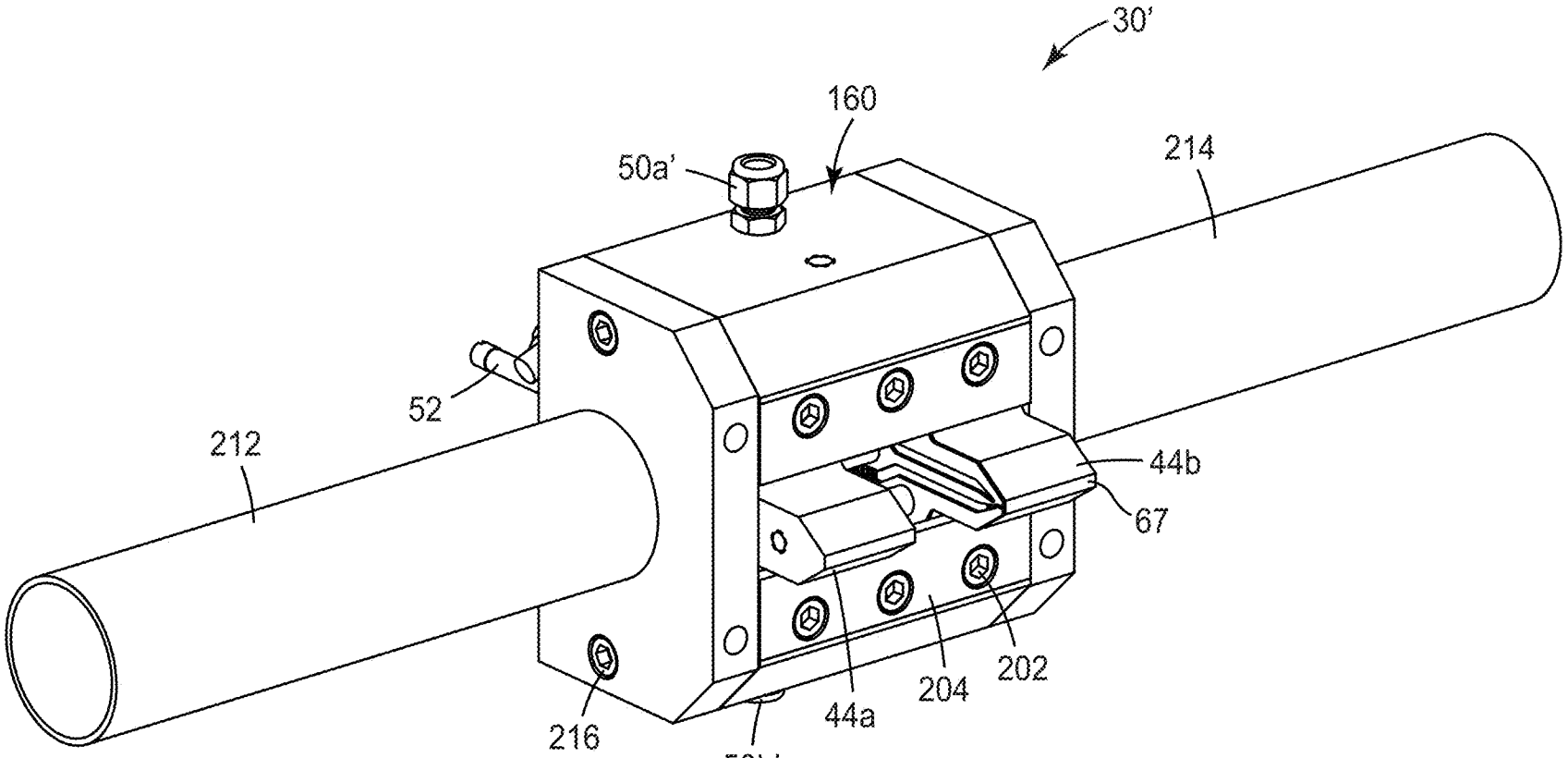
FIG. 9 is a perspective view of the embodiment of FIG. 6 as assembled.

FIG. 9 shows a perspective view of the extrusion die 30' of FIG. 6, except for most of the shims 40' which have been omitted to allow the visualization of internal parts. Although the embodiment of FIG. 6 and FIG. 9 is more complicated than the embodiment of FIG. 1, it has several advantages. First, it allows finer control over heating. Second, the use of manifold body 160 allows shims 40' to be center-fed, increasing side-to-side uniformity in the extruded ribbon region. Third, the forwardly protruding shims 40' allow dispensing surface 67 to fit into tighter locations on crowded production lines. The shims are typically 0.05 mm (2 mils) to 0.25 mm (10 mils) thick, although other thicknesses, including, for example, those from 0.025 mm (1 mil) to 1 mm (40 mils) may also be useful. Each individual shim is generally of uniform thickness, preferably with less than 0.005 mm (0.2 mil), more preferably, less than 0.0025 mm (0.1 mil) in variability.

The shims are typically metal, preferably stainless steel. To reduce size changes with heat cycling, metal shims are preferably heat-treated.

The shims can be made by conventional techniques, including wire electrical discharge and laser machining Often, a plurality of shims are made at the same time by stacking a plurality of sheets and then creating the desired openings simultaneously. Variability of the flow channels is preferably within 0.025 mm (1 mil), more preferably, within 0.013 mm (0.5 mil).

Figure 10:
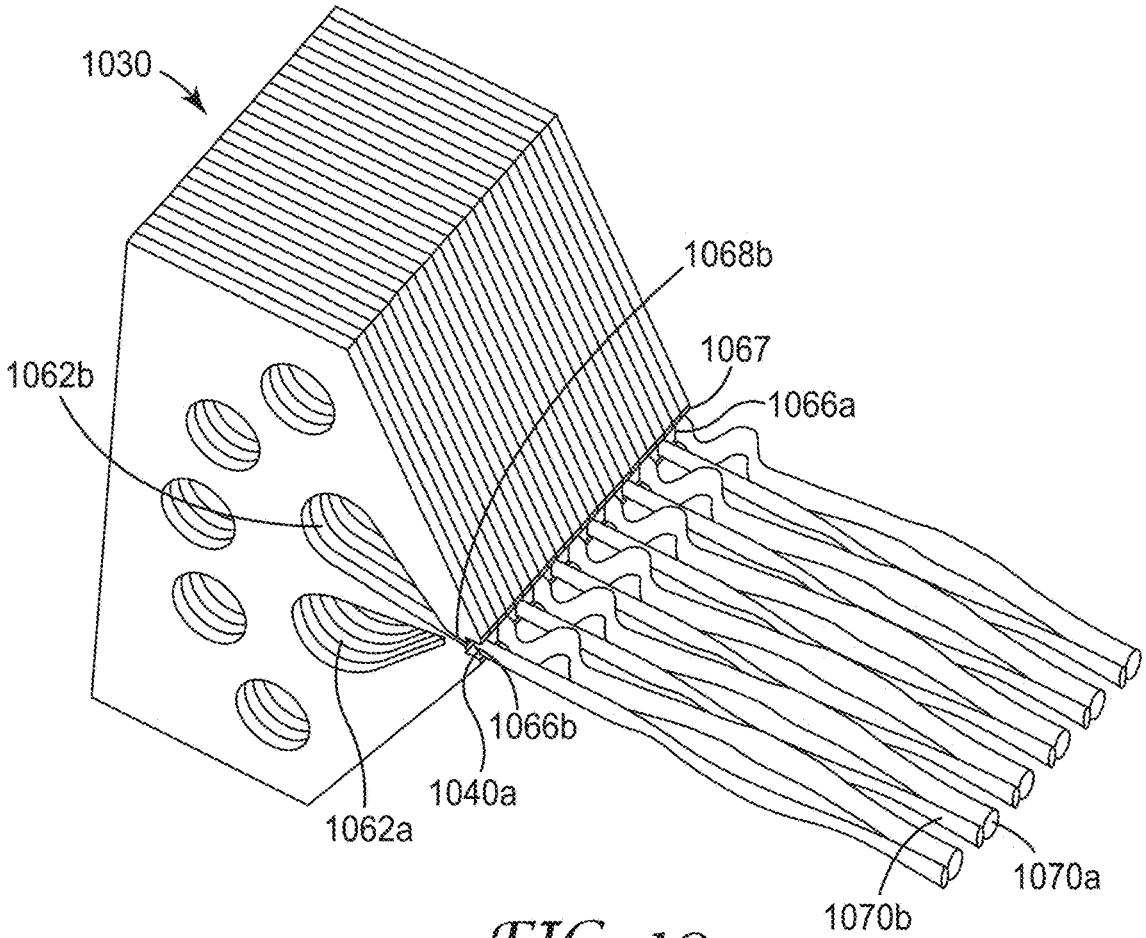
FIG. 10 is a schematic perspective view of a portion of an exemplary extrusion die described herein supplied with polymeric material and forming a net.

FIG. 10 shows a schematic perspective view of a portion of extrusion die 1030, supplied with polymeric material and forming a net. Polymer from first cavity 1062*a* emerges as first strands 1070*a* from first dispensing orifices 1066*a*, and second strands 1070*b* are emerging from second dispensing orifices 1066*b*. Passageways 1068*a* (hidden behind the nearest shim in this view) and 1068*b*, and the pressures in cavities 1062*a* and 1062*b* are selected so that the strand speed of first strands 1070*a* are between about 2 and 6 times greater than the strand speed of second strands 1070*b*.

Figure 11:
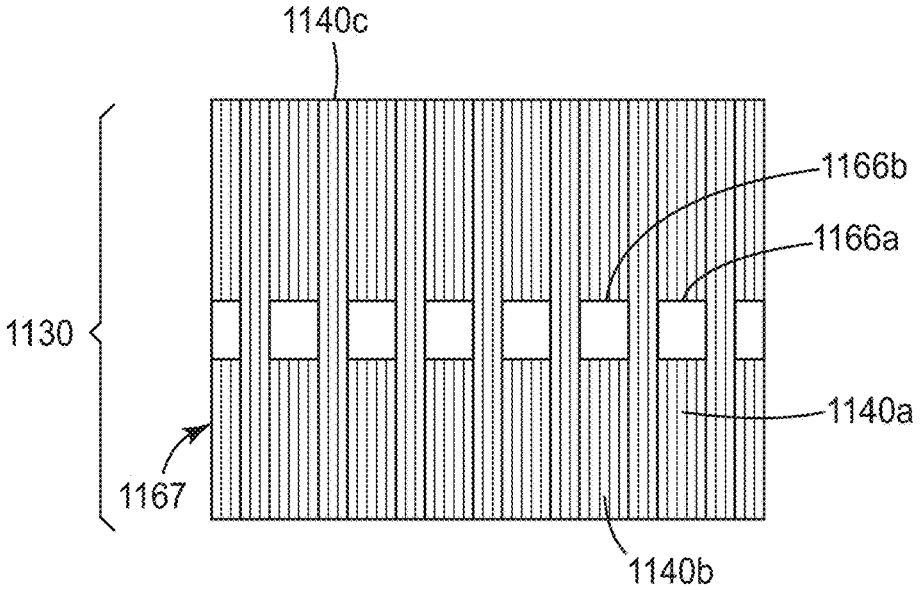
FIG. 11 is a front view of a portion of the dispensing surface of an exemplary extrusion die described herein (and used in Examples 1 and 2)

FIG. 11 shows a front view of a portion of dispensing surface 1167 of alternately assembled die 1130. A repeated sequence of shims is present in which the dispensing orifices 1166*a* and 1166*b* are alternating and collinear. Each repeat in this sequence includes a repeating sequence of sixteen shims. First in the sequence are five shims 1140*a*, then three spacer shims 1140*c*, then five shims 1140*b*, then three spacer shims 1140*c*.

Figure 12:
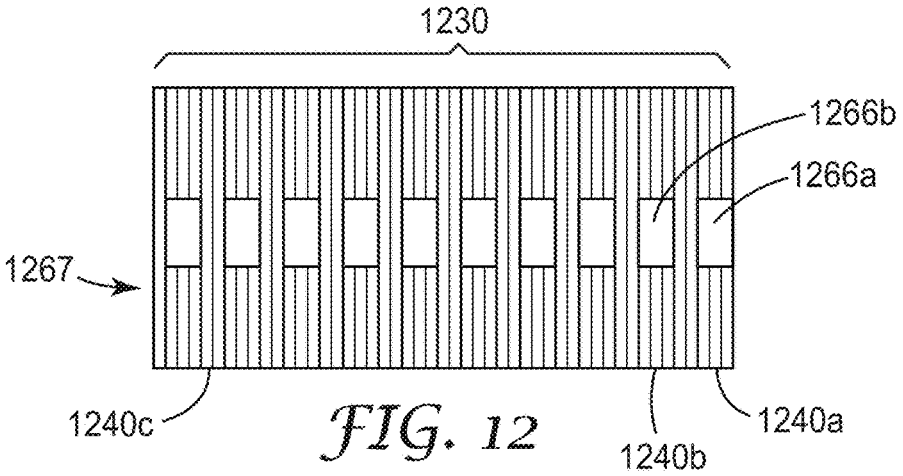
FIG. 12 is a front view of a portion of the dispensing surface of an exemplary extrusion die described herein (and used in Example 4)

FIG. 12 shows a front view of a portion of dispensing surface 1267 of alternately assembled die 1230. A repeated sequence of shims is present in which the dispensing orifices 1266*a* and 1266*b* are alternating and collinear. Each repeat in this sequence includes a repeating sequence of ten shims. First in the sequence are three shims 1240*a*, then two spacer shims 1240*c*, then three shims 1240*b*, then two spacer shims 1240*c*.

Figure 15:
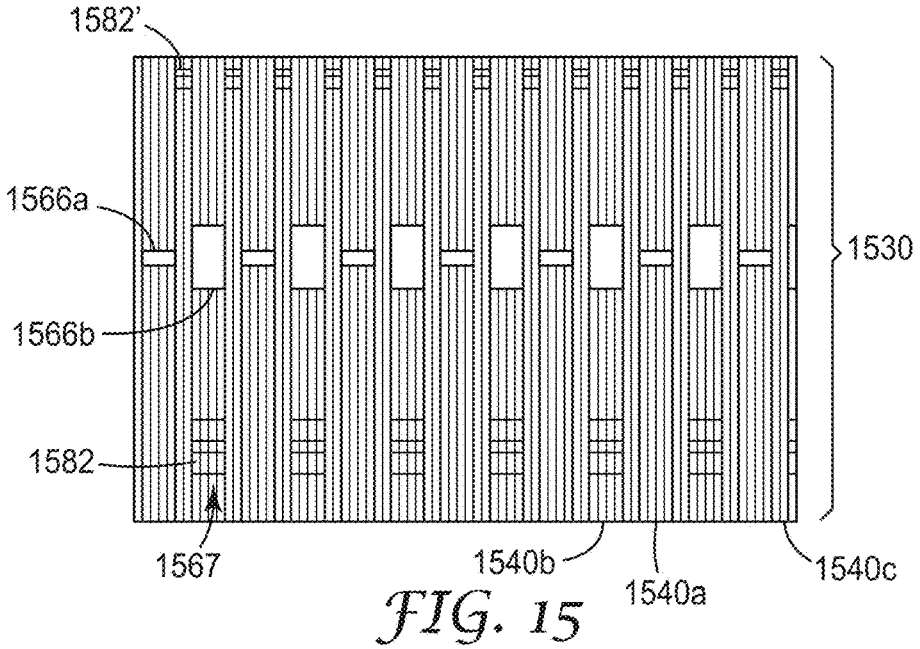
FIG. 15 is a front view of a portion of the dispensing surface of an exemplary extrusion die described herein (and used in Example 3)

FIG. 15 shows a front view of a portion of dispensing surface 1567 of assembled die 1530. A repeated sequence of shims is present in which dispensing orifices 1566*a* and 1566*b* are alternating and collinear. Each repeat in this sequence includes a repeating sequence of twelve shims. First in the sequence are four shims 1540*a*, then two spacer shims 1540*c*, then four shims 1540*b*, then two spacer shims 1540*c*. In this embodiment, shims 1540*b* have an identification notch 1582, and shims 1540*c* have an identification notch 1582' to help verify that the die 1530 has been assembled in the desired manner.

Figure 24:
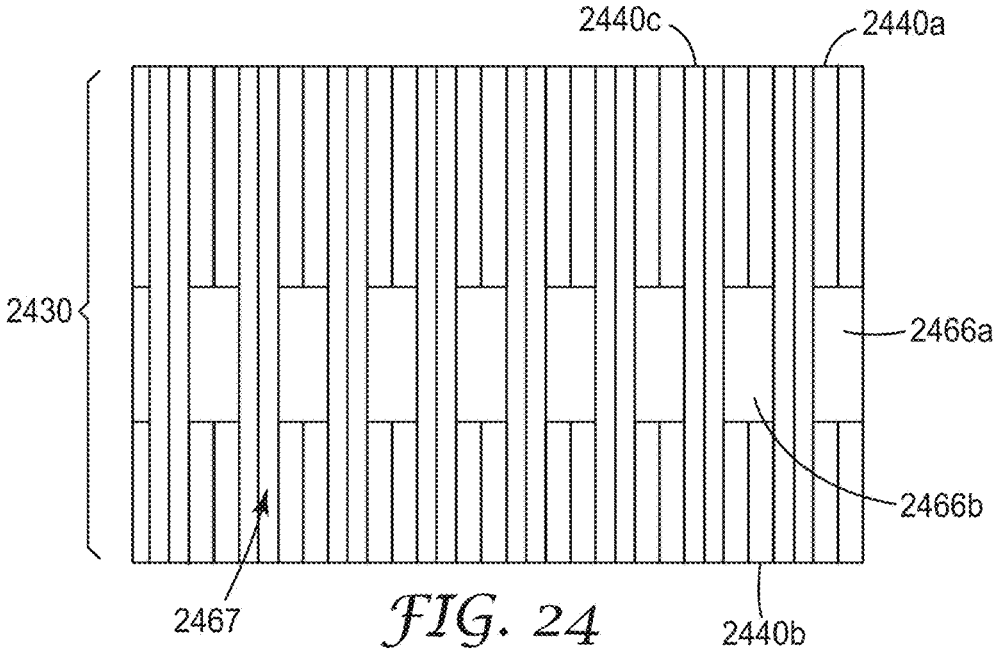
FIG. 24 is a front view of a portion of the dispensing surface of an exemplary extrusion die described herein (and used in Example 11)

FIG. 24 shows a front view of a portion of dispensing surface 2467 of alternately assembled die 2430. A repeated sequence of shims is present in which the dispensing orifices 2466*a* and 2466*b* are alternating and collinear. Each repeat in this sequence includes a repeating sequence of eight shims. First in the sequence are two shims 2440*a*, then two spacer shims 2440*c*, then two shims 2440*b*, then two spacer shims 2440*c*.

Figure 27:
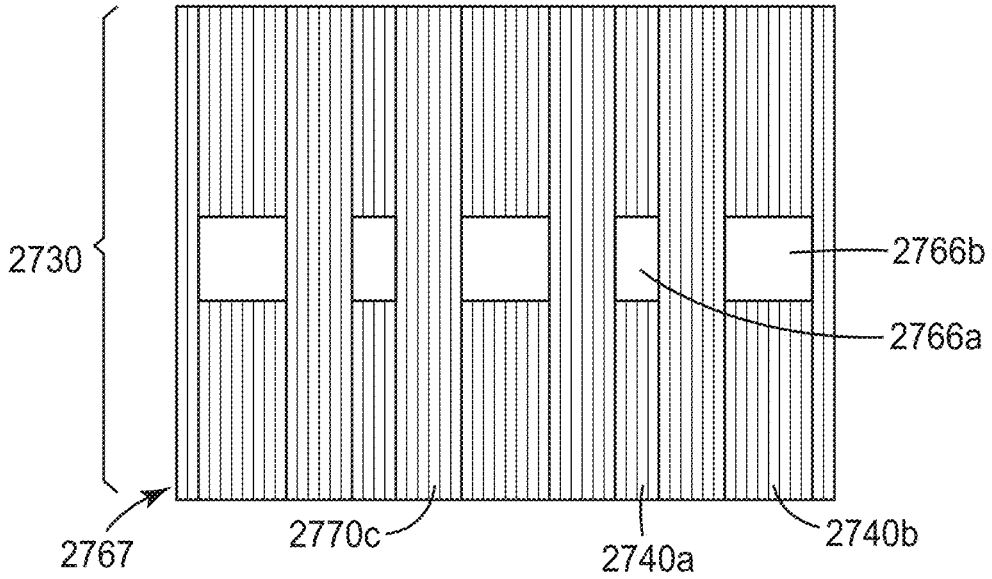
FIG. 27 is a front view of a portion of the dispensing surface of an exemplary extrusion die described herein (and used in Example 13)

FIG. 27 shows a front view of a portion of dispensing surface 2767 of alternately assembled die 2730. A repeated sequence of shims is present in which the dispensing orifices 2766*a* and 2766*b* are alternating and collinear. Each repeat in this sequence includes a repeating sequence of twenty-two shims. First in the sequence are four shims 2740*a*, then six spacer shims 2740*c*, then eight shims 2740*b*, then six spacer shims 2740*c*.

Figure 29:
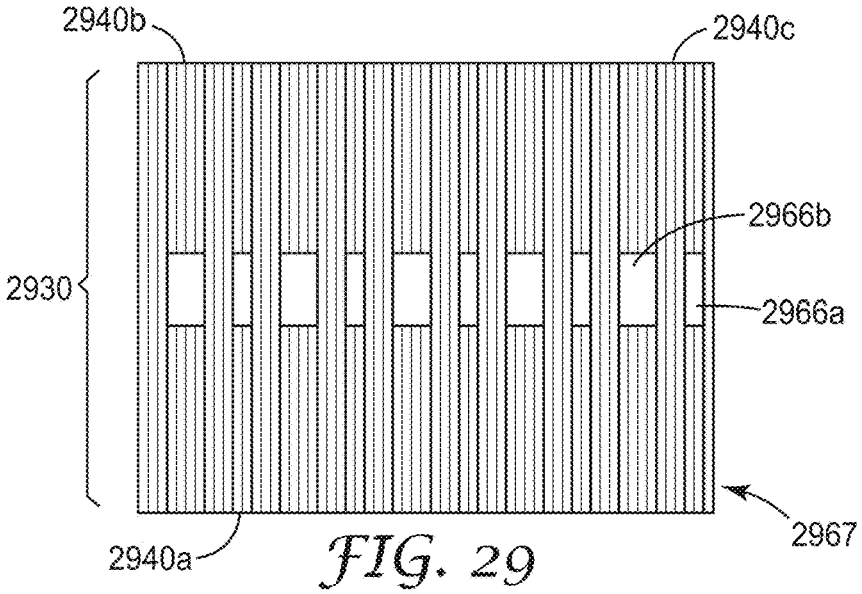
FIG. 29 is a front view of a portion of the dispensing surface of an exemplary extrusion die described herein (and used in Example 14)

FIG. 29 shows a front view of a portion of dispensing surface 2967 of alternately assembled die 2930. A repeated sequence of shims is present in which the dispensing orifices 2966*a* and 2966*b* are alternating and collinear. Each repeat in this sequence includes a repeating sequence of twelve shims. First in the sequence are two shims 2940*a*, then three spacer shims 2940*c*, then four shims 2940*b*, then three spacer shims 2940*c*.

Figure 32:
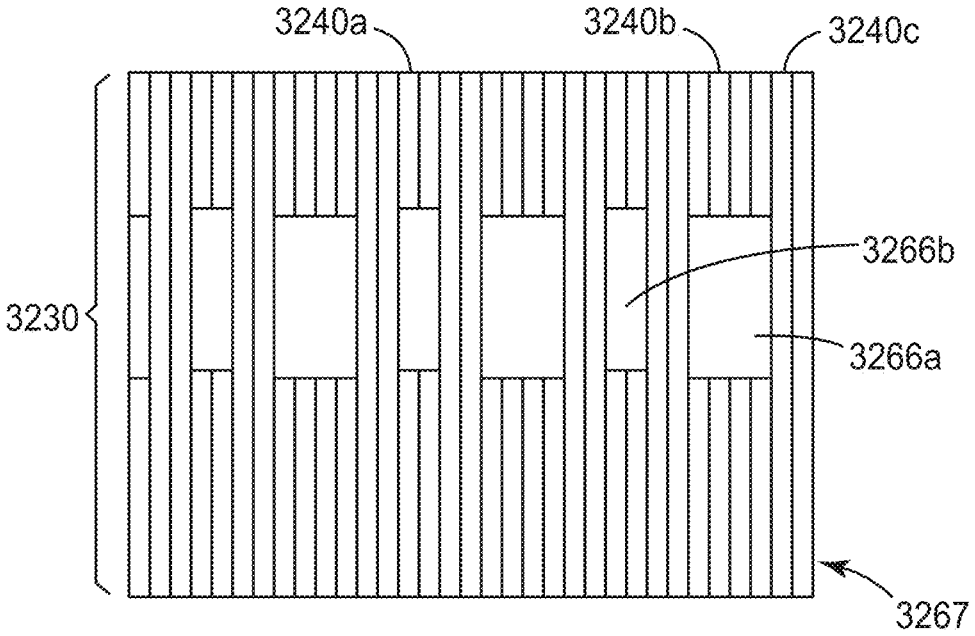
FIG. 32 is a front view of a portion of the dispensing surface of an exemplary extrusion die described herein (and used in Example 16)

FIG. 32 shows a front view of a portion of dispensing surface 3267 of alternately assembled die 3230 is illustrated. A repeated sequence of shims is present in which the dispensing orifices 3266*a* and 3266*b* are alternating and collinear. Each repeat in this sequence includes a repeating sequence of ten shims. First in the sequence are two shims 3240*a*, then two spacer shims 3240*c*, then four shims 3240*b*, then two spacer shims 3240*c*.

Figure 34:
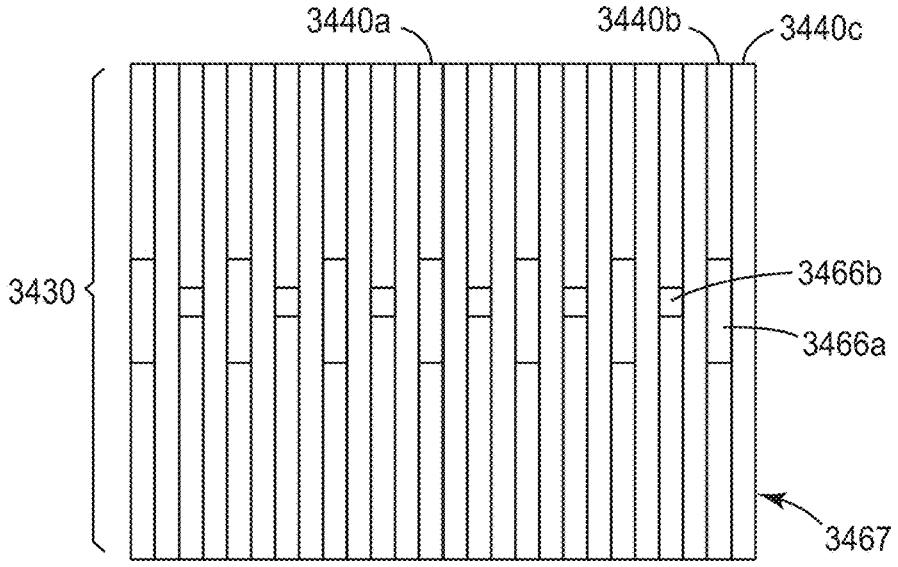
FIG. 34 is a front view of a portion of the dispensing surface of an exemplary extrusion die described herein (and used in Example 17)

FIG. 34 shows a front view of a portion of dispensing surface 3467 of alternately assembled die 3430 is illustrated. A repeated sequence of shims is present in which the dispensing orifices 3466*a* and 3466*b* are alternating and collinear. Each repeat in this sequence includes a repeating sequence of four shims. First in the sequence is one shim 3440*a*, then one spacer shim 3440*c*, then one shim 3440*b*, then one spacer shim 3440*c*.

Figure 37:
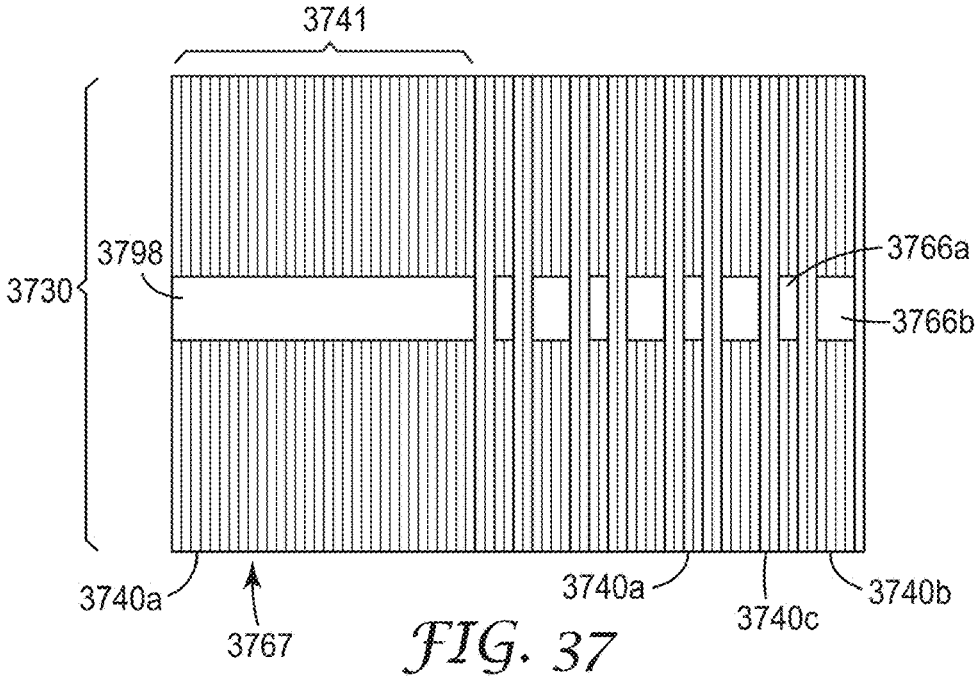
FIG. 37 is a front view of a portion of the dispensing surface of an exemplary extrusion die described herein (and used in Example 19)

FIG. 37 shows a front view of a portion of dispensing surface 3767 of alternately assembled die 3730 is illustrated. A repeated sequence of shims is present in which the dispensing orifices 3766*a* and 3766*b* are alternating and collinear. Each repeat in this sequence includes a repeating sequence of ten shims. First in the sequence are two shims 3740*a*, then two spacer shims 3740*c*, then four shims 3740*b*, then two spacer shims 3740*c*. Assembled die 3730 also includes in addition to the repeated sequences a plurality of shims 3740*a* in zone 3741. This creates slot 3798.

Figure 44:
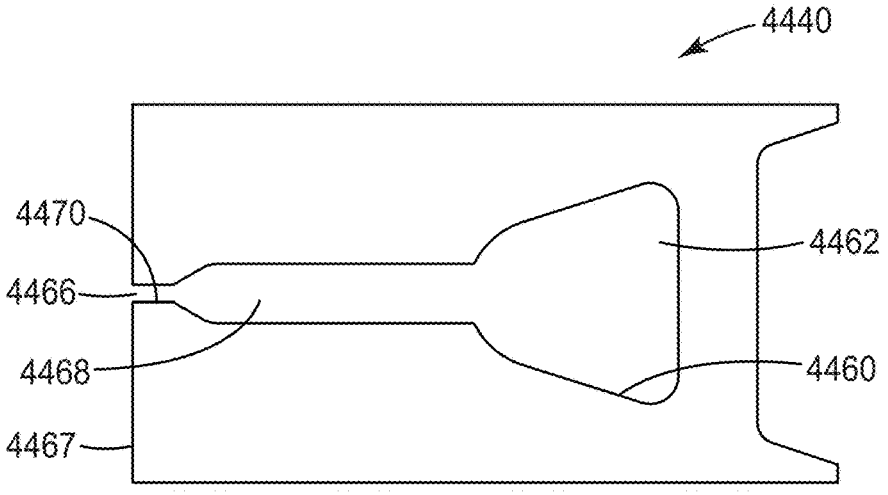
FIG. 44 is a plan view of an exemplary shim for making netting described herein extruded from a single cavity.

While many convenient embodiments of dies described herein supply the first and second strands from separate first and second cavities, other embodiments are also within the scope of the present disclosure that provide a strand speed difference. For example FIG. 44 shows a plan view of shim 4440, useful in connection with a die for forming netting with first and second strands made from the same material and extruded from a single cavity. Shim 4440 has aperture 4460. When assembled with the shims of FIGS. 45-46 in the way described below in FIGS. 47-48, aperture 4460 will define at least a portion of cavity 4462. In use, passageway 4468 conducts polymer from cavity 4462 to first dispensing orifice 4466 on dispensing surface 4467. Importantly, there is restriction 4470 adjacent first dispensing orifice 4466. Restriction 4470 increases the first strand speed of the first strand emerging from first dispensing orifice 4466 during use.

Figure 45:
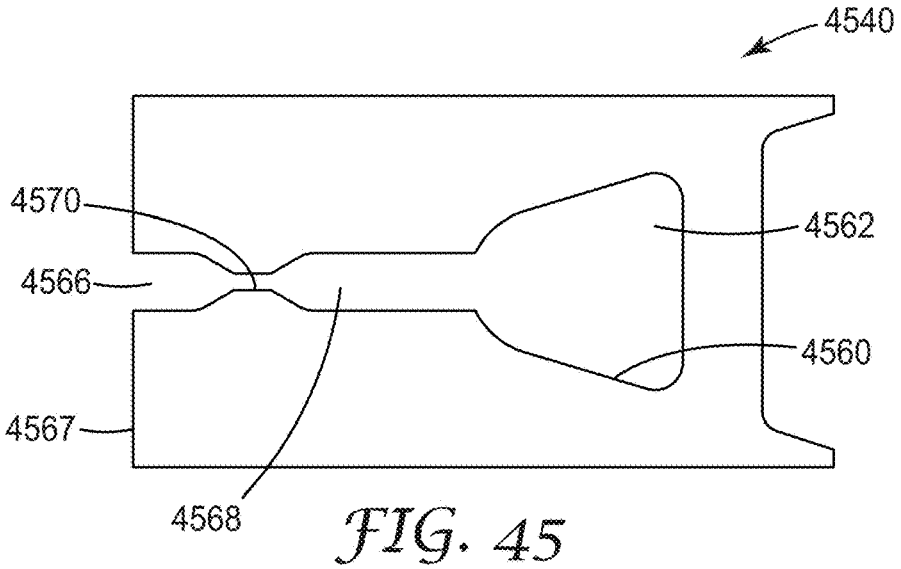
FIG. 45 is a plan view of an exemplary shim for making netting described herein in conjunction with the shim of FIG. 44.

FIG. 45 shows a plan view of shim 4540. Shim 4540 has an aperture 4560. When assembled with the shims of FIGS. 44 and 46 in the way described below in FIGS. 47-48, aperture 4560 will define at least a portion of cavity 4562. In use, passageway 4568 conducts polymer from cavity 4562 to second dispensing orifice 4566 on dispensing surface 4567. There is restriction 4570 set back from second dispensing orifice 4566. Restriction 4570 decreases the second strand speed of the second strand emerging from second dispensing orifice 4566 during use.

Figure 46:
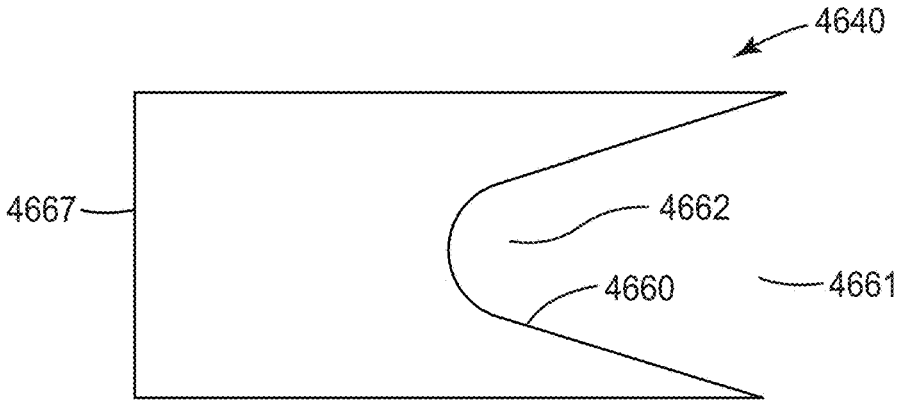
FIG. 46 is a plan view of an exemplary spacer shim for making netting described herein in conjunction with the shims of FIG. 44 and FIG. 45.

FIG. 46 shows a plan view of spacer shim 4640 useful in forming netting in conjunction with the shims 4440 and 4540 of FIGS. 44 and 45. Shim 4640 has cut-out 4660. When assembled with the shims of FIGS. 44-45 in the way described below in FIGS. 47-48, cut-out 4660 will define at least a portion of cavity 4662. Cut-out 4660 has open end 4661 on the end opposite dispensing surface 4667. Open end 4661 allows the inflow of polymer into cavity 4662 when assembled with the other shims and mounted in a die mount analogous to that shown in FIG. 6.

Figure 47:
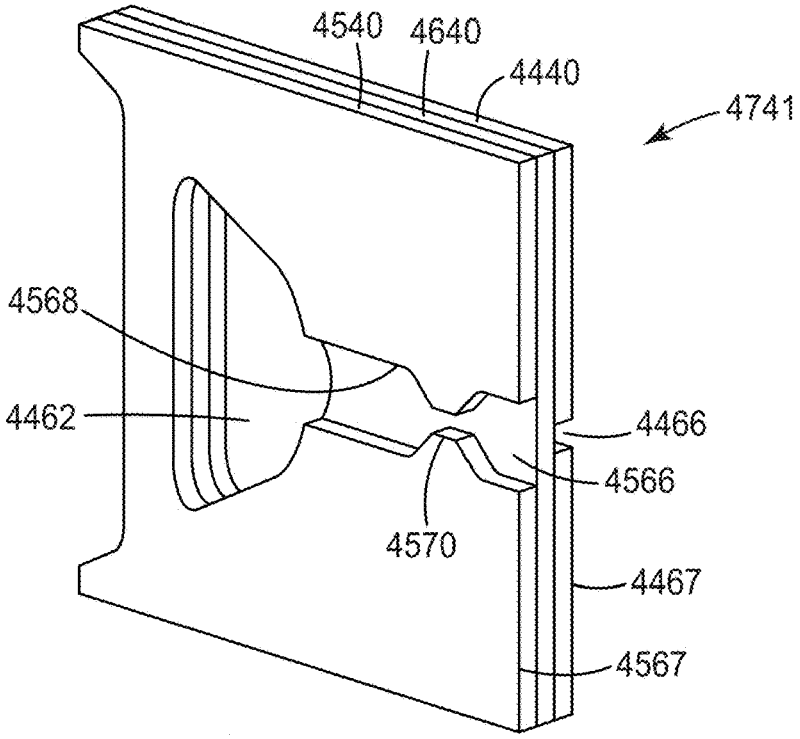
FIG. 47 is a detail perspective view of a plurality of shims formed from the shims of FIGS. 44-46.

FIG. 47 shows a detail perspective view of a plurality of shims 4741 formed by, from left to right, one spacer shim 4640, one shim 4540, one spacer shim 4640, and one shim 4440. In this view it can be appreciated how apertures 4460 and 4560, and cut-out 4660 (not labeled) together define a portion of cavity 4462. It will be apparent to the skilled artisan that for any particular extrusion pressure applied to cavity 4462 during extrusion, the mass flow of the first strand emerging from first dispensing orifice 4466 will be approximately equal to the mass flow of the second strand emerging from second dispensing orifice 4566. However, the first strand speed of the first strand will be significantly faster than the second strand speed of the second strand.

Figure 48:
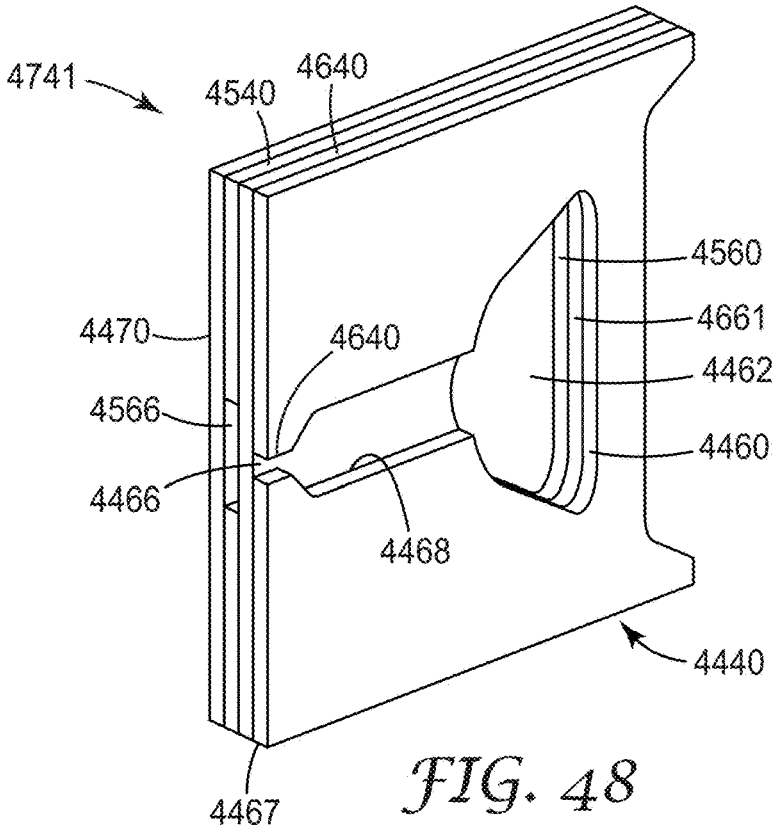
FIG. 48 is a detail perspective view of the plurality of shims of FIG. 47, seen from the reverse angle, with one of the shims removed for visual clarity.

FIG. 48 shows a detail perspective view of the plurality of shims of FIG. 47, seen from the reverse angle, with the nearest instance of shim 4640 removed for visual clarity. In this view of the reduced plurality of shims 4741, restriction 4570 can be better appreciated.

Figure 49:
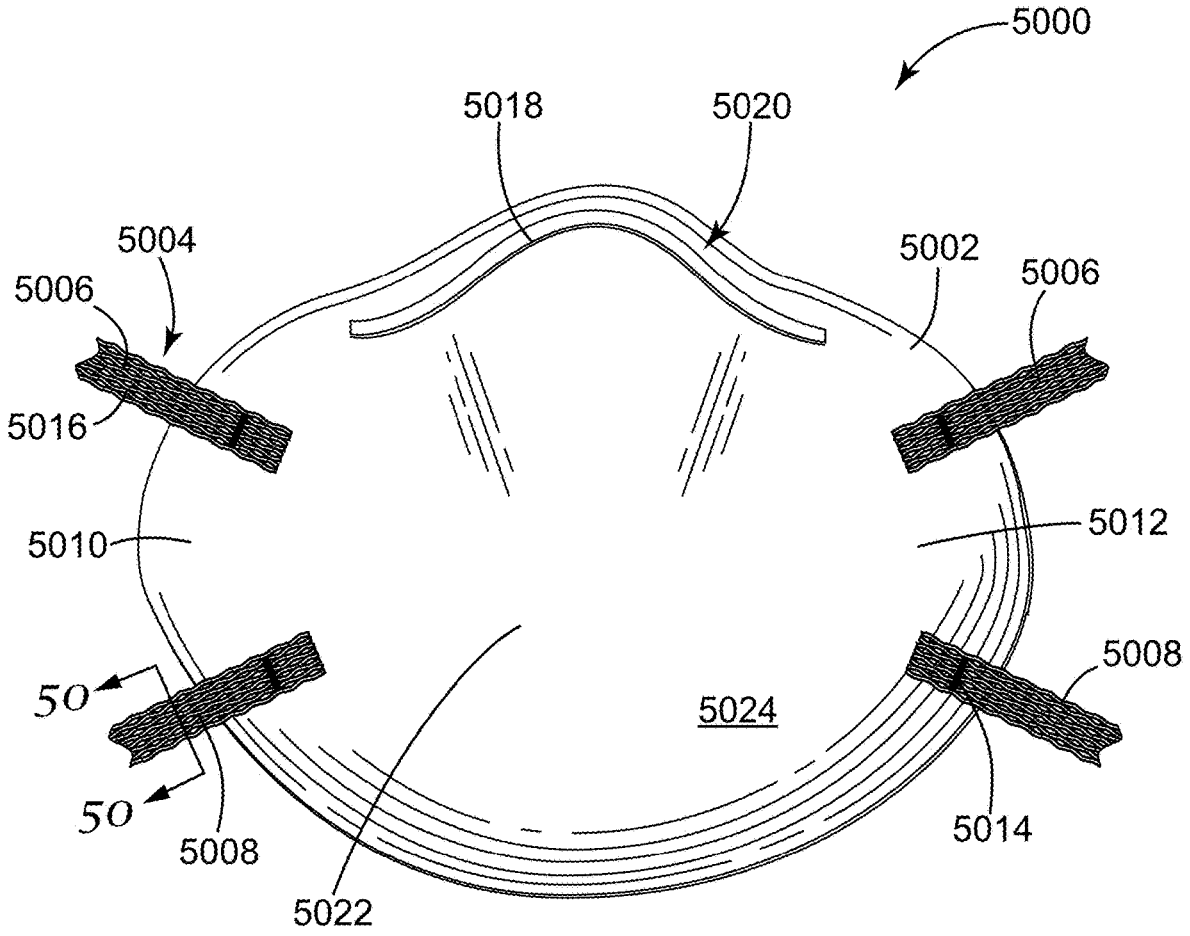
FIG. 49 is a perspective view of one embodiment of a respirator 5000 in accordance with the present disclosure.

FIG. 49 shows an example of a respirator 5000 of the present disclosure. The respirator 5000 includes a mask body 5002 and a harness 5004. The harness 5004 includes first and second straps 5006 and 5008. The straps 5006 and 5008 engage the mask body 5002 on first and second sides 5010 and 5012, respectively, of the mask body 5002. The straps 5006, 5008 may engage the mask body directly by being secured thereto through use of staples 5014 or other suitable mechanical fastener. Alternatively, the straps 5006, 5008 can be physically or chemically secured to the mask body 5002 through use of bonds, including welds or adhesive attachment. Ultrasonic welding may be used, for example, to secure the straps to a mask body. When the straps 5006, 5008 are welded to the mask body 5002, the netting 5016 in the straps 5006, 5008 melts to form solid non-porous plastic that mates with the polymeric material that includes the mask body. Typically the polymeric material in the strands of the netting melts into or merges with the polymeric material in the fibers of the layer(s) that include the mask body. The mask body 5002 also may have a nose clip 5018 secured thereto, which allows the user to conform the mask body 5002 in the nose region 5020. If desired an exhalation valve may be secured to the mask body to assist in the rapid displacement or purging of exhaled air from the interior gas space. The exhalation valve is commonly attached to the mask body at a central location 5022. When the respirator 5000 is a filtering face-piece respirator like the respirator illustrated in FIG. 49, the mask body 5002 may include a filtering structure 5024 that includes one or more layers of filter media, shaping layers, and/or cover webs. A respirator having this construction may be assembled as described in U.S. Pat. No. 7,131,442 to Kronzer et al.

Figure 50:
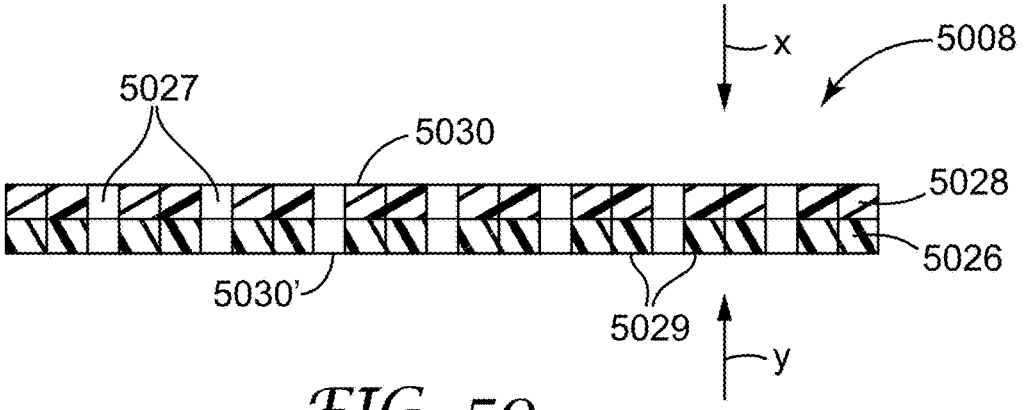
FIG. 50 is a cross section of a strap 5008 taken along lines 50-50 of FIG. 49.

FIG. 50 shows a cross section of the strap 5008. The strap 5008 can include first and second layers 5026 and 5028 of netting material juxtapositioned in an adjoining fashion. The two layers 5026, 5028 may be, for example, joined together by bonding, such as autogenous bonding or fusion, as the layers are coextruded at the same time, one on top of the other. The layers can be combined together in the die as a melt. The layers generally may have some natural affinity to each other, such that the intermixing and bonding between materials at the interface during the melt state holds the layers together. The two flow streams of the two layers may meet together inside the die and exit as a two-layered stranded product, or the layers may be each separately formed and placed in contact with each other while the polymer streams are still molten. Thus, the first and second layers 5026, 5028 of the netting can be secured directly to each other. Alternatively, other layer(s) may be inserted between the two layers so that they are disposed therebetween in the final product. The first netting layer 5026 can be provided with a first color that is different from the color of the second netting layer 5028. The use of different colors can add an aesthetic effect to the strap and may also allow the user to more easily detect if the strap is in a twisted condition. As shown, the netting layers 5026, 5028 can be secured to one another such that the array of polymeric strands in each of the layers corresponds to one another when viewed from a plane projected onto a major surface 5030, 5030' of the strap, that is, in the direction of arrows x or y, respectively. The strap 5008 is constructed to be sufficiently porous such that the strap is air permeable from the first major surface 5030 to the second major surface 5030'. The strap 5008 has a series of open spaces 5027 between strands 5029 through which air can pass. If the layers 5026 and 5028 each are colored differently, when viewing the strap 5008 in the direction of arrow x, a first color may be seen, and when viewing the strap in the direction of arrow y, a second color may be seen. Although two layers 5026 and 5028 are shown in this figure, there may be further layers such as 3, 4 or more layers juxtapositioned with respect to each other. The strap may include first and second inner layers.

Figure 51:
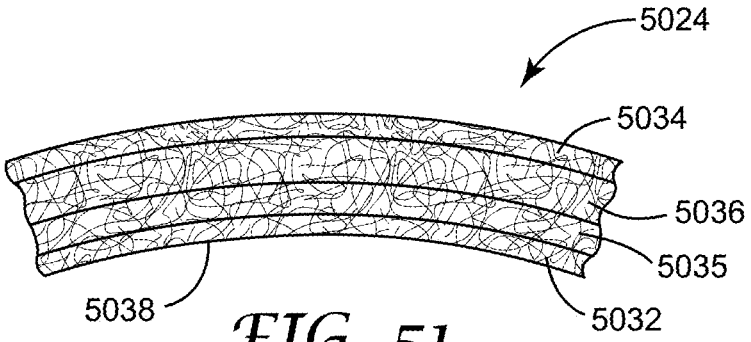
FIG. 51 is a cross section of a filtering structure 5024 that may be used in a mask body 5002 of the present disclosure.

FIG. 51 shows the filtering structure 5024 in cross-section. The filtering structure 5024 may include one or more cover webs 5032 and 5034, a shaping layer 5035, and a filtration layer 5036. The cover webs 5032 and 5034 may be located on the outer sides of the filtering structure 5024 to capture any fibers that could come loose therefrom. Typically, the cover webs 5032 and 5034 are made from a selection of fibers that provide a comfortable feel, particularly on the side 5038 of the filtering structure 5024 that makes contact with the wearer's face. The construction of various filter layers, shaping layers, and cover webs that may be used in conjunction with a filtering structure used in a respirator of the present disclosed are described below in more detail.

Respirator Filtering Structure

The filtering structure that is used in connection with respirators suitable for use in connection with the present disclosure may take on a variety of different shapes and configurations. As shown in FIG. 51, the filtering structure may have a plurality of layers, including a fibrous filtration layer and one or more fibrous cover webs. When the respirator is a molded mask, the mask body may also include a shaping layer. See, e.g., U.S. Pat. No. 6,923,182 to Angadjivand et al.; U.S. Pat. No. 7,131,442 to Kronzer et al.; U.S. Pat. Nos. 6,923,182 and 6,041,782 to Angadjivand et al.; U.S. Pat. No. 4,807,619 to Dyrud et al.; and U.S. Pat. No. 4,536,440 to Berg. The filtering structure removes contaminants from the ambient air and may also act as a barrier layer that precludes liquid splashes from entering the mask interior. The outer cover web can act to stop or slow any liquid splashes, and the inner filtering structure may then contain them if there is penetration past the other layers. The filtering structure can be of a particle capture or gas and vapor type filter. The filtering structure may include multiple layers of similar or dissimilar filter media and one or more cover webs as the application requires. If the respirator contains a fluid impermeable mask body that has one or more filter cartridges attached to it (see, e.g., U.S. Pat. No. 6,874,499 to Viner et al.; U.S. Pat. No. 6,277,178 and D613,850 to Holmquist-Brown et al.; RE39,493 to Yuschak et al.; D652, 507, D471,627, and D467,656 to Mittelstadt et al.; and D518,571 to Martin), then the filtering structure may be disposed within the filtering cartridge. Filtering structures located in filter cartridges do not need shaping layers to support them.

Filtration Layer

Filters that may be beneficially employed in a respirator of the disclosure are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged polymeric microfibers that are produced from processes such as meltblowing. Polyolefin microfibers formed from polypropylene that has been electrically charged provide particular utility for particulate capture applications.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the manufacturing operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area. See, e.g., U.S. Pat. Nos. 5,804,295 and 5,656, 368 to Braun et al. The filtration layer also may include multiple filtration layers joined together by an adhesive or any other means. Essentially any suitable material that is known (or later developed) for forming a filtering layer may be used as the filtering material. Webs of melt-blown fibers, such as those taught in Wente, Van A., Superfine Thermoplastic Fibers, 48 Indus. Engn. Chem., 1342 et seq. (1956), especially when in a persistent electrically charged (electret) form are especially useful (see, e.g., U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Pat. Re. 31,285, also may be suitable, as well as rosin-wool fibrous webs and webs of glass fibers or solution-blown, or electrostatically sprayed fibers, especially in microfiber form. Electric charge can be imparted to the fibers by contacting the fibers with water as disclosed in U.S. Pat. No. 6,824,718 to Eitzman et al.; U.S. Pat. No. 6,783,574 to Angadjivand et al.; U.S. Pat. No. 6,743,464 to Insley et al.; U.S. Pat. Nos. 6,454,986 and 6,406,657 to Eitzman et al.; and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydrocharging process (see U.S. Pat. No. 5,908,598 to Rousseau et al.). Fluorine atoms, in particular, can be disposed at the surface of the fibers in the filter layer to improve filtration performance in an oily mist environment. See U.S. Pat. Nos. 6,398,847 B1, 6,397,458 B1, and 6,409,806 B1 to Jones et al. Typical basis weights for electret BMF filtration layers are about 10 to 100 grams per square meter ($g/m^2$). When electrically charged according to techniques described in, for example, the '507 Angadjivand et al. patent, and when including fluorine atoms as mentioned in the Jones et al. patents, the basis weight may be about 20 to 40 $g/m^2$ and about 10 to 30 $g/m^2$, respectively. Additionally, sorptive materials such as activated carbon may be disposed between the fibers and/or various layers that include the filtering structure. Further, separate particulate filtration layers may be used in conjunction with sorptive layers to provide filtration for both particulates and vapors. The sorbent component may be used for removing hazardous or odorous gases from the breathing air. Sorbents may include powders or granules that are bound in a filter layer by adhesives, binders, or fibrous structures. See U.S. Pat. No. 6,334,671 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumna-silica catalyst substrates, and alumna particles. An example of a sorptive filtration structure that may be conformed into various configurations is described in U.S. Pat. No. 6,391,429 to Senkus et al.

Cover Web(s)

The cover webs also may have filtering abilities, although typically not nearly as good as the filtering layer and/or may serve to make a filtering face-piece respirator more comfortable to wear. The cover webs may be made from nonwoven fibrous materials such as spun bonded fibers that contain, for example, polyolefins, and polyesters. See, e.g., U.S. Pat. No. 6,041,782 to Angadjivand et al.; U.S. Pat. No. 4,807,619 to Dyrud et al.; and U.S. Pat. No. 4,536,440 to Berg. When a wearer inhales, air is drawn through the mask body, and airborne particles become trapped in the interstices between the fibers, particularly the fibers in the filter layer.

The inner cover web can be used to provide a smooth surface for contacting the wearer's face, and the outer cover web, in addition to providing splash fluid protection, can be used for entrapping loose fibers in the mask body and for aesthetic reasons. The cover web typically does not provide any substantial filtering benefits to the filtering structure, although it can act as a pre-filter when disposed on the exterior of (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers may be less than 3.5 denier (typically less than 2 denier, and more typically less than 1 denier but greater than 0.1 denier). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector. See U.S. Pat. No. 6,492,286 to Berrigan et al. Spunbond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland. Cover webs typically have very few fibers protruding from the web surface after processing and therefore have a smooth outer surface. Examples of cover webs that may be used in a respirator of the present disclosure are described, e.g., in U.S. Pat. No. 6,041,782 to Angadjivand; U.S. Pat. No. 6,123,077 to Bostock et al.; and WO 96/28216A to Bostock et al.

Shaping Layer

The shaping layer(s) may be formed from at least one layer of fibrous material that can be molded to the desired shape with the use of heat and that retains its shape when cooled. Shape retention is typically achieved by causing the fibers to bond to each other at points of contact between them, for example, by fusion or welding. Any suitable material known for making a shape-retaining layer of a direct-molded respiratory mask may be used to form the mask shell, including, for example, a mixture of synthetic staple fiber, preferably crimped, and bicomponent staple fiber. Bicomponent fiber is a fiber that includes two or more distinct regions of fibrous material, typically distinct regions of polymeric materials. Typical bicomponent fibers include a binder component and a structural component. The binder component allows the fibers of the shape-retaining shell to be bonded together at fiber intersection points when heated and cooled. During heating, the binder component flows into contact with adjacent fibers. The shape-retaining layer can be prepared from fiber mixtures that include staple fiber and bicomponent fiber in a weight-percent ratios that may range, for example, from 0/100 to 75/25. Preferably, the material includes at least 50 weight-percent bicomponent fiber to create a greater number of intersection bonding points, which, in turn, increase the resilience and shape retention of the shell.

Suitable bicomponent fibers that may be used in the shaping layer include, for example, side-by-side configurations, concentric sheath-core configurations, and elliptical sheath-core configurations. One suitable bicomponent fiber is the polyester bicomponent fiber available, under the trade designation "KOSA T254" (12 denier, length 38 mm), from Kosa of Charlotte, N.C., U.S.A., which may be used in combination with a polyester staple fiber, for example, that available from Kosa under the trade designation "T259" (3 denier, length 38 mm) and possibly also a polyethylene terephthalate (PET) fiber, for example, that available from Kosa under the trade designation "T295" (15 denier, length 32 mm). Alternatively, the bicomponent fiber may include a generally concentric sheath-core configuration having a core of crystalline PET surrounded by a sheath of a polymer formed from isophthalate and terephthalate ester monomers. The latter polymer is heat softenable at a temperature lower than the core material. Polyester has advantages in that it can contribute to mask resiliency and can absorb less moisture than other fibers.

Alternatively, the shaping layer can be prepared without bicomponent fibers. For example, fibers of a heat-flowable polyester can be included together with staple, preferably crimped, fibers in a shaping layer so that, upon heating of the web material, the binder fibers can melt and flow to a fiber intersection point where it forms a mass, that upon cooling of the binder material, creates a bond at the intersection point. Staple fibers (for the shaping component) that are pre-treated with Ammonium Polyphosphate type intumescent FR agents may be used in connection with the present disclosure in addition to or in lieu of a spray-application of the agent. Having the staple fibers contain, or, otherwise being treated with, the agent and then formed into a shell (using binder fibers to hold it together) would be another pathway to employ the agents for our purpose.

When a fibrous web is used as the material for the shape-retaining shell, the web can be conveniently prepared on a "Rando Webber" air-laying machine (available from Rando Machine Corporation, Macedon, N.Y.) or a carding machine. The web can be formed from bicomponent fibers or other fibers in conventional staple lengths suitable for such equipment. To obtain a shape-retaining layer that has the required resiliency and shape-retention, the layer preferably has a basis weight of at least about 100 g/m$^2$, although lower basis weights are possible. Higher basis weights, for example, approximately 150 or more than 200 g/m$^2$, may provide greater resistance to deformation and greater resiliency and may be more suitable if the mask body is used to support an exhalation valve. Together with these minimum basis weights, the shaping layer typically has a maximum density of about 0.2 g/cm$^2$ over the central area of the mask. Typically, the shaping layer would have a thickness of about 0.3 to 2.0, more typically about 0.4 to 0.8 millimeters. Examples of shaping layers suitable for use in the present disclosure are described in the following patents: U.S. Pat. No. 5,307,796 to Kronzer et al.; U.S. Pat. No. 4,807,619 to Dyrud et al.; and U.S. Pat. No. 4,536,440 to Berg. Staple fibers (for the shaping component) that are pre-treated with Ammonium Polyphosphate type intumescent FR agents may be used in connection with the present disclosure in addition to or in lieu of a spray-application of the agent. Having the staple fibers contain, or, otherwise being treated with, the agent and then formed into a shell (using binder fibers to hold it together) would be another pathway to employ the agents for our purpose.

Respirator Componentry

The strap(s) that are used in the respirator harness preferably can be expanded to greater than twice its total length and can be returned to its relaxed state many times throughout the useful life of the respirator. The strap also could possibly be increased to three or four times its relaxed state length and can be returned to its original condition without any damage thereto when the tensile forces are removed. The elastic limit thus is preferably not less than two, three, or four times the relaxed-state length of the strap(s). Typically, the strap(s) are about 20 to 30 cm long, 3 to 20 mm wide, and about 0.3 to 1 mm thick. The strap(s) may extend from the first side of the respirator to the second side as a continuous strap or the strap may have a plurality of parts, which can be joined together by further fasteners or buckles. For example, the strap may have first and second parts that are joined together by a fastener that can be quickly uncoupled by the wearer when removing the mask body from the face. Alternatively, the strap may form a loop that is placed around the wearer's ears. See, e.g., U.S. Pat. No. 6,394,090 to Chen et al. Examples of fastening or clasping mechanism that may be used to joint one or more parts of the strap together is shown, for example, in the following U.S. Pat. No. 6,062,221 to Brostrom et al.; U.S. Pat. No. 5,237,986 to Seppala; and EP1,495,785A1 to Chen. The harness also may include a reusable carriage, one or more buckles, and/or a crown member to support the respirator on a person's head. See, e.g., U.S. Pat. Nos. 6,732,733 and 6,457,473 to Brostrom et al.; and U.S. Pat. Nos. 6,591,837 and 6,715,490 to Byram. Although a filtering face-piece respirator has been illustrated in showing the present disclosure, the respirator may include a compliable rubber-type mask that has one or more filter cartridges attached to it. See, e.g., U.S. Pat. Nos. RE 39,493 to Yuschak et al.; U.S. Pat. No. 7,650,884 to Flannigan et al. Or it could be a full face respirator. See, e.g., U.S. Pat. No. 8,067,110 to Rakow et al.; U.S. Pat. No. 7,594,510 to Betz et al.; and D421,118 and D378,610 to Reischel et al.

As indicated, an exhalation valve may be attached to the mask body to facilitate purging exhaled air from the interior gas space. The use of an exhalation valve may improve wearer comfort by rapidly removing the warm moist exhaled air from the mask interior. See, e.g., U.S. Pat. Nos. 7,188,622, 7,028,689, and 7,013,895 to Martin et al.; U.S. Pat. Nos. 7,428,903, 7,311,104, 7,117,868, 6,854,463, 6,843,248, and 5,325,892 to Japuntich et al.; U.S. Pat. Nos. 7,302,951 and 6,883,518 to Mittelstadt et al.; and RE37,974 to Bowers. Essentially any exhalation valve that provides a suitable pressure drop and that can be properly secured to the mask body may be used in connection with the present disclosure to rapidly deliver exhaled air from the interior gas space to the exterior gas space.

A nose clip that is used with filtering face-piece respirators of the present disclosure may be essentially any additional part that assists in improving the fit over the wearer's nose. Because the wearer's face exhibits a major change in contour in the nose region, a nose clip may be used to better assist in achieving the appropriate fit in this location. The nose clip may include, for example, a pliable dead soft band of metal such as aluminum, which can be shaped to hold the mask in a desired fitting relationship over the nose of the wearer and where the nose meets the cheek. The nose clip may be linear in shape when viewed from a plane projected onto the mask body when in its folded or partially folded condition. Alternatively, the nose clip can be a M-shaped nose clip, an example of which is shown in U.S. Pat. No. 5,558,089 and Des. 412,573 to Castiglione. Other nose clips are described in U.S. patent application Ser. No. 12/238,737 (filed Sep. 26, 2008); and U.S. Patent Publication Nos. 2007-0044803A1 (filed Aug. 25, 2005) and 2007-0068529A1 (filed Sep. 27, 2005). As indicated above, the inventive dispenser can assist in placing a pliable nose clip in a curved shape ready for placement on the wearer's nose. The nose clip is in a substantially linear configuration while in the container. The constriction window is adapted to enable the outermost respirator to have the nose clip change from the substantially linear configuration to a curved configuration when pulled through the constriction window. The imparted curved configuration of the nose clip is concave relative to the mask body interior. Preferably, the curvature imparted by the dispenser onto the nose clip generally matches the curvature of a person's nose.

Strap Materials

All polymer strands in the openwork structure may include a single polymeric material and/or a plurality of polymeric materials, including blends of polymers. Thus, adjoining strands may include the same or different polymeric materials. Polymers used to make netting and arrays of polymeric strands described herein are selected to be compatible with each other such that the first and second strands bond together as the bond regions. In methods described herein for making the nettings and arrays of polymeric strands, the bonding occurs in a relatively short period of time (typically less than 1 second). The bond regions, as well as the strands typically cool through air and natural convection and/or radiation. In selecting polymers for the strands, in some embodiments, it may be desirable to select polymers of bonding strands that have dipole interactions (or H-bonds) or covalent bonds. Bonding between strands has been observed to be improved by increasing the time that the strands are molten to enable more interaction between polymers. Bonding of polymers has generally been observed to be improved by reducing the molecular weight of at least one polymer and or introducing an additional co-monomer to improve polymer interaction and/or reduce the rate or amount of crystallization. In some embodiments, the bond strength is greater than the strength of the strands forming the bond. In some embodiments, it may be desirable for the bonds to break and thus the bonds will be weaker than the strands.

Suitable polymeric materials for extrusion from dies described herein, methods described herein, and for composite layers described herein include thermoplastic resins comprising polyolefins (e.g., polypropylene and polyethylene), polyvinyl chloride, polystyrene, nylons, polyesters (e.g., polyethylene terephthalate) and copolymers and blends thereof. Suitable polymeric materials for extrusion from dies described herein, methods described herein, and for composite layers described herein also include elastomeric materials (e.g., ABA block copolymers, polyurethanes, polyolefin elastomers, polyurethane elastomers, metallocene polyolefin elastomers, polyamide elastomers, ethylene vinyl acetate elastomers, and polyester elastomers). Exemplary adhesives for extrusion from dies described herein, methods described herein, and for composite layers described herein include acrylate copolymer pressure sensitive adhesives, rubber based adhesives (e.g., those based on natural rubber, polyisobutylene, polybutadiene, butyl rubbers, styrene block copolymer rubbers such as styrene-butadiene-styrene block copolymers (SBS) and styrene-ethylene-butadiene-styrene (SEBS), etc.), adhesives based on silicone polyureas or silicone polyoxamides, polyurethane type adhesives, and poly(vinyl ethyl ether), and copolymers or blends of these. Other desirable materials include, for example, styrene-acrylonitrile, cellulose acetate butyrate, cellulose acetate propionate, cellulose triacetate, polyether sulfone, polymethyl methacrylate, polyurethane, polyester, polycarbonate, polyvinyl chloride, polystyrene, polyethylene naphthalate, copolymers or blends based on naphthalene dicarboxylic acids, polyolefins, polyimides, mixtures and/or combinations thereof. Exemplary release materials for extrusion from dies described herein, methods described herein, and for composite layers described herein include silicone-grafted polyolefins such as those described in U.S. Pat. No. 6,465,107 (Kelly) and U.S. Pat. No. 3,471,588 (Kanner et al.), silicone block copolymers such as those described in PCT Publication No. WO96039349, published Dec. 12, 1996, low density polyolefin materials such as those described in U.S. Pat. Nos. 6,228,449, 6,348,249, and 5,948,517 to Meyer. In some embodiments using first and second polymeric materials to make nettings and arrays of polymeric strands described herein, each have a different modulus (i.e., one relatively higher to the other).

In some embodiments using first and second polymeric materials to make nettings and arrays of polymeric strands described herein, each have a different yield strength.

In some embodiments, polymeric materials used to make nettings and arrays described herein may include a colorant (e.g., pigment and/or dye) for functional (e.g., optical effects) and/or aesthetic purposes (e.g., each has different color/shade). Suitable colorants are those known in the art for use in various polymeric materials. Exemplary colors imparted by the colorant include white, black, red, pink, orange, yellow, green, aqua, purple, and blue. In some embodiments, it is desirable to have a certain degree of opacity for one or more of the polymeric materials. The amount of colorant(s) to be used in specific embodiments can be readily determined by those skilled in the (e.g., to achieve desired color, tone, opacity, transmissivity, etc.). If desired, the polymeric materials may be formulated to have the same or different colors.

In some embodiments, nettings and arrays of polymeric strands described herein have a basis weight in a range from 5 $g/m^2$ to 400 $g/m^2$ (in some embodiments, 10 $g/m^2$ to 300 $g/m^2$), for example, nettings as-made from dies described herein.

In some embodiments, nettings and arrays of polymeric strands described herein have a strand pitch in a range from 0.5 mm to 20 mm (in some embodiments, in a range from 0.5 mm to 10 mm).

Optionally, nettings and arrays of polymeric strands described herein are attached to a backing. The backings may be, for example, one of a film, net, or non-woven in elastic form or periodically cut to allow for expansion when a tensile force is applied. The nonwoven may be, for example, a spun bond web constructed like one of the cover webs described below. In some embodiments, nettings and arrays of polymeric strands described herein have a machine direction and a cross-machine direction, where the netting or arrays of polymeric strands is elastic in machine direction, and inelastic in the cross-machine direction. Elastic means that the material will substantially resume its original shape after being stretched (i.e., will sustain only a small permanent set following deformation and relaxation which set is less than 20 percent (in some embodiments, less than 10 percent) of the original length at moderate elongation (i.e., about 400-500%; in some embodiments, up to 300% to 1200%, or even up to 600 to 800%) elongation at room temperature). The elastic material can be both pure elastomers and blends with an elastomeric phase or content that will still exhibit substantial elastomeric properties at room temperature.

In some embodiments, arrays described herein of alternating first and second polymeric strands exhibit at least one of diamond-shaped or hexagonal-shaped openings. Long bond lengths, relative to the pitch of the bond in the machine direction, tend to create diamond shaped nets, whereas short bond lengths tend to create hexagon shaped nets.

In some embodiments, the bond regions have an average largest dimension perpendicular to the strand thickness, where the polymeric strands have an average width, and where the average largest dimension of the bond regions is at least 2 (in some embodiments, at least 2.5, 3, 3.5, or even at least 4) times greater than the average width of the polymeric strands.

Figure 41:
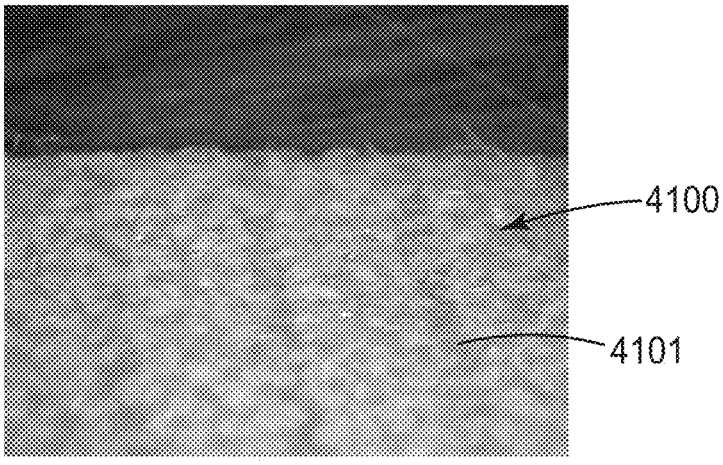
FIG. 41 is a digital optical image at 10× of an exemplary netting described herein having bond lines (see Example 22)
Figure 42:
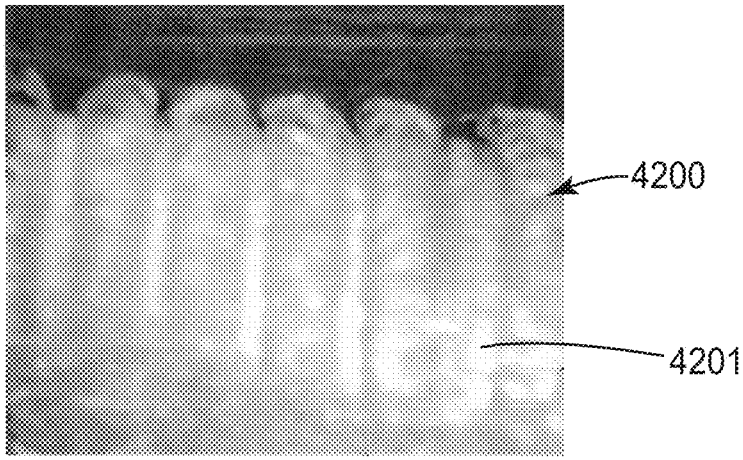
FIG. 42 is a digital optical image at 10× of an exemplary netting described herein having bond lines (see Example 23)

In some embodiments, a strap described herein includes bond lines as shown, for example, in FIGS. 41 and 42, where netting 4100 and 4200, respectively, have bond lines 4101, 4201.

Figure 38:
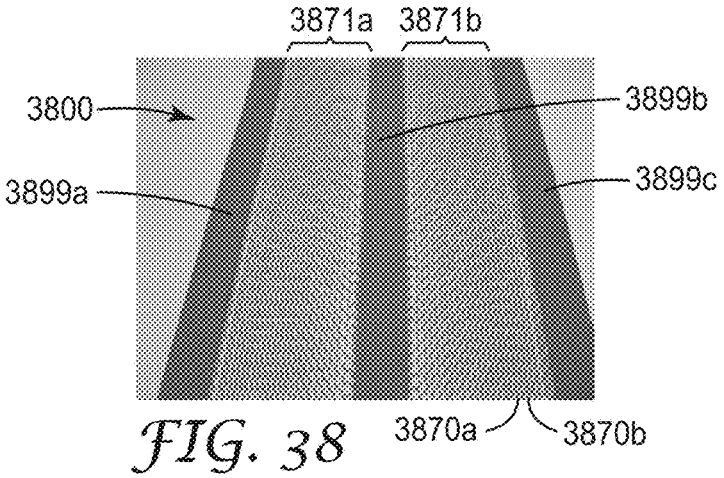
FIG. 38 is a digital optical image of an exemplary ribbon region-netting-film-netting-ribbon region article described herein (see Example 19)

The present disclosure also provides a strap that includes two nettings described herein with a ribbon region disposed there between. Typically, the netting and ribbon region are integral. The present disclosure also provides an article comprising netting described herein disposed between two ribbon regions. Typically, the netting and ribbon regions are integral. In some embodiments, the ribbon region has a major surface with engagement posts thereon. An example, without engagements posts, is shown in FIG. 38, where netting 3800 includes netting 3871*a* and 3871*b*, each having first strands 3870*a* and second strands 3870*b*. Film regions 3899*a*, 3899*b*, and 3899*c* are attached to netting 3871*a* and 3871*b*.

The present disclosure also provides a strap that includes more than one layer of openwork structures. The layers may include strands made from different polymers and that have different elasticities. The inner layers may be highly elastic and tacky, while the outer layers may be less tacky to provide better comfort to the user. Layers that are not tacky are not sticky to touch.

In some embodiments, the elastic nettings described herein can flex in the machine direction, cross direction, or both directions. Elastic netting can also provide a breathable, soft, and flexible strap. The elastic strap can be made as elastic in a first lengthwise direction and inelastic in a second direction normal thereto through use of an elastic and an inelastic strand.

EXEMPLARY EMBODIMENTS

1A. A netting including an array of polymeric strands periodically joined together at bond regions throughout the array but do not substantially cross over each other (i.e., at least 50 (at least 55, 60, 65, 70, 75, 80, 85, 90, 95, 99, or even 100) percent by number), where the netting has a thickness up to about 5 mm.

2A. The netting of Embodiment 1A having a basis weight in a range from 5 g/m$^2$ to 400 g/m$^2$ (in some embodiments, 10 g/m$^2$ to 200 g/m$^2$).

3A. The netting of Embodiment 1A having a basis weight in a range from 0.5 g/m$^2$ to 40 g/m$^2$ (in some embodiments, 1 g/m$^2$ to 20 g/m$^2$).

4A. The netting of any preceding Embodiment having a strand pitch (i.e., center point to center point of adjacent bonds in the machine direction) in a range from 0.5 mm to 20 mm (in some embodiments, in a range from 0.5 mm to 10 mm).

5A. The netting of any preceding Embodiment that is elastic.

6A. The netting of any of Embodiments 1A to 4A having a machine direction and a cross-machine direction, where the netting is elastic in machine direction, and inelastic in the cross-machine direction.

7A. The netting of any of Embodiments 1A to 4A having a machine direction and a cross-machine direction, where the netting is inelastic in the machine direction, and elastic in the cross-machine direction.

8A. The netting of any preceding Embodiment, where at least some of the polymeric stands include at least one of a dye or pigment therein.

9A. The netting of any preceding Embodiment, where the array of polymeric strands exhibits at least one of diamond-shaped or hexagonal-shaped openings.

10A. The netting of any preceding Embodiment, where at least some of the polymeric strands include a first polymer that is a thermoplastic (e.g., adhesives, nylons, polyesters, polyolefins, polyurethanes, elastomers (e.g., styrenic block copolymers), and blends thereof).

11A. The netting of Embodiment 10A, where the first polymer is an adhesive material.

12A. The netting of any preceding Embodiment, where the plurality of strands include alternating first and second polymeric strands, where the second polymeric strands include a second polymer.

13A. The netting of Embodiment 12A, where the first polymeric strands include the first polymer, and where the second polymeric strands include a second polymer that is a thermoplastic (e.g., adhesives, nylons, polyesters, polyolefins, polyurethanes, elastomers (e.g., styrenic block copolymers), and blends thereof).

14A. The netting of either of Embodiments 12A or 13A, where the first strands have an average width in a range from 10 micrometers to 500 micrometers (in a range from 10 micrometers to 400 micrometers, or even 10 micrometers to 250 micrometers).

15A. The netting of any of Embodiments 12A to 14A, where the second strands have an average width in a range from 10 micrometers to 500 micrometers (in a range from 10 micrometers to 400 micrometers, or even 10 micrometers to 250 micrometers).

16A. The netting of any of Embodiments 12A to 15A further including third strands disposed between at least some of the alternating first and second strands.

17A. The netting of any preceding Embodiment where the netting is stretched.

18A. The netting of any preceding Embodiment, where the bond regions have an average largest dimension perpendicular to the strand thickness, where the polymeric strands have an average width, and where the average largest dimension of the bond regions is at least 2 (in some embodiments, at least 2.5, 3, 3.5, or even at least 4) times greater than the average width of the polymeric strands.

19A. An article including a backing having the netting of any preceding Embodiment on a major surface thereof.

20A. The article of Embodiment 19A, where the backing is one of a film, net, or non-woven.

21A. The article of Embodiment 20A that includes bond lines.

22A. An article including the netting of any of Embodiment 1A to 18A disposed between two non-woven layers.

23A. An article including two nettings of any of Embodiments 1A to 20A with a ribbon region disposed there between.

24A. The article of Embodiment 23A, where the netting and ribbon region are integral.

25A. The article of either Embodiment 23A or 24A, where the ribbon region has a major surface with engagement posts thereon.

26A. An article including the netting of any of Embodiments 1A to 18A disposed between two ribbon regions.

27A. The article of Embodiment 26A, where the netting is integral with each of the ribbon regions.

28A. The article of either Embodiment 26A or 27A, where the ribbon has a major surface with engagement posts thereon.

29A. An attachment system including the netting of any of Embodiments 1A to 18A and an array of engagement posts (e.g., hooks) for engaging with the netting.

30A. An absorbent article including the attachment system of Embodiment 29A.

31A. A method of making the netting of any of Embodiments 1A to 18A, the method including one of Method I or Method II:

Method I providing an extrusion die including a plurality of shims positioned adjacent to one another, the shims together defining a cavity, the extrusion die having a plurality of first dispensing orifices in fluid communication with the cavity and a plurality of second dispensing orifices in fluid communication with the cavity, such that the first and second dispensing orifices are alternated; and dispensing first polymeric strands from the first dispensing orifices at a first strand speed while simultaneously dispensing second polymeric strands from the second dispensing orifices at a second strand speed, where the first strand speed is at least 2 (in some embodiments, in a range from 2 to 6, or even 2 to 4) times the second strand speed to provide the netting (i.e., the first and second dispensing orifices in fluid communication with the (single) cavity such that in use the first and second strand speeds are sufficiently different to produce net bonding); or Method II providing an extrusion die including a plurality of shims positioned adjacent to one another, the shims together defining a first cavity and a second cavity, the extrusion die having a plurality of first dispensing orifices in fluid communication with the first cavity and having a plurality of second dispensing orifices connected to the second cavity, such that the first and second dispensing orifices are alternated; and dispensing first polymeric strands from the first dispensing orifices at a first strand speed while simultaneously dispensing second polymeric strands from the second dispensing orifices at a second strand speed, where the first strand speed is at least 2 (in some embodiments, in a range from 2 to 6, or even 2 to 4) times the second strand speed to provide the netting.

32A. The method of Embodiment 30A, where the plurality of shims of either method includes a plurality of a repeating sequence of shims that includes a shim that provides a passageway between the first cavity and at least one of the first dispensing orifices and a shim that provides a passageway between the second cavity and the at least one of the second dispensing orifices.

33A. The method of either Embodiments 31A or 32A, where the repeating sequence of either method further includes at least one spacer shim.

34A. The method of any of Embodiments 31A to 33A of either method including at least 1000 of the shims.

35A. The method of any of Embodiments 31A to 34A, where the first dispensing orifices and the second dispensing orifices of either method are collinear.

36A. The method of any of Embodiments 31A to 35A, where for either method, the first dispensing orifices are collinear, and the second dispensing orifices are collinear but offset from the first dispensing orifices.

1B. An extrusion die including one of:

(I)

a plurality of shims positioned adjacent to one another, the shims together defining a cavity and a dispensing surface, where the dispensing surface has an array of first dispensing orifices alternating with an array of second dispensing orifices, where the plurality of shims includes a plurality of a repeating sequence of shims including a shim that provides a fluid passageway between the cavity and the first dispensing orifices and a shim that provides a fluid passageway between the cavity and the second dispensing orifices where the first array of fluid passageways has greater fluid restriction than the second array of fluid passageways; or (II)

a plurality of shims positioned adjacent to one another, the shims together defining a first cavity, a second cavity, and a dispensing surface, where the dispensing surface has an array of first dispensing orifices alternating with an array of second dispensing orifices, where the plurality of shims includes a plurality of a repeating sequence of shims including a shim that provides a fluid passageway between the first cavity and one of the first dispensing orifices and a shim that provides a fluid passageway between the second cavity and one of second the dispensing orifices.

2B. The extrusion die of Embodiment 1B, where for either I or II, the repeating sequence further includes at least one spacer shim.

3B. The extrusion die of either Embodiment 1B or 2B including at least 1000 of the shims for either I or II.

4B. The extrusion die of any of Embodiments 1B to 3B, where for either I or II, the first dispensing orifices and the second dispensing orifices are collinear.

5B. The extrusion die of any of Embodiments 1B to 4B, where for either I or II, the first dispensing orifices are collinear, and the second dispensing orifices are collinear but offset from the first dispensing orifices.

6B. The extrusion die of any of Embodiments 1B to 5B for either I or II, further including a manifold body for supporting the shims, the manifold body having at least one manifold therein, the manifold having an outlet; and further including an expansion seal disposed so as to seal the manifold body and the shims, where the expansion seal defines a portion of at least one of the cavities, and where the expansion seal allows a conduit between the manifold and the cavity.

7B. The extrusion die of any of Embodiment 6B, where for either I or II, the expansion seal defines a portion of both the first and the second cavities.

8B. The extrusion die of any of Embodiment 7B, where the expansion seal is made of copper.

9B. The extrusion die of any of Embodiments 1B to 8B, further including a pair of end blocks for supporting the plurality of shims for either I or II.

10B. The extrusion die of any of Embodiment 9B, where for either I or II, each of the shims has at least one through-hole for the passage of connectors between the pair of end blocks.

11B. The extrusion die of any of Embodiments 1B to 10B, where for either I or II, each of the dispensing orifices of the first and the second arrays have a width, and where each of the dispensing orifices of the first and the second arrays are separated by up to 2 times the width of the respective dispensing orifice.

12B. The extrusion die of any of Embodiments 1B to 11B, for either I or II, where the first cavity is supplied with a first polymer at a first pressure so as to dispense the first polymer from the first array at a first strand speed, where the second cavity is supplied with a second polymer at a second pressure so as to dispense the second polymer from the second array at a second strand speed, and where the first strand speed is between about 2 to 6 times the second strand speed, such that a netting including an array of alternating first and second polymeric strands is formed.

13B. The extrusion die of any of Embodiments 1B to 12B, where for either I or II, the fluid passageway is up to 5 mm in length.

1C. An extrusion die including one of:

(I)

a plurality of shims positioned adjacent to one another, the shims together defining a cavity and a dispensing surface, where the dispensing surface has at least one net-forming zone and at least one film-forming zone, where the net-forming zone has an array of first dispensing orifices alternating with an array of second dispensing orifices; or (II)

a plurality of shims positioned adjacent to one another, the shims together defining a first cavity, a second cavity, and a dispensing surface, where the dispensing surface has at least one net-forming zone and at least one film-forming zone, where the net-forming zone has an array of first dispensing orifices alternating with an array of second dispensing orifices.

2C. The extrusion die of Embodiment 1C, where for either I or II the repeating sequence further includes at least one spacer shim.

3C. The extrusion die of either Embodiment 1C or 2C including at least 1000 of the shims for either I or II.

4C. The extrusion die of any of Embodiments 1C to 3C, where for either I or II the first dispensing orifices and the second dispensing orifices are collinear.

5C. The extrusion die of any of Embodiments 1C to 3C, where for either I or II, the first dispensing orifices are collinear, and the second dispensing orifices are collinear but offset from the first dispensing orifices.

6C. The extrusion die of any of Embodiments 1C to 5C for either I or II further including a manifold body for supporting the shims, the manifold body having at least one manifold therein, the manifold having an outlet; and further including an expansion seal disposed so as to seal the manifold body and the shims, where the expansion seal defines a portion of at least one of the cavities, and where the expansion seal allows a conduit between the manifold and the cavity.

7C. The extrusion die of any of Embodiment 6C, where for either I or II the expansion seal defines a portion of both the first and the second cavities.

8C. The extrusion die of any of Embodiment 7C, where the expansion seal is made of copper.

9C. The extrusion die of any of Embodiments 1C to 8C, further including a pair of end blocks for supporting the plurality of shims for either I or II.

10C. The extrusion die of any of Embodiment 9C, where for either I or II each of the shims has at least one through-hole for the passage of connectors between the pair of end blocks.

11C. The extrusion die of any of Embodiments 1C to 10C, for either I or II, where the first cavity is supplied with a first polymer at a first pressure so as to dispense the first polymer from the first array at a first strand speed, where the second cavity is supplied with a second polymer at a second pressure so as to dispense the second polymer from the second array at a second strand speed, and where the first strand speed is between about 2 to 6 times the second strand speed, such that a netting including an array of alternating first and second polymeric strands is formed in the net-forming zone, and such that a film attached to the netting is formed in the film-forming zone.

1D. An attachment system including a netting and an array of engagement posts (e.g., hooks) for engaging with the netting, the netting including an array of polymeric strands periodically joined together at bond regions throughout the array, where the netting has a thickness up to about 5 mm.

2D. The attachment system of Embodiment 1D, where the engagement posts are attached to a backing.

3D. The attachment system of Embodiment 2D, where the backing is one of a film, net, or non-woven.

4D. The attachment system of any of Embodiments 1D to 3D having a basis weight in a range from 0.5 $g/m^2$ to 40 $g/m^2$ (in some embodiments, 1 $g/m^2$ to 20 $g/m^2$).

5D. The attachment system of any of Embodiments 1D to 4D having a strand pitch in a range from 0.5 mm to 20 mm (in some embodiments, in a range from 0.5 mm to 10 mm).

6D. The attachment system of any of Embodiments 1D to 5D that is elastic.

7D. The attachment system of any of Embodiments 1D to 6D, where the netting has a machine direction and a cross-machine direction, where the netting is elastic in machine direction, and inelastic in the cross-machine direction.

8D. The attachment system of any of Embodiments 1D to 6D, where the netting has a machine direction and a cross-machine direction, where the netting is inelastic in the machine direction and elastic in the cross-machine direction.

9D. The attachment system of any of Embodiments 1D to 8D, where at least some of the polymeric strands include at least one of a dye or pigment therein.

10D. The attachment system of any of Embodiments 1D to 9D, where the array of polymeric strands exhibits at least one of diamond-shaped or hexagonal-shaped openings.

11D. The attachment system of any of Embodiments 1D to 10D, where at least some of the polymeric strands include a first polymer that is a thermoplastic (e.g., adhesives, nylons, polyesters, polyolefins, polyurethanes, elastomers (e.g., styrenic block copolymers), and blends thereof).

12D. The netting of any of Embodiments 1D to 11D, where the plurality of strands include alternating first and second polymeric strands, where the second polymeric strands include a second polymer.

13D. The attachment system of Embodiment 12D, where the first polymeric strands include the first polymer, and where the second polymeric strands include a second polymer that is a thermoplastic (e.g., adhesives, nylons, polyesters, polyolefins, polyurethanes, elastomers (e.g., styrenic block copolymers), and blends thereof).

14D. The attachment system of either Embodiments 12D or 13D, where the first strands have an average width in a range from 10 micrometers to 500 micrometers (in a range from 10 micrometers to 400 micrometers, or even 10 micrometers to 250 micrometers).

15D. The attachment system of any of Embodiments 12D to 14D, where the second strands have an average width in a range from 10 micrometers to 500 micrometers (in a range from 10 micrometers to 400 micrometers, or even 10 micrometers to 250 micrometers).

16D. The attachment system of any of Embodiments 12D to 15D, where the first strands, second strands, and bond regions each have thicknesses that are substantially the same.

17D. The attachment system of any of Embodiments 1D to 16D, where the bond regions have an average largest dimension perpendicular to the strand thickness, where the polymeric strands have an average width, and where the average largest dimension of the bond regions is at least 2 (in some embodiments, at least 2.5, 3, 3.5, or even at least 4) times greater than the average width of the polymeric strands.

18D. The attachment system of any of Embodiments 12D to 17D, where the array of the netting further includes third strands disposed between at least some of the alternating first and second strands.

19D. The attachment system of any of Embodiments 12D to 18D, where there is a ribbon region adjacent and connected to one side of the netting.

20D. The attachment system of Embodiment 19D, where the netting and ribbon region are integral.

21D. The attachment system of either Embodiment 19D or 20D, where the ribbon region is inelastic.

22D. The article of any of Embodiments 19D to 21D, where the ribbon region has a major surface with the engagement posts thereon.

23D. An absorbent article including the attachment system of any of Embodiments 1D to 22D.

1E. An attachment system including an array of engagement posts (e.g., hooks) engaged with a netting, the netting including an array of polymeric strands periodically joined together at bond regions throughout the array, where the netting has a thickness up to about 5 mm.

2E. The attachment system of Embodiment 1E, where the engagement posts are attached to a backing.

3E. The attachment system of Embodiment 2E, where the backing is one of a film, net, or non-woven.

4E. The attachment system of Embodiment 1E to 3E having a basis weight in a range from 0.5 $g/m^2$ to 40 $g/m^2$ (in some embodiments, 1 $g/m^2$ to 20 $g/m^2$).

5E. The attachment system of any of Embodiments 1E to 4E having a strand pitch in a range from 0.5 mm to 20 mm (in some embodiments, in a range from 0.5 mm to 10 mm).

6E. The attachment system of any of Embodiments 1E to 5E that is elastic.

7E. The attachment system of any of Embodiments 1E to 6E, where the netting has a machine direction and a cross-machine direction, where the netting is elastic in the machine direction and inelastic in the cross-machine direction.

8E. The attachment system of any of Embodiments 1E to 6E, where the netting has a machine direction and a cross-machine direction, where the netting is inelastic in the machine direction and elastic in the cross-machine direction.

9E. The attachment system of any of Embodiments 1E to 8E, where at least some of the of polymeric strands include at least one of a dye or pigment therein.

10E. The attachment system of any of Embodiments 1E to 9E, where the array polymeric strands exhibits at least one of diamond-shaped or hexagonal-shaped openings.

11E. The attachment system of any of Embodiments 1E to 10E, where at least some of the polymeric strands include a polymer that is a thermoplastic (e.g., adhesives, nylons, polyesters, polyolefins, polyurethanes, elastomers (e.g., styrenic block copolymers), and blends thereof).

12E. The netting of any of Embodiments 1E to 11E, where the plurality of strands include alternating first and second polymeric strands, where the second polymeric strands include a second polymer.

13E. The attachment system of Embodiment 12E, where the first polymeric strands include the first polymer, and where the second polymeric strands include a second polymer that is a thermoplastic (e.g., adhesives, nylons, polyesters, polyolefins, polyurethanes, elastomers (e.g., styrenic block copolymers), and blends thereof).

14E. The attachment system of either Embodiments 12E or 13E, where the first strands have an average width in a range from 10 micrometers to 500 micrometers (in a range from 10 micrometers to 400 micrometers, or even 10 micrometers to 250 micrometers).

15E. The attachment system of any of Embodiments 12E to 14E, where the second strands have an average width in a range from 10 micrometers to 500 micrometers (in a range from 10 micrometers to 400 micrometers, or even 10 micrometers to 250 micrometers).

16E. The attachment system of any of Embodiments 1E to 15E, where the bond regions have an average largest dimension perpendicular to the strand thickness, where the polymeric strands have an average width, and where the average largest dimension of the bond regions is at least 2 (in some embodiments, at least 2.5, 3, 3.5, or even at least 4) times greater than the average width of the polymeric strands.

17E. The attachment system of any of Embodiments 1E to 16E, where there is a ribbon region adjacent and connected to one side of the netting.

18E. The attachment system of Embodiment 17E, where the netting and ribbon region are integral.

19E. The attachment system of either Embodiment 17E or 18E, where the ribbon region is inelastic.

20E. The attachment system of any of Embodiments 17E to 19E, where the ribbon region has a major surface with the engagement posts thereon.

21E. An absorbent article including the attachment system of any of Embodiments 1E to 20E.

1F. An array of alternating first and second polymeric strands, where the first and second strands periodically join together at bond regions throughout the array, where the first strands have an average first yield strength, and where the second strands have an average second yield strength that is different (e.g., at least 10 percent different) than the first yield strength.

2F. The array of alternating first and second polymeric strands of Embodiment 1F, where the array has a thickness up about 5 mm.

3F. The array of either Embodiment 1F or 2F having a strand pitch in a range from 0.5 mm to 20 mm (in some embodiments, in a range from 0.5 mm to 10 mm).

4F. The array of any of Embodiments 1F to 3F, where at least one of the first or second polymeric materials each include at least one of a dye or pigment therein.

5F. The array of any of Embodiments 1F to 4F having at least one of diamond-shaped or hexagonal-shaped openings.

6F. The array of any of Embodiments 1F to 5F, where the first polymer is a thermoplastic (e.g., adhesives, nylons, polyesters, polyolefins, polyurethanes, elastomers (e.g., styrenic block copolymers), and blends thereof).

7F. The array of any of Embodiments 1F to 6F, where the first polymer is an adhesive material.

8F. The array of any of Embodiments 1F to 7F, where the second polymer is a thermoplastic (e.g., adhesives, nylons, polyesters, polyolefins, polyurethanes, elastomers (e.g., styrenic block copolymers), and blends thereof).

9F. The array of any of Embodiments 1F to 8F, where the first strands have an average width in a range from 10 micrometers to 500 micrometers (in a range from 10 micrometers to 400 micrometers, or even 10 micrometers to 250 micrometers).

10F. The array of any of Embodiments 1F to 9F, where the second strands have an average width in a range from 10 micrometers to 500 micrometers (in a range from 10 micrometers to 400 micrometers, or even 10 micrometers to 250 micrometers).

11F. The array of any of Embodiments 1F to 10F, where the first strands, second strands, and bond regions each have thicknesses that are substantially the same.

12F. The array of any of Embodiments 1F to 11F, where the bond regions have an average largest dimension perpendicular to the strand thickness, and where the average largest dimension of the bond regions is at least 2 (in some embodiments, at least 2.5, 3, 3.5, or even at least 4) times greater than the average width of at least one of the first strands or the second strands.

13F. An article including a backing having the array of any of Embodiments 1F to 12F on a major surface thereof.

14F. The article of Embodiment 13F, where the backing is one of a film, net, or non-woven.

15F. An article including two arrays of any of Embodiments 1F to 14F with a ribbon region disposed there between.

16F. The article of Embodiment 15F, where the array and ribbon region are integral.

17F. The article of either Embodiment 14F or 15F, where the ribbon region has a major surface with the engagement posts thereon.

18F. An article including the array of any of Embodiments 1F to 17F disposed between two ribbon regions.

19F. The article of Embodiment 18F, where the array is integral with each of the ribbon regions.

20F. The article of either Embodiment 16F or 17F, where the film has a major surface with the engagement posts thereon.

21F. A wound dressing including the array of alternating first and second polymeric strands of any of Embodiments 1F to 20F.

22F. A method of making the array of alternating first and second polymeric strands of any of Embodiments 1F to 21F, the method including:

providing an extrusion die including a plurality of shims positioned adjacent to one another, the shims together defining a first cavity and a second cavity, the extrusion die having a plurality of first dispensing orifices in fluid communication with the first cavity and having a plurality of second dispensing orifices connected to the second cavity, such that the first and second dispensing orifices are alternated; and dispensing first polymeric strands from the first dispensing orifices at a first strand speed while simultaneously dispensing second polymeric strands from the second dispensing orifices at a second strand speed, where the first strand speed is at least 2 (in some embodiments, in a range from 2 to 6 or even 2 to 4) times the second strand speed to provide the array of alternating first and second polymeric strands.

23F. The method according to Embodiment 22F, where the plurality of shims includes a plurality of a repeating sequence of shims that includes a shim that provides a passageway between the first cavity and at least one of the first dispensing orifices and a shim that provides a passageway between the second cavity and the at least one of the second dispensing orifices.

24F. The method according to either of Embodiments 20F or 21F, where the repeating sequence further includes at least one spacer shim.

25F. The method according to any of Embodiments 20F to 24F including at least 1000 of the shims.

26F. The method according to any of Embodiments 20F to 25F, where the first dispensing orifices and the second dispensing orifices are collinear.

27F. The method according to any of Embodiments 20F to 26F, where the first dispensing orifices are collinear and the second dispensing orifices are collinear but offset from the first dispensing orifices.

Advantages and embodiments of this disclosure are further illustrated by the following examples, but the particular materials and amounts thereof recited in these examples, as well as other conditions and details, should not be construed to unduly limit this disclosure. All parts and percentages are by weight unless otherwise indicated.

STRAP PREPARATION EXAMPLES

Test Methods

Shear-Engaged Peel Test

A 25.4 mm wide by 12.7 mm length hook sample (obtained under the trade designation "KN2854" from 3M Company, St. Paul, Minn.) was affixed to a 25.4 mm strip of printer paper with adhesive tape (obtained under the trade designation "TRM-300 Double Coated Tape" from 3M Company). The 12.7 mm edge of the hook was in the machine direction. The loop was cut into 25.4 mm wide strips along the machine direction of the sample. The hook and loop were mated aligning the machine directions and rolled down with a 2.05 kg rubber coated roller, one cycle forward and back. The construction was loaded in shear with a 500 gram dead weight for 10 seconds.

The peel was measured in a tensile tester, (obtained under the trade designation "INSTRON 5500R Series" from Instron Engineering Corp., Canton, Mass.). The instrument was calibrated to an accuracy of 1 percent of the full scale, and the scale range used for the test was within 10-90 percent of full range. The initial jaw separation was 76.2 mm. The sample was peeled to failure at a constant rate of 300 mm/min. A minimum of 5 tests were performed and averaged for each hook and loop combination.

The maximum peel force and average peel force, both in N/25.4 mm, are reported.

Dynamic Shear Test

The Dynamic Shear Test was used to measure the amount of force required to shear the sample of mechanical fastener hook material from a sample of loop fastener material. A 2.5 cm by 7.5 cm loop sample was cut with the short dimension being the machine direction of the hook. This loop sample was then reinforced with filament tape (obtained under the trade designation "#898 filament tape" from 3M Company). A 1.25 cm by 2.5 cm hook sample ("KN2854") was also prepared. The long dimension is the machine direction of the hook. This sample was laminated to the end of a tab of filament tape 2.5 cm wide by 7.5 cm long. The filament tape was doubled over on itself on the end without hook to cover the adhesive. The hook was then placed centrally on the loop with long tab directions parallel to each other such that the loop tab extended past on the first end and the hook tab extended past on the second end. The hook was rolled down by hand with a 5 kg steel roll, 5 replicates up and back. The assembled tabs were placed into the jaws of a tensile tester (obtained under the trade designation "INSTRON 5500R Series" from Instron Engineering Corp.). The hook tab was placed in the top jaw, and the loop tab was placed in the bottom jaw. The sample was sheared to failure in a 180 degree angle at a crosshead speed of 30.5 cm per minute. The maximum load was recorded in grams. The force required to shear the mechanical fastener strip from the loop material was reported in grams/2.54 cm-width. A minimum of 5 tests were run and averaged for each hook and loop corribination.

Example 1

A co-extrusion die as generally depicted in FIG. 1 was prepared. The thickness of each shim was 2 mil (0.051 mm).

Five identical shims were stacked together to create an orifice width of 10 mils (0.254 mm) to the first cavity. Five identical shims were stacked together to create an orifice width of 10 mils (0.254 mm) to the second cavity. Three identical shims were stacked together to create an effective shim width of 6 mils (0.152 mm) for the spacer between orifices. The shims were formed from stainless steel, with perforations cut by wire electron discharge machining. The height of the first extrusion orifice was cut to 10 mils (0.254 mm). The height of the second set of extrusion orifices was cut to 10 mils (0.254 mm). The extrusion orifices were aligned in a collinear, alternating arrangement with a dispensing surface generally as shown in FIG. 11. The total width of the shim setup was 5 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thirty-five melt flow index polypropylene pellets (obtained under the trade designation "EXXONMOBIL 3155 PP" from ExxonMobil, Irving, Tex.).

The extruder feeding the second cavity was loaded with twelve melt flow index polypropylene pellets (obtained under the trade designation "EXXONMOBL 1024 PP" from ExxonMobil). Other process conditions are listed below:

| | |
|---|---|
| Orifice width | 0.254 mm |
| Orifice height | 0.254 mm |
| Ratio of orifice height to width | 1:1 |
| Ratio of first and second orifice area | 1:1 |
| Land spacing between orifices | 0.152 mm |
| Flow rate of first polymer | 1.7 kg/hr |
| Flow rate of second polymer | 0.47 kg/hr |
| Flow rate ratio first to second polymer | 3.6:1 |
| Extrusion temperature | 205° C. |
| Quench roll temperature | 50° C. |
| Quench takeaway speed | 9 m/min. |

Using an optical microscope, the netting dimensions were measured and are shown below:

| | |
|---|---|
| Netting thickness | 0.275 mm |
| Netting basis weight | 155 g/m$^2$ |
| Bond length in the machine direction | 1.9 mm |
| Net bonding distance in the machine direction (pitch) | 2.08 mm |
| First polymer strand width | 0.260 mm |
| Second polymer strand width | 0.120 mm. |

Figure 13:
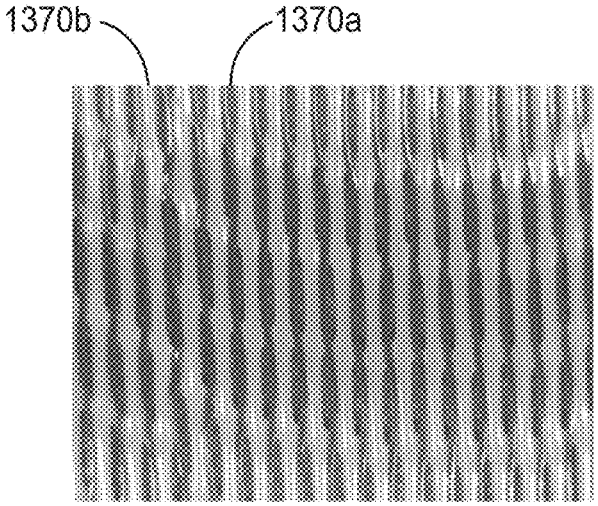
FIG. 13 is a digital optical image at 10× of an exemplary netting described herein (see Example 1)

The resulting netting had strand cross-sections of equal width and thickness with a cross sectional area ratio of 3.6:1. A digital optical image at 10× of the netting is shown in FIG. 13, with first strands 1370*a* and second strands 1370*b*.

Example 2

Example 2 was made with the same die setup and materials as Example 1 except with the following conditions listed below:

| | |
|---|---|
| Orifice width | 0.254 mm |
| Orifice height | 0.254 mm |
| Ratio of orifice height to width | 1:1 |
| Ratio of first and second orifice area | 1:1 |
| Land spacing between orifices | 0.152 mm |
| Flow rate of first polymer | 1.7 kg/hr |
| Flow rate of second polymer | 0.65 kg/hr |

-continued

| | |
|---|---|
| Flow rate ratio first to second polymer | 2.5:1 |
| Extrusion temperature | 205° C. |
| Quench roll temperature | 50° C. |
| Quench takeaway speed | 9 m/min. |

Using an optical microscope, the netting dimensions were measured and are shown below:

| | |
|---|---|
| Netting thickness | 0.35 mm |
| Netting basis weight | 170 g/m$^2$ |
| Bond length in the machine direction | 2.2 mm |
| Net bonding distance in the machine direction (pitch) | 3.6 mm |
| First polymer strand width | 0.235 mm |
| Second polymer strand width | 0.15 mm. |

Figure 14:
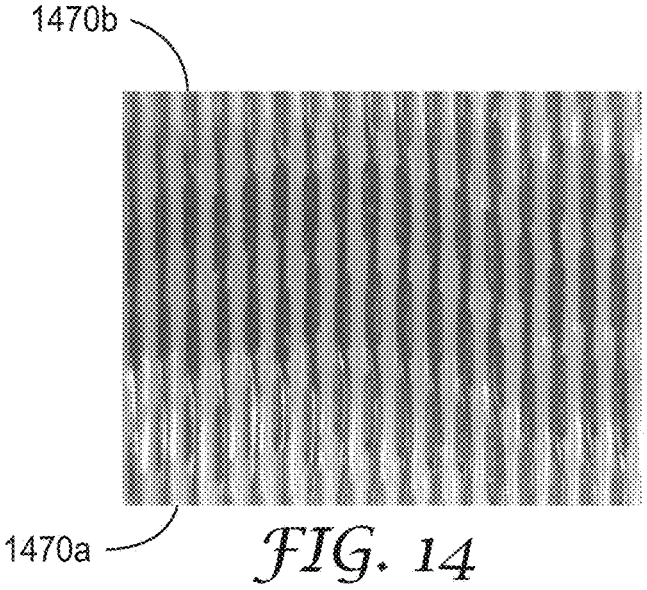
FIG. 14 is a digital optical image at 10× of an exemplary netting described herein (see Example 2)

The resulting netting had first to second strand cross-sections with a cross sectional area ratio of 2.5:1. A digital optical image at 10× of the netting is shown in FIG. 14, with first strands 1470*a* and second strands 1470*b*.

Example 3

A co-extrusion die as generally depicted in FIG. 1 was prepared. The thickness of each shim was 4 mils (0.102 mm). Four identical shims were stacked together to create an orifice width of 16 mils (0.406 mm) to the first cavity. Four identical shims were stacked together to create an orifice width of 16 mils (0.406 mm) to the second cavity. Two spacer shims provided the spacer between orifices. The shims were formed from stainless steel, with perforations cut by wire electron discharge machining. The height of the first extrusion orifice was cut to 30 mils (0.762 mm). The height of the second set of extrusion orifices was cut to 10 mils (0.254 mm). The extrusion orifices were aligned in a collinear arrangement as shown in FIG. 15. The total width of the shim setup was 7.5 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thirty-five melt flow index polypropylene pellets ("EXXONMOBIL 3155 PP").

The extruder feeding the second cavity was loaded with twelve melt flow index polypropylene pellets ("EXXONMOBL 3155 PP"). Other process conditions are listed below:

| | |
|---|---|
| Orifice width for the first cavity | 0.406 mm |
| Orifice height for the first cavity | 0.762 mm |
| Orifice width of the second cavity | 0.406 mm |
| Orifice height of the second cavity | 0.254 mm |
| Ratio of orifice height to width for the oscillating strand | 0.625:1 |
| Ratio of first and second orifice area | 3:1 |
| Land spacing between orifices | 0.203 mm |
| Flow rate of first polymer | 1.36 kg/hr |
| Flow rate of second polymer | 1.32 kg/hr |
| Flow rate ratio first to second polymer | 1:1 |
| Extrusion temperature | 227° C. |
| Quench roll temperature | 55° C. |
| Quench takeaway speed | 6 m/min. |

Using an optical microscope, the netting dimensions were measured and are shown below:

| | |
|---|---|
| Netting thickness | 0.28 mm |
| Netting basis weight | 96 g/m$^2$ |
| Bond length in the machine direction | 2.8 mm |
| Net bonding distance in the machine direction (pitch) | 7.7 mm |
| First polymer strand width | 0.30 mm |
| Second polymer strand width | 0.26 mm. |

Figure 16:
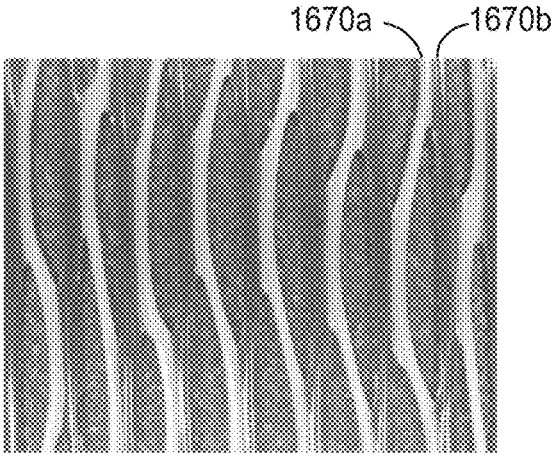
FIG. 16 is a digital optical image at 10× of an exemplary netting described herein (see Example 3)

The resulting netting had first to second strand cross-sections with a cross sectional area ratio of 1:1. A digital optical image at 10× of the netting is shown in FIG. 16, with first strands 1670*a* and second strands 1670*b*.

Example 4

A co-extrusion die as generally depicted in FIG. 1 was prepared. The thickness of each shim was 2 mil (0.051 mm). Three identical shims were stacked together to create an orifice width of 6 mils (0.152 mm) to the first cavity. Three identical shims were stacked together to create an orifice width of 6 mils (0.152 mm) to the second cavity. Two identical shims were stacked together to create an effective shim width of 4 mils (0.102 mm) for the spacer between orifices. The shims were formed from stainless steel, with perforations cut by wire electron discharge machining. The height of the first extrusion orifice was cut to 10 mils (0.254 mm). The height of the second set of extrusion orifices was cut to 10 mils (0.254 mm). The extrusion orifices were aligned in a collinear, alternating arrangement as shown in FIG. 12. The total width of the shim setup was 5 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thirty-five melt flow index polypropylene pellets ("EXXONMOBIL 3155 PP").

The extruder feeding the second cavity was loaded with twelve melt flow index polypropylene pellets ("EXXONMOBL 1024 PP"). Other process conditions are listed below:

| | |
|---|---|
| Orifice width | 0.152 mm |
| Orifice height | 0.254 mm |
| Ratio of orifice height to width | 1.67:1 |
| Ratio of first and second orifice area | 1:1 |
| Land spacing between orifices | 0.102 mm |
| Flow rate of first polymer | 0.5 kg/hr |
| Flow rate of second polymer | 0.18 kg/hr |
| Flow rate ratio first to second polymer | 2.8:1 |
| Extrusion temperature | 205° C. |
| Quench roll temperature | 50° C. |
| Quench takeaway speed | 9 m/min. |

Using an optical microscope, the netting dimensions were measured and are shown below.

| | |
|---|---|
| Netting thickness | 0.16 mm |
| Netting basis weight | 50 g/m$^2$ |
| Bond length in the machine direction | 1.6 mm |
| Net bonding distance in the machine direction (pitch) | 4.6 mm |
| First polymer strand width | 0.110 mm |
| Second polymer strand width | 0.05 mm. |

Figure 17:
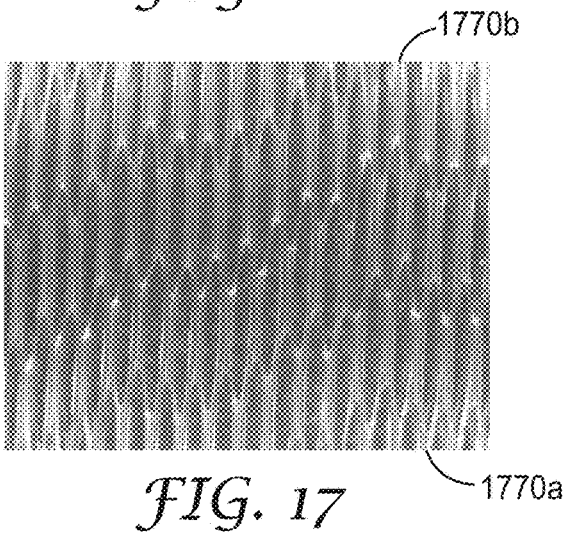
FIG. 17 is a digital optical image at 10× of an exemplary netting described herein (see Example 4)

The resulting netting had first to second strand cross-sections with a cross sectional area ratio of 2.8:1. A digital optical image at 10× of the netting is shown in FIG. 17, with first strands 1770*a* and second strands 1770*b*.

The die swell of the polymer strands was also measured as the polymer exited the die:

| | |
|---|---|
| First polymer die swell width | 0.25 mm |
| Second polymer die swell width | 0.125. |

Example 5

A co-extrusion die as generally depicted in FIG. 1 was prepared. The thickness of each shim was 2 mil (0.051 mm). Two identical shims were stacked together to create an orifice width of 4 mils (0.102 mm) to the first cavity. Two identical shims were stacked together to create an orifice width of 4 mils (0.102 mm) to the second cavity. One shim formed the spacer between orifices. The shims were formed from stainless steel, with perforations cut by wire electron discharge machining. The height of the first extrusion orifice was cut to 10 mils (0.254 mm). The height of the second set of extrusion orifices was cut to 10 mils (0.254 mm). The extrusion orifices with connection to the first cavity were aligned in a collinear arrangement. The extrusion orifices with connection to the second cavity were aligned in a collinear arrangement. The alignment of the first and second set of orifices was offset by 100%, as shown in FIG. 5. The total width of the shim setup was 5 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thirty-five melt flow index polypropylene pellets ("EXXONMOBIL 3155 PP").

The extruder feeding the second cavity was loaded with twelve melt flow index polypropylene pellets ("EXXONMOBL 1024 PP"). Other process conditions are listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.05 mm |
| Flow rate of first polymer | 1.12 kg/hr |
| Flow rate of second polymer | 0.25 kg/hr |
| Flow rate ratio first to second polymer | 4.5:1 |
| Extrusion temperature | 205° C. |
| Quench roll temperature | 50° C. |
| Quench takeaway speed | 4.5 m/min. |

Using an optical microscope, the netting dimensions were measured and are shown below.

| | |
|---|---|
| Netting thickness | 0.35 mm |
| Netting basis weight | 130 g/m$^2$ |
| Bond length in the machine direction | 0.4 mm |
| Net bonding distance in the machine direction (pitch) | 0.83 mm |
| First polymer strand width | 0.160 mm |
| Second polymer strand width | 0.075 mm. |

Figure 18:
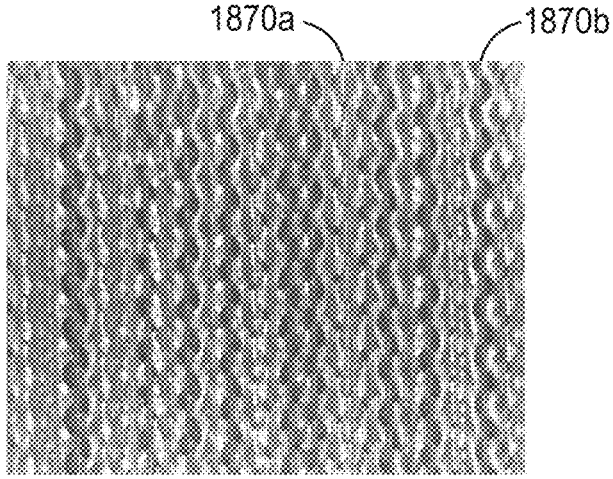
FIG. 18 is a digital optical image at 10× of an exemplary netting described herein (see Example 5)

The resulting netting had first to second strand cross-sections with a cross sectional area ratio of 4.5:1. A digital optical image at 10× of the netting is shown in FIG. 18, with first strands 1870*a* and second strands 1870*b*.

Example 6

Example 6 was made with the same die setup and materials as Example 5 except with the following conditions listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.05 mm |
| Flow rate of first polymer | 1.12 kg/hr |
| Flow rate of second polymer | 0.25 kg/hr |
| Flow rate ratio first to second polymer | 4.5:1 |
| Extrusion temperature | 205° C. |
| Quench roll temperature | 50° C. |
| Quench takeaway speed | 9 m/min. |

Using an optical microscope, the netting dimensions were measured and are shown below:

| | |
|---|---|
| Netting thickness | 0.225 mm |
| Netting basis weight | 65 g/m$^2$ |
| Bond length in the machine direction | 0.6 mm |
| Net bonding distance in the machine direction (pitch) | 1.5 mm |
| First polymer strand width | 0.110 mm |
| Second polymer strand width | 0.070 mm. |

Figure 19:
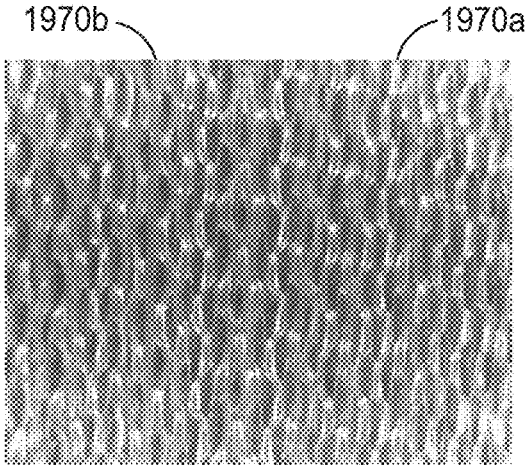
FIG. 19 is a digital optical image at 10× of an exemplary netting described herein (see Example 6)

The resulting netting had first to second strand cross-sections with a cross sectional area ratio of 4.5:1. A digital optical image at 10× of the netting is shown in FIG. 19, with First strands 1970*a* and second strands 1970*b*.

Example 7

Example 7 was made with the same die setup and materials as Example 5 except with the following conditions listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.05 mm |
| Flow rate of first polymer | 2.1 kg/hr |
| Flow rate of second polymer | 0.5 kg/hr |
| Flow rate ratio first to second polymer | 4.1:1 |
| Extrusion temperature | 205° C. |
| Quench roll temperature | 50° C. |
| Quench takeaway speed | 4.5 m/min. |

Using an optical microscope, the netting dimensions were measured and are shown below:

| | |
|---|---|
| Netting thickness | 0.50 mm |
| Netting basis weight | 245 g/m$^2$ |
| Bond length in the machine direction | 0.26 mm |
| Net bonding distance in the machine direction (pitch) | 0.55 mm |
| First polymer strand width | 0.150 mm |
| Second polymer strand width | 0.080 mm. |

Figure 20:
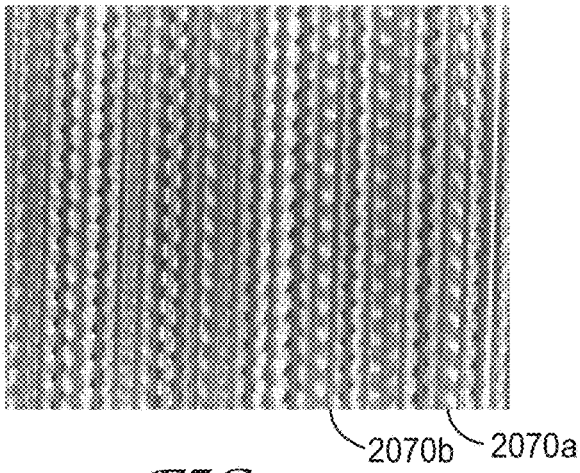
FIG. 20 is a digital optical image at 10× of an exemplary netting described herein (see Example 7)

The resulting netting had first to second strand cross-sections with a cross sectional area ratio of 4.1:1. A digital optical image at 10× of the netting is shown in FIG. 20, with first strands 2070*a* and second strands 2070*b*.

Example 8

Example 8 was made with the same die setup and materials as Example 5 except with the following conditions listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.05 mm |
| Flow rate of first polymer | 2.1 kg/hr |
| Flow rate of second polymer | 0.5 kg/hr |
| Flow rate ratio first to second polymer | 4.1:1 |
| Extrusion temperature | 205° C. |
| Quench roll temperature | 50° C. |
| Quench takeaway speed | 9.0 m/min. |

Using an optical microscope, the netting dimensions were measured and are shown below:

| | |
|---|---|
| Netting thickness | 0.325 mm |
| Netting basis weight | 125 g/m$^2$ |
| Bond length in the machine direction | 0.35 mm |
| Net bonding distance in the machine direction (pitch) | 1.0 mm |
| First polymer strand width | 0.150 mm |
| Second polymer strand width | 0.070 mm |

Figure 21:
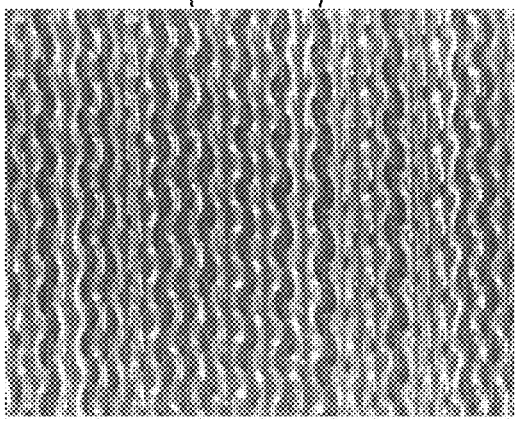
FIG. 21 is a digital optical image at 10× of an exemplary netting described herein (see Example 8)

The resulting netting had first to second strand cross-sections with a cross sectional area ratio of 4.1:1. A digital optical image at 10× of the netting is shown in FIG. 21 with first strands 2170*a* and second strands 2170*b*.

Examples 4-7 demonstrate that the strand net bonding rate increases as the strand polymer throughput rate is increased. The net bonding pitch increases as the drawing rate from the die increases for a given polymer throughput rate.

Example 9

Example 9 was made with the same die setup and materials as Example 5 except with the following conditions listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.05 mm |
| Flow rate of first polymer | 2.0 kg/hr |
| Flow rate of second polymer | 1.0 kg/hr |
| Flow rate ratio first to second polymer | 2.0:1 |
| Extrusion temperature | 205° C. |
| Quench roll temperature | 50° C. |
| Quench takeaway speed | 9 m/min. |

Using an optical microscope, the netting dimensions were measured and are shown below:

| | |
|---|---|
| Netting thickness | 0.325 mm |
| Netting basis weight | 140 g/m$^2$ |
| Bond length in the machine direction | 0.35 mm |
| Net bonding distance in the machine direction (pitch) | 0.9 mm |
| First polymer strand width | 0.170 mm |
| Second polymer strand width | 0.110 mm. |

Figure 22:
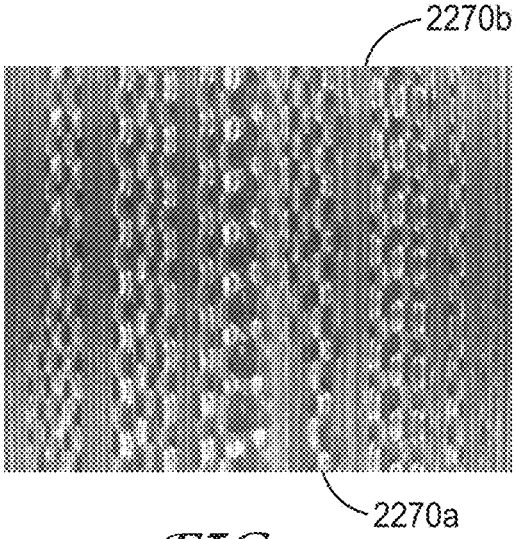
FIG. 22 is a digital optical image at 10× of an exemplary netting described herein (see Example 9)

The resulting netting had first to second strand cross-sections with a cross sectional area ratio of 2.0:1. A digital optical image at 10× of the netting is shown in FIG. 22, with first strands 2270*a* and second strands 2270*b*.

Example 10

Example 10 was made with the same die setup as Example 5.

The inlet fittings on the two end blocks were each connected to a conventional single-screw extruder. A chill roll was positioned adjacent to the distal opening of the co-extrusion die to receive the extruded material. The extruder feeding the first cavity was loaded with twenty-two melt flow index copolymer polypropylene pellets ("VISTAMAX 1120").

The extruder feeding the second cavity was loaded with twenty-two melt flow index copolymer polypropylene pellets ("VISTAMAX 1120"). Other process conditions are listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.05 mm |
| Flow rate of first polymer | 2.0 kg/hr |
| Flow rate of second polymer | 1.18 kg/hr |
| Flow rate ratio first to second polymer | 1.7:1 |
| Extrusion temperature | 205° C. |
| Quench roll temperature | 50° C. |
| Quench takeaway speed | 6.1 m/min. |

Using an optical microscope, the netting dimensions were measured and are shown below:

| | |
|---|---|
| Netting thickness | 0.425 mm |
| Netting basis weight | 225 g/m$^2$ |
| Bond length in the machine direction | 0.35 mm |
| Net bonding distance in the machine direction (pitch) | 0.82 mm |
| First polymer strand width | 0.085 mm |
| Second polymer strand width | 0.050 mm. |

Figure 23:
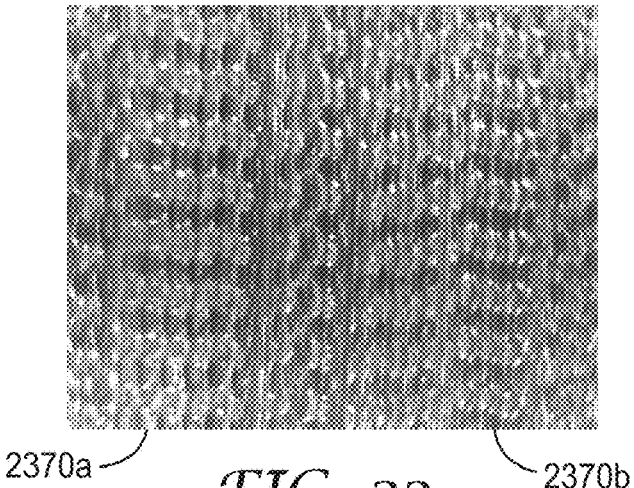
FIG. 23 is a digital optical image at 10× of an exemplary netting described herein (see Example 10)

The resulting netting had first to second strand cross-sections with a cross sectional area ratio of 1.7:1. A digital optical image at 10× of the netting is shown in FIG. 23, with first strands 2370*a* and second strands 2370*b*.

Example 11

A co-extrusion die as generally depicted in FIG. 1 was prepared. The thickness of each shim was 2 mil (0.051 mm). Two identical shims were stacked together to create an orifice width of 4 mils (0.102 mm) to the first cavity. Two identical shims were stacked together to create an orifice width of 4 mils (0.102 mm) to the second cavity. Two identical shims were stacked together to create an effective shim width of 4 mils (0.102 mm) for the spacer between orifices. The shims were formed from stainless steel, with perforations cut by wire electron discharge machining. The height of the first extrusion orifice was cut to 10 mils (0.254 mm). The height of the second set of extrusion orifices was cut to 10 mils (0.254 mm). The extrusion orifices were aligned in a collinear, alternating arrangement as shown in FIG. 24. The total width of the shim setup was 5 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thirty-five melt flow index polypropylene pellets ("EXXONMOBIL 3155 PP").

The extruder feeding the second cavity was loaded with twelve melt flow index polypropylene pellets ("EXXONMOBL 1024 PP"). Other process conditions are listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.102 mm |
| Flow rate of first polymer | 1.2 kg/hr |
| Flow rate of second polymer | 0.21 kg/hr |
| Flow rate ratio first to second polymer | 5.7:1 |
| Extrusion temperature | 205° C. |
| Quench roll temperature | 50° C. |
| Quench takeaway speed | 9 m/min. |

Using an optical microscope, the netting dimensions were measured and are shown below:

| | |
|---|---|
| Netting thickness | 0.175 mm |
| Netting basis weight | 70 g/m$^2$ |
| Bond length in the machine direction | 0.55 mm |
| Net bonding distance in the machine direction (pitch) | 1.4 mm |
| First polymer strand width | 0.125 mm |
| Second polymer strand width | 0.065 mm. |

Figure 25:
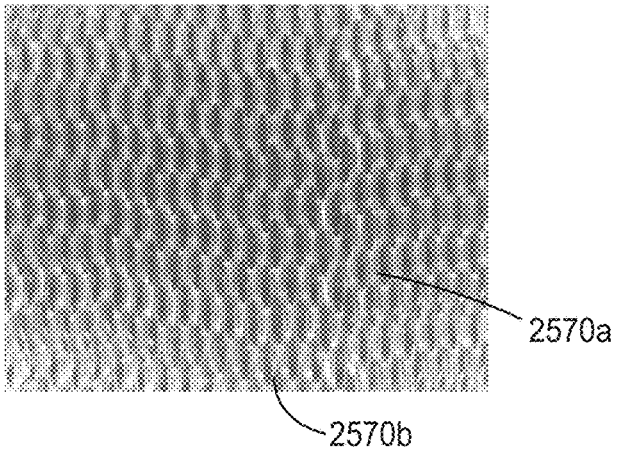
FIG. 25 is a digital optical image at 10× of an exemplary netting described herein (see Example 11)

The resulting netting had first to second strand cross-sections with a cross sectional area ratio of 5.7:1. A digital optical image at 10× of the netting is shown in FIG. 25, with first strands 2570*a* and second strands 2570*b*.

Example 12

Example 12 was made with the same die setup as Example 11.

The inlet fittings on the two end blocks were each connected to a conventional single-screw extruder. A chill roll was positioned adjacent to the distal opening of the co-extrusion die to receive the extruded material. The extruder feeding the first cavity was loaded with one hundred melt flow index polypropylene pellets (obtained under the trade designation "TOTAL 3860" from Total Petrochemicals, Houston, Tex.).

The extruder feeding the second cavity was loaded with twelve melt flow index polypropylene pellets ("EXXONMOBL 1024 PP"). Other process conditions are listed below:

| | |
|---|---|
| Orifice width | 0.102 mm |
| Orifice height | 0.254 mm |
| Ratio of orifice height to width | 2.5:1 |
| Ratio of first and second orifice area | 1:1 |
| Land spacing between orifices | 0.102 mm |
| Flow rate of first polymer | 1.0 kg/hr |
| Flow rate of second polymer | 0.3 kg/hr |
| Flow rate ratio first to second polymer | 3.0:1 |
| Extrusion temperature | 205° C. |
| Quench roll temperature | 50° C. |
| Quench takeaway speed | 9 m/min. |

Using an optical microscope, the netting dimensions were measured and are shown below:

| | |
|---|---|
| Netting thickness | 0.150 mm |
| Netting basis weight | 65 g/m$^2$ |
| Bond length in the machine direction | 0.9 mm |
| Net bonding distance in the machine direction (pitch) | 2.3 mm |
| First polymer strand width | 0.140 mm |
| Second polymer strand width | 0.07 mm. |

Figure 26:
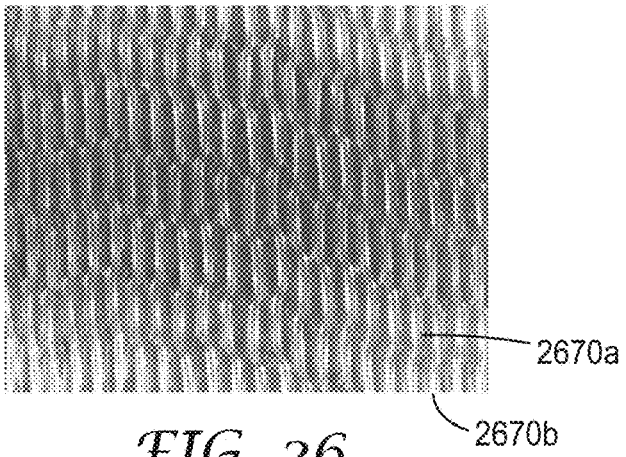
FIG. 26 is a digital optical image at 10× of an exemplary netting described herein (see Example 12)

The resulting netting had first to second strand cross-sections with a cross sectional area ratio of 3:1. A digital optical image at 10× of the netting is shown in FIG. 26, with first strands 2670*a* and second strands 2670*b*.

Example 13

A co-extrusion die as generally depicted in FIG. 1 was prepared. The thickness of each shim was 4 mils (0.102 mm). Eight identical shims were stacked together to create an orifice width of 32 mils (0.813 mm) to the first cavity. Four identical shims were stacked together to create an orifice width of 16 mils (0.406 mm) to the second cavity. Six identical shims were stacked together to create an effective shim width of 24 mils (0.610 mm) for the spacer between orifices. The shims were formed from stainless steel, with perforations cut by wire electron discharge machining. The height of the first extrusion orifice was cut to 30 mils (0.762 mm). The height of the second set of extrusion orifices was cut to 30 mils (0.762 mm). The extrusion orifices were aligned in a collinear, alternating arrangement as shown in FIG. 27. The total width of the shim setup was 5 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thirty-five melt flow index polypropylene pellets ("EXXONMOBIL 3155 PP").

The extruder feeding the second cavity was loaded with twelve melt flow index polypropylene pellets ("EXXONMOBL 3155 PP"). Other process conditions are listed below:

| | |
|---|---|
| Orifice width for the first cavity | 0.813 mm |
| Orifice height for the first cavity | 0.762 mm |
| Orifice width of the second cavity: | 0.406 mm |
| Orifice height of the second cavity: | 0.762 mm |
| Ratio of orifice height to width for oscillating strand | 1.88:1 |
| Ratio of first and second orifice area | 2:1 |
| Land spacing between orifices | 0.610 mm |
| Flow rate of first polymer | 1.5 kg/hr |
| Flow rate of second polymer | 1.73 kg/hr |
| Flow rate ratio first to second polymer | 0.9:1 |
| Extrusion temperature | 205° C. |
| Quench roll temperature | 18° C. |
| Quench takeaway speed | 9 m/min. |

Using an optical microscope, the netting dimensions were measured and are shown below:

| | |
|---|---|
| Netting thickness | 0.56 mm |
| Netting basis weight | 230 g/m$^2$ |
| Bond length in the machine direction | 2.1 mm |

-continued

| | |
|---|---|
| Net bonding distance in the machine direction (pitch) | 16 mm |
| First polymer strand width | 0.30 mm |
| Second polymer strand width | 0.40 mm. |

Figure 28:
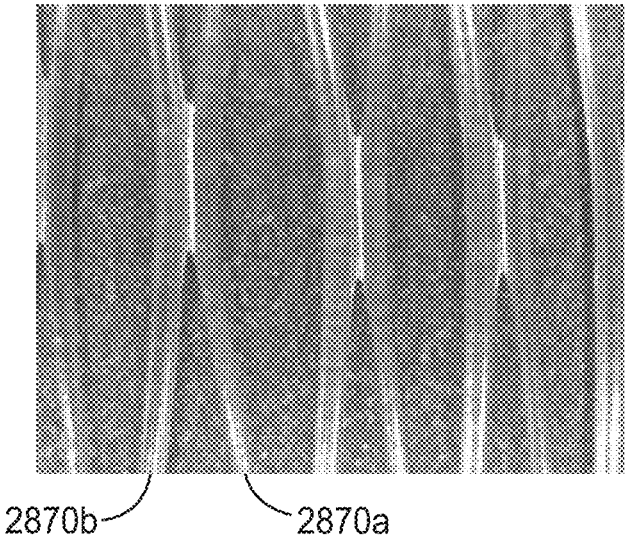
FIG. 28 is a digital optical image at 10× of an exemplary netting described herein (see Example 13)

The resulting netting had first to second strand cross-sections with a cross sectional area ratio of 0.9:1. A digital optical image at 10× of the netting is shown in FIG. 28, with first strands 2870*a* and second strands 2870*b*.

Example 14

A co-extrusion die as generally depicted in FIG. 1 was prepared. The thickness of each shim was 4 mils (0.102 mm). Four identical shims were stacked together to create an orifice width of 16 mils (0.406 mm) to the first cavity. Two identical shims were stacked together to create an orifice width of 8 mils (0.203 mm) to the second cavity. Three identical shims were stacked together to create an effective shim width of 12 mils (0.305 mm) for the spacer between orifices. The shims were formed from stainless steel, with perforations cut by wire electron discharge machining. The height of the first extrusion orifice was cut to 30 mils (0.762 mm). The height of the second set of extrusion orifices was cut to 30 mils (0.762 mm). The extrusion orifices were aligned in a collinear, alternating arrangement as shown in FIG. 29. The total width of the shim setup was 15 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thermoplastic polyurethane pellets (obtained under the trade designation "IROGRAN 440" from Huntsman, Auburn Hills, Mich.).

The extruder feeding the second cavity was loaded with thermoplastic polyurethane pellets ("IROGRAN 440"). Other process conditions are listed below:

| | |
|---|---|
| Orifice width for the first cavity | 0.406 mm |
| Orifice height for the first cavity | 0.762 mm |
| Orifice width of the second cavity | 0.203 mm |
| Orifice height of the second cavity | 0.762 mm |
| Ratio of orifice height to width for oscillating strand | 3.75:1 |
| Ratio of first and second orifice area | 2:1 |
| Land spacing between orifices | 0.305 mm |
| Flow rate of first polymer | 2.1 kg/hr |
| Flow rate of second polymer | 3.2 kg/hr |
| Flow rate ratio first to second polymer | 0.64:1 |
| Extrusion temperature | 218° C. |
| Quench roll temperature | 13° C. |
| Quench takeaway speed | 4.4 m/min. |

Using an optical microscope, the netting dimensions were measured and are shown below:

| | |
|---|---|
| Netting thickness | 0.375 mm |
| Netting basis weight | 325 g/m$^2$ |
| Bond length in the machine direction | 1.5 mm |
| Net bonding distance in the machine direction (pitch) | 5.4 mm |
| First polymer strand width | 0.20 mm |
| Second polymer strand width | 0.25 mm. |

Figure 30:
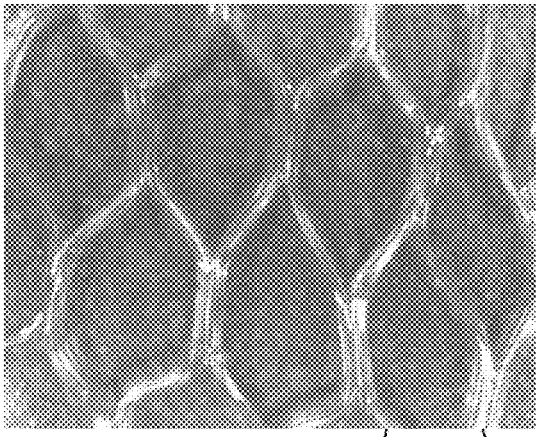
FIG. 30 is a digital optical image at 10× of an exemplary netting described herein (see Example 14)

The resulting netting had first to second strand cross-sections with a cross sectional area ratio of 0.64:1. A digital optical image at 10× of the netting is shown in FIG. 30, with first strands 3070*a* and second strands 3070*b*.

Example 15

Example 15 was made with the same die as Example 14. The inlet fittings on the two end blocks were each connected to a conventional single-screw extruder. A chill roll was positioned adjacent to the distal opening of the co-extrusion die to receive the extruded material. The extruder feeding the first cavity was loaded with styrene ethylene/butylene block copolymer pellets (obtained under the trade designation "KRATON 1657" from Kraton Polymers, Houston, Tex.).

The extruder feeding the second cavity was loaded with styrene ethylene/butylene block copolymer pellets ("KRATON 1657"). Other process conditions are listed below:

| | |
|---|---|
| Orifice width for the first cavity | 0.406 mm |
| Orifice height for the first cavity | 0.762 mm |
| Orifice width of the second cavity | 0.203 mm |
| Orifice height of the second cavity | 0.762 mm |
| Ratio of orifice height to width for oscillating strand | 3.75:1 |
| Ratio of first and second orifice area | 2:1 |
| Land spacing between orifices | 0.305 mm |
| Flow rate of first polymer | 1.6 kg/hr |
| Flow rate of second polymer | 1.6 kg/hr |
| Flow rate ratio first to second polymer | 1:1 |
| Extrusion temperature | 238° C. |
| Quench roll temperature | 18° C. |
| Quench takeaway speed | 1.5 m/min. |

Using an optical microscope, the netting dimensions were measured and are shown below:

| | |
|---|---|
| Netting thickness | 0.625 mm |
| Netting basis weight | 270 g/m$^2$ |
| Bond length in the machine direction | 0.6 mm |
| Net bonding distance in the machine direction (pitch) | 2.1 mm |
| First polymer strand width | 0.25 mm |
| Second polymer strand width | 0.25 mm. |

Figure 31:
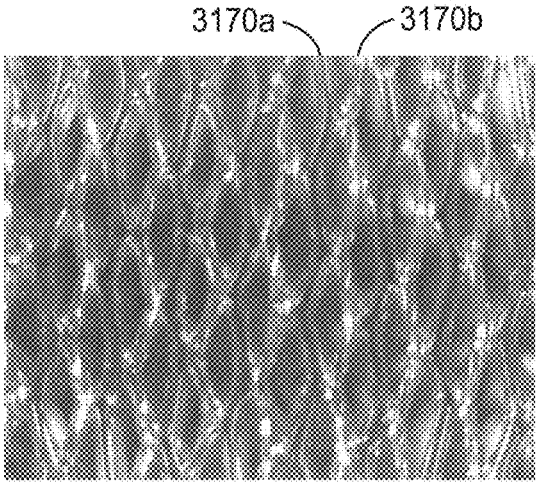
FIG. 31 is a digital optical image at 10× of an exemplary netting described herein (see Example 15)

The resulting netting had first to second strand cross-sections with a cross sectional area ratio of 1:1. A digital optical image at 10× of the netting is shown in FIG. 31, with first strands 3170*a* and second strands 3170*b*.

Example 16

A co-extrusion die as generally depicted in FIG. 1 was prepared. The thickness of each shim was 4 mils (0.102 mm). Four identical shims were stacked together to create an orifice width of 16 mils (0.406 mm) to the first cavity. Two identical shims were stacked together to create an orifice width of 8 mils (0.203 mm) to the second cavity. Two identical shims were stacked together to create an effective shim width of 8 mils (0.203 mm) for the spacer between orifices. The shims were formed from stainless steel, with perforations cut by wire electron discharge machining. The height of the first extrusion orifice was cut to 30 mils (0.762 mm). The height of the second set of extrusion orifices was cut to 30 mils (0.762 mm). The extrusion orifices were aligned in a collinear, alternating arrangement as shown in FIG. 32. The total width of the shim setup was 15 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with styrene isoprene styrene block copolymer pellets (obtained under the trade designation "VECTOR 4114" from Dexco Polymers LP, Houston, Tex.), dry blended at 50% with C-5 hydrocarbon tackifier flakes ("WINGTAC PLUS"), and then dry blended with 1% antioxidant powder (obtained under the trade designation "IRGANOX 1010" from BASF, Luwigshafen, Germany).

The extruder feeding the second cavity was loaded with styrene-isoprene-styrene block copolymer pellets ("VECTOR 4114"), dry blended at 50% with C-5 hydrocarbon tackifier flakes ("WINGTAC PLUS"), and then dry blended with 1% antioxidant powder ("IRGANOX 1010"). Other process conditions are listed below:

| | |
|---|---|
| Orifice width for the first cavity | 0.406 mm |
| Orifice height for the first cavity | 0.762 mm |
| Orifice width of the second cavity | 0.203 mm |
| Orifice height of the second cavity | 0.762 mm |
| Ratio of orifice height to width for oscillating strand | 3.75:1 |
| Ratio of first and second orifice area | 2:1 |
| Land spacing between orifices | 0.203 mm |
| Flow rate of first polymer | 0.55 kg/hr |
| Flow rate of second polymer | 1.43 kg/hr |
| Flow rate ratio first to second polymer | 0.38:1. |
| Extrusion temperature | 150° C. |
| Quench roll temperature | 15° C. |
| Quench takeaway speed | 9 m/min. |

Using an optical microscope, the netting dimensions were measured and are shown below:

| | |
|---|---|
| Netting thickness | 0.10 mm |
| Netting basis weight | 30 g/m$^2$ |
| Bond length in the machine direction | 2.3 mm |
| Net bonding distance in the machine direction (pitch) | 9 mm |
| First polymer strand width | 0.01 mm |
| Second polymer strand width | 0.015 mm |

Figure 33:
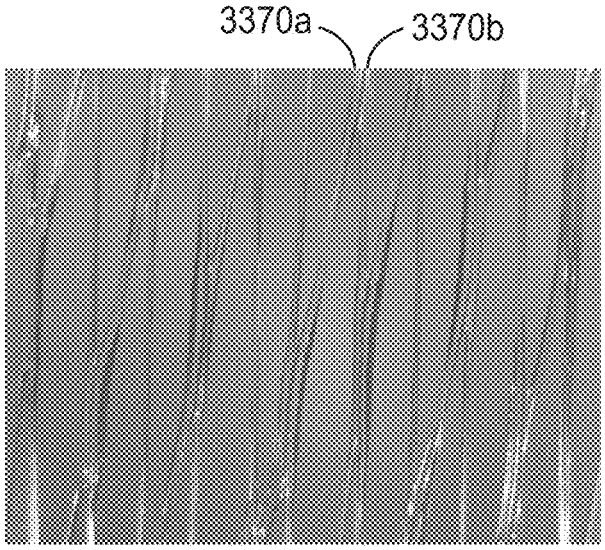
FIG. 33 is a digital photographic image at 10× of an exemplary netting described herein (see Example 16)

The resulting netting had first to second strand cross-sections with a cross sectional area ratio of 0.38:1. A digital optical image at 10× of the netting is shown in FIG. 33, with first strands 3370*a* and second strands 3370*b*.

Example 17

A co-extrusion die as generally depicted in FIG. 1 was prepared. The thickness of each shim was 4 mils (102 mm). The shims were formed from stainless steel, with perforations cut by wire electron discharge machining. The height of the first extrusion orifice was cut to 15 mils (0.381 mm). The height of the second set of extrusion orifices was cut to 5 mils (0.127 mm). The extrusion orifices were aligned in a collinear, alternating arrangement as shown in FIG. 34. The total width of the shim setup was 15 cm.

The inlet fittings on the two end blocks were each connected to a conventional single-screw extruder. A chill roll was positioned adjacent to the distal opening of the co-extrusion die to receive the extruded material. The extruder feeding the first cavity was loaded with thirty-five melt flow index polypropylene pellets ("EXXONMOBIL 3155 PP").

The extruder feeding the second cavity was loaded with twelve melt flow index polypropylene pellets ("EXXONMOBL 1024 PP"), dry blended at 50% with a polypropylene copolymer resin (obtained under the trade designation "VISTAMAX 6202" from ExxonMobil). Other process conditions are listed below:

| | |
|---|---|
| Orifice width for the first cavity | 0.102 mm |
| Orifice height for the first cavity | 0.381 mm |
| Orifice width of the second cavity | 0.102 mm |
| Orifice height of the second cavity | 0.127 mm |
| Ratio of orifice height to width for oscillating strand | 1.25:1 |
| Ratio of first and second orifice area | 3:1 |
| Land spacing between orifices | 0.102 mm |
| Flow rate of first polymer | 0.64 kg/hr |
| Flow rate of second polymer | 0.59 kg/hr. |
| Flow rate ratio first to second polymer | 1.1:1 |
| Extrusion temperature | 232° C. |
| Quench roll temperature | 38° C. |
| Quench takeaway speed | 15.3 m/min. |

Using an optical microscope, the netting dimensions were measured and are shown below:

| | |
|---|---|
| Netting thickness | 0.025 mm |
| Netting basis weight | 8 g/m$^2$ |
| Bond length in the machine direction | 1.3 mm |
| Net bonding distance in the machine direction (pitch) | 8 mm |
| First polymer strand width | 0.02 mm |
| Second polymer strand width | 0.02 mm. |

Figure 35:
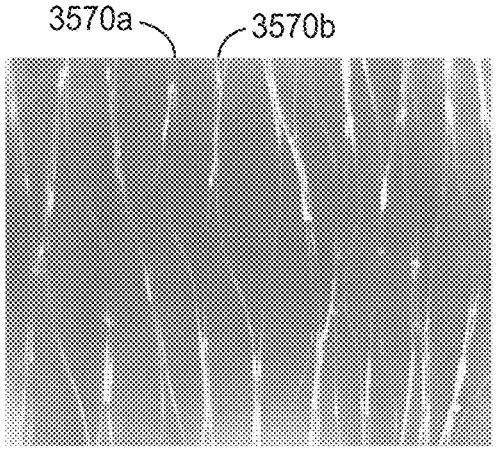
FIG. 35 is a digital optical image at 10× of an exemplary netting described herein (see Example 17)

The resulting netting had first to second strand cross-sections with a cross sectional area ratio of 1.1:1. A digital optical image at 10× of the netting is shown in FIG. 35, with first strands 3570*a* and second strands 3570*b*.

Example 18

Example 18 was made with the same die setup as Example 16. The inlet fittings on the two end blocks were each connected to a conventional single-screw extruder. A chill roll was positioned adjacent to the distal opening of the co-extrusion die to receive the extruded material. The extruder feeding the first cavity was loaded with propylene ethylene copolymer pellets (obtained under the trade designation "VERSIFY 4200" from Dow Chemical, Midland, Mich.), dry blended with 75% polypropylene impact copolymer pellets (obtained under the trade designation "DOW C700-35N" from Dow Chemical).

The extruder feeding the second cavity was loaded with propylene ethylene copolymer pellets ("VERSIFY 4200"). Other process conditions are listed below:

| | |
|---|---|
| Orifice width for the first cavity | 0.406 mm |
| Orifice height for the first cavity | 0.762 mm |
| Orifice width of the second cavity | 0.203 mm |
| Orifice height of the second cavity | 0.762 mm |
| Ratio of orifice height to width for oscillating strand | 3.75:1 |
| Ratio of first and second orifice area | 2:1 |
| Land spacing between orifices | 0.203 mm |
| Flow rate of first polymer | 0.95 kg/hr |
| Flow rate of second polymer | 1.9 kg/hr |
| Flow rate ratio first to second polymer | 0.5:1 |
| Extrusion temperature | 225° C. |
| Quench roll temperature | 95° C. |
| Quench takeaway speed | 2.1 m/min. |

Using an optical microscope, the netting dimensions were measured and are shown below:

| | |
|---|---|
| Netting thickness | 0.50 mm |
| Netting basis weight | 150 g/m$^2$ |
| Bond length in the machine direction | 1.2 mm |

-continued

| | |
|---|---|
| Net bonding distance in the machine direction (pitch) | 3 mm |
| First polymer strand width | 0.25 mm |
| Second polymer strand width | 0.35 mm. |

Figure 36:
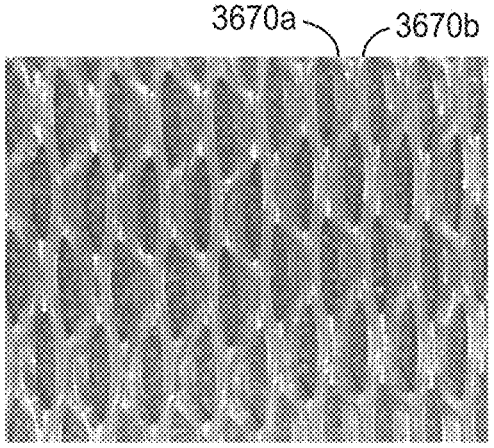
FIG. 36 is a digital optical image at 10× of an exemplary netting described herein (see Example 18)

The resulting netting had first to second strand cross-sections with a cross sectional area ratio of 0.5:1. A digital optical image at 10× of the netting is shown in FIG. 36, with first strands 3670*a* and second strands 3670*b*.

Example 19

A co-extrusion die as generally depicted in FIG. 1 was prepared. In this example there are 3 zones of a continuous orifice that extrudes a film, and 2 zones of strand orifices to produce net. The sequence of zones is one film zone, one net zone, one film zone, one net zone, and then one film zone. Each zone was about 2 cm wide. The total width of the shim setup was 9.5 cm. The extrusion orifices were aligned in a collinear arrangement as shown in FIG. 37.

For the net zones, the following sequence was stacked together for a net extrusion width of 20 mm. The thickness of each shim was 4 mils (0.102 mm). Four identical shims were stacked together to create an orifice width of 16 mils (0.406 mm) to the first cavity. Two identical shims were stacked together to create an orifice width of 8 mils (0.203 mm) to the second cavity. Two identical shims were stacked together to create an effective shim width of 8 mils (0.203 mm) for the spacer between orifices. The shims were formed from stainless steel, with perforations cut by wire electron discharge machining. The height of the first extrusion orifice was cut to 30 mils (0.762 mm). The height of the second set of extrusion orifices was cut to 30 mils (0.762 mm). The extrusion orifices were aligned in a collinear, alternating arrangement.

For the film zones, 190 identical shims were stacked together to create an effective orifice width of 760 mils (19 mm). The shim passageway of these shims was connected to the first cavity.

The inlet fittings on the two end blocks were each connected to a conventional single-screw extruder. A chill roll was positioned adjacent to the distal opening of the co-extrusion die to receive the extruded material. The extruder feeding the first cavity was loaded with polypropylene copolymer pellets ("VISTAMAX 6202").

The extruder feeding the second cavity was loaded with polypropylene copolymer pellets ("VISTAMAX 6202"). Other process conditions are listed below:

For the net zones:

| | |
|---|---|
| Orifice width for the first cavity | 0.406 mm |
| Orifice height for the first cavity | 0.762 mm |
| Orifice width of the second cavity | 0.203 mm |
| Orifice height of the second cavity | 0.762 mm |
| Ratio of orifice height to width for oscillating strand | 3.75:1 |
| Ratio of first and second orifice area | 2:1 |
| Land spacing between orifices | 0.203 mm. |

For the film zones:

| | |
|---|---|
| Orifice height connected to the first cavity | 0.762 mm |
| Flow rate of first polymer | 1.4 kg/hr |
| Flow rate of second polymer | 0.6 kg/hr |

-continued

| | |
|---|---|
| Extrusion temperature | 218° C. |
| Quench roll temperature | 15° C. |
| Quench takeaway speed | 1.5 m/min. |

Using an optical microscope, the netting dimensions were measured and are shown below:

| | |
|---|---|
| Netting thickness | 0.50 mm |
| Netting basis weight | 220 g/m$^2$ |
| Bond length in the machine direction | 0.9 mm |
| Net bonding distance in the machine direction (pitch) | 2.6 mm |
| First polymer strand width | 0.17 mm |
| Second polymer strand width | 0.21 mm. |

The resulting netting had first to second strand cross-sections with a cross sectional area ratio of 0.9:1. A digital optical image of netting 3800 is shown in FIG. 38, with first strands 3870*a*, second strands 3870*b*, film regions 3899*a*, 3899*b*, and 3899*c* attached to netting 3871*a* and 3871*b*.

Example 20

Example 20 was made with the same die and materials as Example 17. Other process conditions are listed below:

| | |
|---|---|
| Flow rate of first polymer | 1.2 kg/hr |
| Flow rate of second polymer | 1.1 kg/hr |
| Flow rate ratio first to second polymer | 1.1:1 |
| Extrusion temperature | 232° C. |
| Quench roll temperature | 15° C. |
| Quench takeaway speed | 18 m/min. |

Using an optical microscope, the netting dimensions were measured and are shown below:

| | |
|---|---|
| Netting thickness | 0.06 mm |
| Netting basis weight | 14 g/m$^2$ |
| Bond length in the machine direction | 1.5 mm |
| Net bonding distance in the machine direction (pitch) | 5 mm |
| First polymer strand width | 0.03 mm |
| Second polymer strand width | 0.03 mm. |

The net material was then stretched using a seven roll fiber stretching process. The process rolls were 19 cm diameter. The roll temperatures and speed were run as follows:

| | | |
|---|---|---|
| Roll 1 | 80° C. | 4 m/min |
| Roll 2 | 80° C. | 4 m/min |
| Roll 3 | 80° C. | 4 m/min |
| Roll 4 | 20° C. | 18 m/min |
| Roll 5 | 20° C. | 18 m/min |
| Roll 6 | 20° C. | 18 m/min |
| Roll 7 | 80° C. | 18 m/min. |

The net was collected without tension after roll 7 by allowing the web to drop into a box. This allows the net to relax and form a web that has a bulk thickness greater than the initial material.

| | |
|---|---|
| Initial net thickness | 0.50 mm |
| Final net thickness | 5 mm |
| First strand width after stretching | 0.015 mm |
| Second strand width after stretching | 0.015 mm. |

Figure 39:
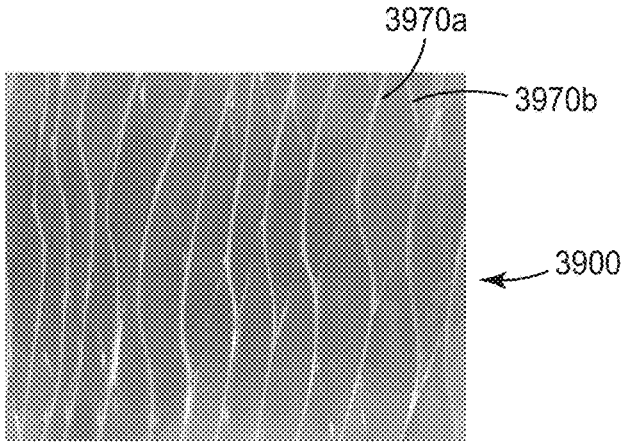
FIG. 39 is a digital optical image at 10× of an exemplary netting described herein (see Example 20)

A digital optical image of the netting 3900 is shown in FIG. 39, with first strands 3970*a* and second strands 3970*b*.

Example 21

A layered net sample was prepared as loop for a hook and loop attachment article. A hook engaging net was prepared and intermittently bonded to a base net layer as follows.

The engagement net layer was prepared with the same die setup and materials as Example 17. Other process conditions are listed below:

| | |
|---|---|
| Flow rate of first polymer | 2.7 kg/hr |
| Flow rate of second polymer | 2.7 kg/hr |
| Flow rate ratio first to second polymer | 1:1 |
| Extrusion temperature | 232° C. |
| Quench roll temperature | 20° C. |
| Quench takeaway speed | 10 m/min. |

The netting was stretched in line 6:1. It was then allowed to relax and curl into a bulk thickness greater than a flat laid example. The stretched, relaxed netting had a basis weight of4 g/m$^2$.

The loop article base net layer was prepared with the same die as Example 17. The inlet fittings on the two end blocks were each connected to a conventional single-screw extruder. A chill roll was positioned adjacent to the distal opening of the co-extrusion die to receive the extruded material. The extruder feeding the first and second cavity was loaded with thirty-five melt flow index polypropylene pellets ("EXXONMOBIL 3155 PP"). Other process conditions are listed below:

| | |
|---|---|
| Flow rate of first polymer | 2.7 kg/hr |
| Flow rate of second polymer | 2.7 kg/hr |
| Flow rate ratio first to second polymer | 1:1 |
| Extrusion temperature | 232° C. |
| Quench roll temperature | 20° C. |
| Quench takeaway speed | 15 m/min. |
| Netting basis weight | 16 g/m$^2$ |

Figure 40:
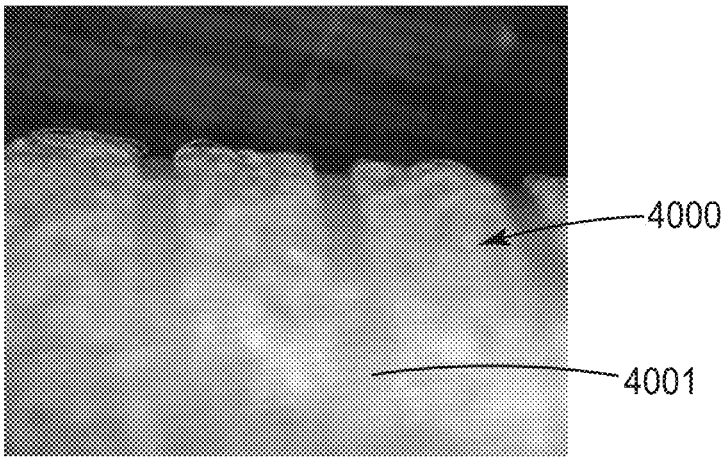
FIG. 40 is a digital optical image at 10× of an exemplary netting described herein having bond lines (see Example 21)

Three layers of engagement net were bonded to one layer of base net with ultrasonic welding. Bonding was performed on a sonic bonder (obtained under the trade designation" 0 MHZ BRANSON 2000AED" from Branson Ultrasonics Corporation, Danbury, Conn.) with a 19 mm×165 mm flat horn. The anvil was a grooved plate which had a bond pitch of 3.6 mm and a bond width of 1 mm. The bonding times were between 0.5 and 0.75 second with a 0.5 second hold time after the bond. The bonding energy was adjusted to provide a secure bond without excessive melting of the strand. Bond forces were about 240 kg. A digital optical image at 10× of the netting 4000 having bond lines 4001 is shown in FIG. 40.

Peel force to hook was measured with the Shear-Engaged Peel Test. Ten replicates were performed. The average peel force was calculated at 82 grams.

Dynamic shear was measured with the 180 Degree Dynamic Shear Test. Ten replicates were performed. The average shear value of the ten replicates was 1993 grams.

Example 22

A layered net sample was prepared as loop for a hook and loop attachment article similar to Example 21. In this example, three layers of the hook engaging net was intermittently bonded to a base net layer of 30 g/m$^2$ polypropylene spunbond nonwoven. A digital optical image at 10× of the netting 4100 having bond lines 4101 is shown in FIG. 41.

Peel force to hook was measured with the Shear-Engaged Peel Test. Ten replicates were performed. The average peel force was calculated at 100 grams.

Dynamic shear was measured with the Dynamic Shear Test. Ten replicates were performed. The average shear value of the ten replicates was 2326 grams.

Example 23

A layered net sample was prepared as loop for a hook and loop attachment article. A hook engaging net was prepared and intermittently bonded to a base net layer as follows.

The engagement net layer was prepared with the same die setup as Example 17. The inlet fittings on the two end blocks were each connected to a conventional single-screw extruder. A chill roll was positioned adjacent to the distal opening of the co-extrusion die to receive the extruded material. The extruder feeding the first and second cavity was loaded with thirty-five melt flow index polypropylene pellets ("EXXONMOBIL 3155 PP). Other process conditions are listed below:

| | |
|---|---|
| Flow rate of first polymer | 2.7 kg/hr |
| Flow rate of second polymer | 2.7 kg/hr |
| Flow rate ratio first to second polymer | 1:1 |
| Extrusion temperature | 232° C. |
| Quench roll temperature | 20° C. |
| Quench takeaway speed | 40 m/min |
| Netting basis weight | 5.5 g/m$^2$. |

The loop article base net layer was prepared the same as the base net layer of Example 21.

Three layers of engagement net were bonded to one layer of base net with ultrasonic welding. Bonding was performed on a sonic bonder ("20 MHZ BRANSON 2000AED") with a 19 mm×165 mm flat horn. The anvil was a grooved plate which had a bond pitch of 3.6 mm and a bond width of 1 mm. This example is an arcuate fiber construction whereby the fibers are pressed into the grooves between the bonding ribs using an array of wires. This forms fiber loops in the final loop construction. The bonding times were between 0.5 and 0.75 second with a 0.5 second hold time after the bond. Bond forces were approximately 240 kg. A digital optical image at 10× of the netting 4200 having bond lines 4201 is shown in FIG. 42.

Peel force to hook was measured with the Shear-Engaged Peel Test. Ten replicates were performed. The average peel force was calculated at 294 grams.

Dynamic shear was measured with the Dynamic Shear Test. Ten replicates were performed. The average shear value of the ten replicates was 3950 grams.

Example 24

Figure 43:
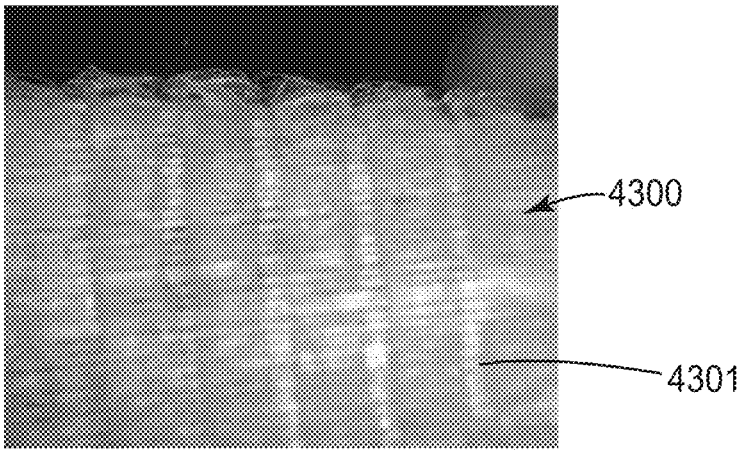
FIG. 43 is a digital optical image at 10× of an exemplary netting described herein having bond lines (see Example 24)

A layered net sample was prepared as loop for a hook and loop attachment article similar to Example 23. In this example, four layers of the hook engaging net was intermittently bonded to a base net layer of beta nucleated polypropylene film. A digital optical image at 10× of the netting 4300 having bond lines 4301 is shown in FIG. 43.

Peel force to hook was measured with the Shear-Engaged Peel Test. Ten replicates were performed. The average peel force was calculated at 318 grams.

Dynamic shear was measured with the Dynamic Shear Test. Ten replicates were performed. The average shear value of the ten replicates was 4209 grams.

Respirator Example

Mechanical Testing

Mechanical testing on headbands was performed using a model 4302 tensile testing unit, from Instron Inc., Norwood, Mass., that was fitted with a 1 kilonewton (kN) load cell. Tensile and hysteresis tests were performed on single headband strands that were equilibrated to a room temperature of about 21 degrees centigrade. Tensile testing was conducted using a gauge length of 101 millimeters (mm) and a crosshead speed of 8.5 mm/second. Tensile values were reported as the Maximum Load in Newtons (N) and Maximum Percent Elongation to the point of failure. Hysteresis testing was conducted using the same gauge length as the tensile test except the test specimen was cycled through three elongations. The first hysteresis cycle extended the headband to 300% elongation of the starting gauge length and returned to the starting length, using a crosshead speed of 8.5 mm/second. The two subsequent extensions cycles were performed to 50% elongation at a crosshead speed of 4.2 mm/second. Hysteresis values, recorded at the 50% elongation point of the third extension, were reported as the Peak Force in Newtons.

Example 25 and Comparative Example 25C

Figure 52:
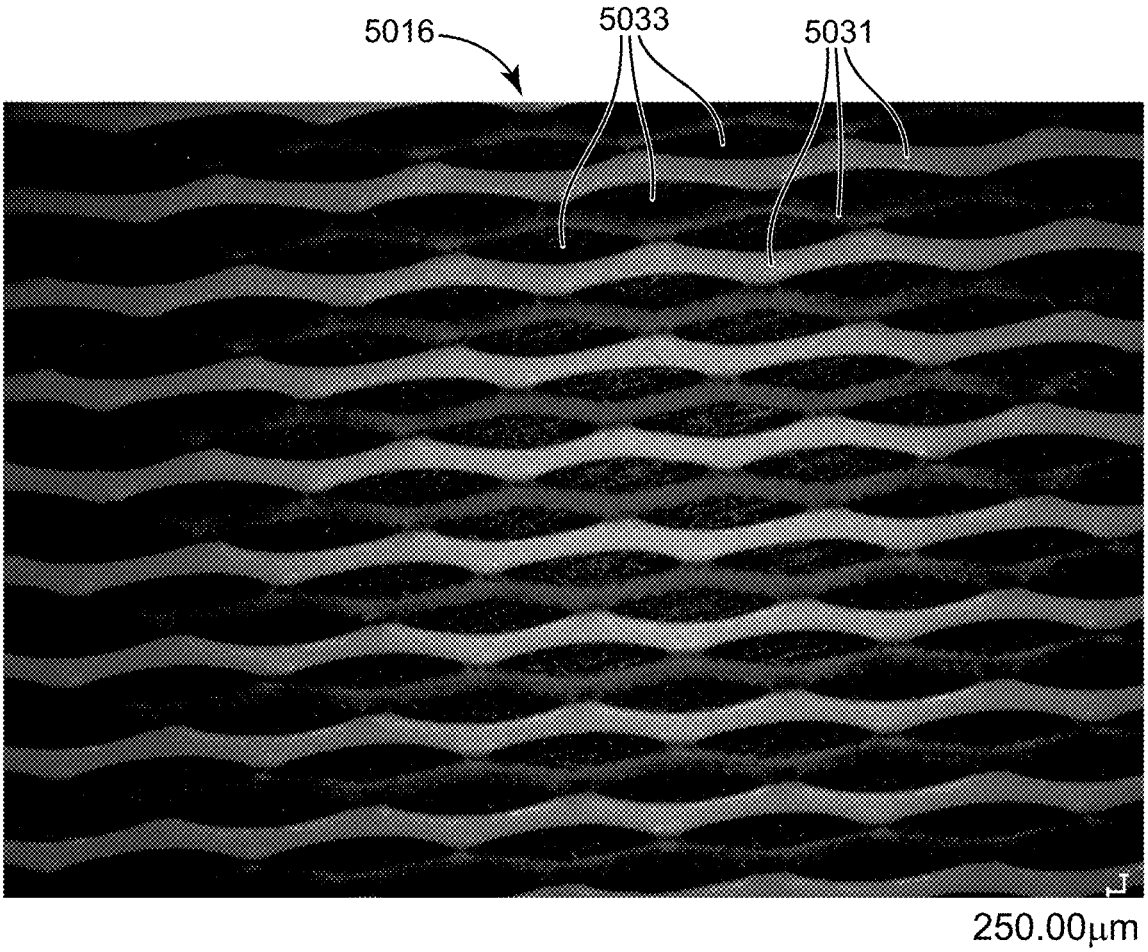
FIG. 52 is a photograph of an elastic netting 5016 that has an array of polymeric strands 5033 adapted for use in a respirator of Examples.

Head band straps were prepared from an elastomeric stranded mesh. The dual-stranded mesh was made as described in U.S. Patent Application Ser. No. 61/779,997 filed Mar. 13, 2013, entitled NETTINGS, DIES, AND METHODS OF MAKING THE SAME. The dual-strand mesh was formed of units of side-by-side strands of generally triangular-shaped waves having an amplitude of 0.25 millimeter (mm) and periodicity of 3 mm; the dual strand units being fused together at the peaks of the strand waves. The mesh was an assembly of the strand units that were also joined at triangular peaks as depicted in FIG. 52 as elastic netting 5016. A first strand 5031 of the unit was generally rectangular in cross section, having a diameter of 0.35 mm, and was composed of styrene-ethylene-butylene block copolymer elastomer ("Kraton G" from Kraton Polymers, Houston, Tex.) blended with 2% red color concentrate, ("RED POLYPROPYLENE PIGMENT" from Clariant, Minneapolis, Minn.). A second strand 5033 of the two-strand unity was 0.40 mm in diameter with a round cross section and comprised of styrene-ethylene-butylene block copolymer elastomer ("Kraton G" from Kraton Polymers, Houston, Tex.) blended with 2% white color concentrate, ("WHITE POLYPROPYLENE PIGMENT" from Clariant, Minneapolis, Minn.). The nominal thickness of the resulting netting was 0.7 mm, and it had a basis weight of 270 grams per square meter (g/m$^2$).

Head band straps were cut from the dual-stranded netting along the strand length. The upper strap was 360 mm long and 8 mm wide, while the lower strap was 305 mm long and had the same width. Mechanical properties of an individual strap were determined as described in the Mechanical Testing procedure and are given in Table 1, along with values of a Comparative head band strap removed from a commercially available respirator type 8210, 3M Company, St. Paul Minn.:

TABLE 1

| | Max Load Newton (N) | Max Elongation % | 3rd Cycle Peak Force N |
|---|---|---|---|
| Comparative 25C | 67 | 750 | 2 |
| Example 25 | 68 | 498 | 1.8 |

Two of the dual-stranded straps as described were ultrasonically welded to the mask body of a commercially available respirator type 8210, 3M Company, St. Paul Minn., similar to the respirator illustrated in FIGS. 49 and 51 (with the exception of not having the inner cover web 5032). Welding was done with a flat-faced horn against a flat anvil using a model 2000 welder from Branson Inc., Danbury, Conn. The welder was operated at 3500 watts and 20 kilohertz for a dwell time of 0.15 seconds and an actuation force of approximately 250 N. Masks made using the dual-stranded headbands of the present disclosure were compared to the 3M commercially available respirator 8210™ of Example 25C. The data set forth in Table 1 shows that straps of the present disclosure exhibited very good tensile strength and elongation suitable for use in a respirator.

This disclosure may take on various modifications and alterations without departing from its spirit and scope. Accordingly, this disclosure is not limited to the above-described but is to be controlled by the limitations set forth in the following claims and any equivalents thereof.

This disclosure also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A respirator that comprises:

a mask body; and a harness that comprises one or more elastic straps that are each joined to the mask body on opposing sides thereof, each of the one or more elastic straps comprising a netting that has an array of polymeric strands, wherein two polymeric strands of the array of polymeric strands are periodically joined together at bond regions throughout the array, wherein the two polymeric strands intersect each other at the bond regions but do not substantially cross over each other past the intersection.

2. The respirator of claim 1, wherein each of the one or more elastic straps has a thickness of greater than 0 millimeters and up to 1 millimeter.

3. The respirator of claim 1, wherein at least one of the one or more elastic straps comprises first and second layers of the netting, the first and second layers of the netting being secured to each other.

4. The respirator of claim 3, wherein at least one of the one or more elastic straps comprises first and second layers of the netting, the first and second layers of the netting being secured directly to each other.

5. The respirator of claim 4, wherein the first netting layer has a first color that is different from a color of the second netting layer.

6. The respirator of claim 5, wherein the first and second netting layers are secured to one another such that the array of polymeric strands in each of the layers correspond to one another when viewed from a plane projected onto a major surface of the at least one of the one or more elastic straps.

7. The respirator of claim 1, wherein open spaces of the netting are air permeable.

8. The respirator of claim 7, wherein the open spaces are about 0.1 to 40 $mm^2$ in size.

9. The respirator of claim 8, wherein the strands have a cross-sectional area of about 0.03 to 1 $mm^2$.

10. The respirator of claim 9, wherein one or more of the strands comprise a block copolymer.

11. The respirator of claim 10, wherein the block copolymer is a styrene-ethylene-butylene block copolymer.

12. The respirator of claim 11 being a filtering face-piece respirator.

13. The respirator of claim 12, wherein the harness comprises first and second straps that are each ultrasonically welded to first and second sides of the mask body.

* * * * *